US009310165B2

(12) United States Patent
Bell et al.

(10) Patent No.: US 9,310,165 B2
(45) Date of Patent: Apr. 12, 2016

(54) PROJECTILE SIGHTING AND LAUNCHING CONTROL SYSTEM

(71) Applicants: John Curtis Bell, Honolulu, HI (US); Curtis King Bell, Portland, OR (US)

(72) Inventors: John Curtis Bell, Honolulu, HI (US); Curtis King Bell, Portland, OR (US)

( * ) Notice: Subject to any disclaimer, the term of this patent is extended or adjusted under 35 U.S.C. 154(b) by 0 days.

(21) Appl. No.: 13/925,620

(22) Filed: Jun. 24, 2013

(65) Prior Publication Data

US 2016/0069644 A1 Mar. 10, 2016

Related U.S. Application Data

(63) Continuation-in-part of application No. 12/607,822, filed on Oct. 28, 2009, now Pat. No. 8,468,930, which is a continuation-in-part of application No. 11/120,701, filed on May 3, 2005, now Pat. No. 7,624,528, which is a continuation-in-part of application No. 10/441,422, filed on May 19, 2003, now Pat. No. 6,886,287.

(60) Provisional application No. 60/381,922, filed on May 18, 2002.

(51) Int. Cl.
*F41G 5/18* (2006.01)
*F41G 3/08* (2006.01)

(52) U.S. Cl.
CPC ... *F41G 5/18* (2013.01); *F41G 3/08* (2013.01)

(58) Field of Classification Search
CPC ..... F41G 5/02; F41G 5/04; F41G 5/06; F41G 5/08; F41G 5/18; F41G 3/08
USPC ..... 89/41.06, 41.05, 41.07, 41.17; 235/404, 235/407
See application file for complete search history.

(56) References Cited

U.S. PATENT DOCUMENTS

| | | | |
|---|---|---|---|
| 3,123,915 | A | 3/1964 | Wilkinson |
| 3,464,770 | A | 9/1969 | Schmidt |
| 3,506,330 | A | 4/1970 | Allen |
| 3,579,840 | A | 5/1971 | Heinzel |
| 3,634,940 | A | 1/1972 | Vockenhuber |
| 3,737,232 | A | 6/1973 | Milburn, Jr. |
| 3,766,656 | A | 10/1973 | Westphal |
| 3,782,822 | A | 1/1974 | Spence |

(Continued)

FOREIGN PATENT DOCUMENTS

WO WO 88/02841 * 4/1988

*Primary Examiner* — Stephen M Johnson
(74) *Attorney, Agent, or Firm* — Knobbe Martens Olson & Bear LLP

(57) ABSTRACT

A remote controlled projectile sighting and launching system (RCPSLS) is disclosed. In some embodiments, such a system can be compliant with the Americans with Disabilities Act (ADA) and can automatically facilitate moving targets, unmanned operation of a projectile launching device and automatic friendly-fire over-ride. In some embodiments, such a system can include network-linked components such as a plurality of auto-adjusting aiming units (AAAU), gimbaled robotic apparatuses (GRA), trigger activation devices (TAD), and transport vehicles (TRV). In some implementations, a plurality of shooters and/or command centers that are able to view and operate a plurality of AAAUs, TADs, GRAs, and TRVs from a remote location(s). The system can be configured to be capable of discerning friendly confirmed target coordinates (CTC) from enemy CTC and is able to launch a plurality of preselected projectiles (PP) from a plurality of preselected projectile launching devices (PPLD).

15 Claims, 47 Drawing Sheets

(56) References Cited

U.S. PATENT DOCUMENTS

| | | | | |
|---|---|---|---|---|
| 3,824,699 | A | 7/1974 | Lenz et al. | |
| 3,845,276 | A | 10/1974 | Kendy et al. | |
| 4,062,267 | A | 12/1977 | Vinches et al. | |
| 4,108,551 | A | 8/1978 | Weber | |
| 4,200,355 | A | 4/1980 | Williams, Jr. | |
| 4,317,304 | A | 3/1982 | Bass | |
| 4,375,725 | A | 3/1983 | Orlob | |
| 4,497,548 | A | 2/1985 | Burris | |
| 4,561,204 | A | 12/1985 | Binion | |
| 4,570,530 | A * | 2/1986 | Armstrong | 89/41.05 |
| 4,777,352 | A | 10/1988 | Moore | |
| 4,787,291 | A | 11/1988 | Frohock, Jr. | |
| 4,787,739 | A | 11/1988 | Gregory | |
| 4,993,833 | A | 2/1991 | Lorey et al. | |
| 4,998,811 | A | 3/1991 | Basta | |
| 5,005,308 | A | 4/1991 | Parks | |
| 5,020,892 | A | 6/1991 | Glover et al. | |
| 5,180,875 | A | 1/1993 | Berry, Jr. et al. | |
| 5,181,323 | A | 1/1993 | Cooper | |
| 5,194,908 | A | 3/1993 | Lougheed et al. | |
| 5,355,609 | A | 10/1994 | Schenke | |
| 5,374,986 | A | 12/1994 | Solinsky | |
| 5,388,005 | A | 2/1995 | Wilson | |
| 5,400,539 | A | 3/1995 | Moore | |
| 5,491,546 | A | 2/1996 | Wascher et al. | |
| 5,511,317 | A | 4/1996 | Allen | |
| 5,513,440 | A | 5/1996 | Murg | |
| 5,555,662 | A | 9/1996 | Teetzel | |
| 5,584,137 | A | 12/1996 | Teetzel | |
| 5,669,174 | A | 9/1997 | Teetzel | |
| 5,680,725 | A | 10/1997 | Bell | |
| 5,686,690 | A | 11/1997 | Lougheed et al. | |
| 5,745,287 | A | 4/1998 | Sauter | |
| 5,771,595 | A | 6/1998 | Bell | |
| 5,771,623 | A | 6/1998 | Pernstich et al. | |
| 5,822,905 | A | 10/1998 | Teetzel | |
| 5,898,519 | A | 4/1999 | Palmer | |
| 5,974,940 | A | 11/1999 | Madni et al. | |
| 6,046,868 | A | 4/2000 | Theriault et al. | |
| 6,111,692 | A | 8/2000 | Sauter | |
| 6,199,286 | B1 | 3/2001 | Reed et al. | |
| 6,208,461 | B1 | 3/2001 | Gaber | |
| 6,252,706 | B1 | 6/2001 | Kaladgew | |
| 6,260,466 | B1 | 7/2001 | Humphreys | |
| 6,266,911 | B1 | 7/2001 | Suzuki | |
| 6,269,581 | B1 | 8/2001 | Groh | |
| 6,295,754 | B1 | 10/2001 | Otteman et al. | |
| 6,397,483 | B1 | 6/2002 | Perkins | |
| 6,449,419 | B1 | 9/2002 | Brough et al. | |
| 6,487,809 | B1 | 12/2002 | Gaber | |
| 6,519,083 | B2 | 2/2003 | Heinrich | |
| 6,563,636 | B1 | 5/2003 | Baun et al. | |
| 6,603,602 | B1 | 8/2003 | McWilliams | |
| 6,679,609 | B2 | 1/2004 | Ohtomo et al. | |
| 6,705,037 | B2 | 3/2004 | Van Kirk | |
| 6,813,025 | B2 | 11/2004 | Edwards | |
| 6,886,287 | B1 | 5/2005 | Bell et al. | |
| 7,350,329 | B1 | 4/2008 | Bell et al. | |
| 7,624,528 | B1 | 12/2009 | Bell et al. | |
| 7,703,719 | B1 | 4/2010 | Bell et al. | |
| 8,468,930 | B1 | 6/2013 | Bell | |
| 2002/0051288 | A1 | 5/2002 | Shirai et al. | |
| 2004/0020099 | A1 | 2/2004 | Osborn, II | |
| 2005/0213962 | A1 | 9/2005 | Gordon | |
| 2008/0121097 | A1 * | 5/2008 | Rudakevych et al. | 89/28.05 |

* cited by examiner

| | 694A X Offset | 694B Y Offset | 694C Range | 694D Wind | 694E Bullet Data | 694F Atmosphere | 694G Slope | 694H Altitude |
|---|---|---|---|---|---|---|---|---|
| 696A | + 1 MOA | − 2 MOA | 321 meters | X= −5 mph<br>Y= 0 mph<br>Z = 1 mph | 120 grains projectile<br>120 grains load | 42% humidity<br>29.84 in (N/Amb)<br>78°F | 8° | 1,122 feet |
| 696B | 0 MOA | + 1 MOA | 100 meters | X= 1 mph<br>Y= 1 mph<br>Z = 0 mph | 120 grains projectile<br>120 grains load | 61% humidity<br>29.62 in<br>65°F | 5° | 2,486 feet |
| 696C | − 2 MOA | − 4 MOA | 448 meters | X= 10 mph<br>Y= 2 mph<br>Z = .5 mph | 120 grains projectile<br>120 grains load | 22% humidity<br>30.87 in<br>81°F | 2° | 481 feet |
| 696D | 3 MOA | − 0.5 MOA | 250 meters | X= 15 mph<br>Y= 4 mph<br>Z = 0 mph | 120 grains projectile<br>120 grains load | 57% humidity<br>30.1 in<br>50°F | −7° | 5,629 feet |
| | . . . | . . . | . . . | . . . | . . . | . . . | . . . | . . . |

594A

FIG. 14D

PROJECTILE SIGHTING AND LAUNCHING CONTROL SYSTEM

RELATED APPLICATIONS

This application is a continuation-in-part of U.S. patent application Ser. No. 12/607,822 filed on Oct. 28, 2009, now U.S. Pat. No. 8,468,930, entitled "SCOPE ADJUSTMENT METHOD AND APPARATUS," which is a continuation-in-part of U.S. patent application Ser. No. 11/120,701, filed on May 3, 2005, now U.S. Pat. No. 7,624,528, entitled "SCOPE ADJUSTMENT METHOD AND APPARATUS," which is a continuation-in-part of U.S. patent application Ser. No. 10/441,422, filed on May 19, 2003, now U.S. Pat. No. 6,886,287, entitled "SCOPE ADJUSTMENT METHOD AND APPARATUS," which claims priority from U.S. provisional application Ser. No. 60/381,922, filed on May 18, 2002, each of which is expressly incorporated by reference herein in its entirety.

BACKGROUND

1. Field of the Disclosure

The present teachings generally relate to systems and methods for projectile sighting and launching control.

2. Description of the Related Art

Many projectile launching devices are equipped with portable sighting devices to aid in accurate positioning of the device's point of aim (POA). A common example of a projectile launching device having a portable sighting device would be a rifle with a rifle scope. In this example, when shot, the bullet's point of impact (POI), relative to the scope's targeted POA, varies depending on various ballistic parameters associated with the bullet specifications and the shooting parameters at hand. Some of the common shooting parameters include, for example, the projectile's specification, the distance to the target, and the wind speed that is present at the time that the projectile is launched.

In an example of a rifle scope, sighting-in methods and procedures typically involve repetition of shots with manual manipulations of the elevation and/or windage adjustment mechanisms. Each manipulation of the scope adjustment usually requires the shooter to disturb the scope sight picture. After each adjustment is made, the shooter typically has to re-assume the proper shooting posture and re-acquire the target through the scope. Furthermore, subsequent shots at targets at non-zeroed distances may be subject to the shooter's estimate errors.

The continuous repetition of this process results in potential errors in the sighting-in of the firearm. For example, with higher power firearms, the recoil of the firearm can be substantial. As such, a shooter who is repeatedly firing the firearm to sight it in may begin to flinch prior to firing the rifle in anticipation of the recoil. Flinching can then result in the shooter introducing error into the shooting process thereby increasing the difficulty in sighting-in the firearm. Flinching is generally observed to increase with each additional shot fired. Hence, there is a need for a system and process that allows the firearm to be sighted-in in a more efficient fashion.

SUMMARY

In one embodiment, a sighting system for a projectile launching device comprises a ballistic parameter detector that measures one or more parameters that affect the ballistic flight of a projectile fired by the weapon, an adjustable aiming device that defines a point of aim of the device, wherein the point of aim indicator (POAI) can be adjusted so that the point of aim coordinate (POAC) coincides with the point of impact coordinate (POIC) for a projectile fired by the weapon for a given set of multiple-parameters measured by the ballistic parameter detector, a memory wherein empirical point of aim adjustment data and correlated empirical ballistic parameters are stored, wherein the stored aim adjustment data and correlated ballistic parameters comprise data capture for successive firings of projectiles from the weapon, and a processor that, upon receiving new sensed ballistic parameters from the ballistic parameter detector, determines new aim adjustment data based at least in part upon the stored empirical point of aim adjustment data and correlated empirical ballistic parameters and provides the new aim adjustment data to the adjustable aiming device to adjust the point of aim for the new sensed ballistic parameters.

In one embodiment, a sighting system for a projectile launching device comprises an optical assembly having a POAI, wherein the POAI is configured to be movable relative to an optical axis of the optical assembly, an adjustment mechanism coupled to the point of aim indicator and configured to adjust the POAI relative to the optical axis, a ballistic parameter detector configured to detect one or more current ballistic parameters, and a memory. The sighting system further comprises a processor configured to initiate storage in the memory of an empirical zero data point indicating a first position of the POAI and one or more first ballistic parameters associated with the first position, initiate storage in the memory of one or more empirical secondary data points, wherein each secondary data point indicates a secondary position of the POAI and one or more secondary ballistic parameters associated with the respective secondary position, receive one or more current ballistic parameters associated with a static target, determine a point of aim adjustment increment between a current position of the POAI and an adjusted position of the POAI based on the zero data point, the one or more secondary data points, and the one or more current ballistic parameters, and signal the adjustment mechanism to adjust the position of the POAI according to the determined point of aim adjustment increment.

In one embodiment, a sighting system for a projectile launching device comprises an optical assembly having a field of view (FOV) and a point of aim reference dot (POARD) that is confined to the FOV and is maintained within the embodiment of the sighting system, as opposed to being projected onto the POAC of the target itself; wherein the POARD is configured to be movable within the FOV of the sighting system relative to an optical axis of the optical assembly and the point of aim indicator (POAI), wherein an adjustment mechanism is coupled to the POARD and configured to adjust the POARD via remote control and relative to the optical axis and the POAI.

In one embodiment, a method for adjusting a point of aim indicator (POAI) of an optical assembly configured to be attached to a projectile launching device comprises storing a first data point indicating a first position of a POAI of an optical assembly and a set of parameters (SOP) associated with the first position of the POAI in a computer memory, wherein the first position of the POAI indicates a point of aim coordinate (POAC) that coincides with a first point of impact coordinate (POIC) of a projectile fired by a projectile launching device subject to the SOP present, and storing one or more secondary data points indicating a respective secondary position of the POAI and the secondary SOP associated with the secondary position of the POAI in a computer memory, wherein the secondary static position of the POAI indicates a POAC that coincides with a POIC of a projectile fired by the firearm subject to the respective secondary SOP. The method further comprises receiving one or more target parameters from one or more sensor devices, determining with a computing device an adjusted position of the POAI based on the one or more target ballistic parameters, the first data, and the second data, and initiating adjustment by an actuator device of the POAI to the adjusted position.

In one embodiment, a sighting system for a projectile launching device can be configured to compensates for moving targets. The embodiment operates on the same principle as the POAI adjustment device that was previously described for static targets. Like static targets, the POAI adjustment device can also be pre-programmed, recorded, and then later automatically retrieved/adjusted (in real-time) to compensate for moving targets and/or from a transport vehicle (TRV). The SOP for a moving target can include additional parameter such as target speed (e.g., as deciphered by a portable encrypted radar device such as a Doppler radar device). The parameter of target speed can include a quantifiable speed, in which the target is moving relative to the shooter (for example, a target speed of 45 MPH).

In one embodiment, a sighting system for a projectile launching device comprises an optical assembly having a digital field of view (FOV) where the FOV can be cryptically transmitted from the sighting system to an independent view screen(s) that can be observed from a remote location. The independent view screen(s) may include, but not limited to, a handheld device such as a personal computer (PC) and/or central command center. The optical assembly system can include programmable software/hardware components that are installed or downloaded into the handheld device and/or command centers. These software and hardware components can include a transmitter/receiver (TX/RX) operating system that is installed in the sighting system, handheld device, and/or command system. This TX/RX operating system can allow the digital information and adjustment commands to be transmitted and received by the sighting system, and/or handheld device, and/or central command center. The remote digital TX/RX system can allow the operator to view and cryptically operate the digital sighting-system from a remote location. The digital sighting-system allows any authorized individual to view and operate the sighting system from a remote location. Examples of how these digital signals and transmissions are linked between the optical assembly and the remote transmitter-receiver system include, but are not limited to, wireless-link, satellite-link, radio-link, microwave-link, or internet-link.

In one embodiment, a sighting system for a projectile launching device comprises an optical assembly having a zoom-magnification and focus adjustment mechanism. The magnification and focus adjustment mechanisms can be configured to be viewed and/or operated via remote control and a transmitted (TX) remote field of view (FOV) from a remote location. The shooter can adjust and record the sighting unit's magnification and focus settings to various preferred settings based upon varying stored SOP combinations. These custom-set magnification and focus settings can be performed and then recorded via a remote controller and ballistic parameter device receiver/recording device. The issue of parallax, if actually present, is no longer of concern, or can be mitigated, due to the shooter and/or the sighting system adjusting and recording the POAC position relative to the actual POIC and its corresponding magnification setting; regardless of whether parallax is present or not. The size of the sighting system's focal length and the diameter of the sighting system's objective lens may vary without departing from the present teachings. The processor of the ballistic parameter device can be configured to store in the memory each of the shooter's preferred magnification and focus settings associated with any combination of target distance and ambient light condition that he may encounter in the field. Each recording can indicate one or more ballistic parameters (such as distance and available ambient light levels) associated with each respective magnification and focus setting. Once recorded, the processor can be configured such that it can then later operate in an automatic or in a manual remote-controlled manner. In Auto-Mode the processor can be configured to automatically signal the adjustment mechanism to adjust the sighting system's magnification and focus to the desired setting associated with the sensed ballistic parameters at hand.

In one embodiment, a sighting system for a projectile launching device comprises an optical assembly having night-vision (NV), infra-red (IR), and/or thermal-imaging (TI) capabilities. The NV, IR, and/or TI adjustment mechanisms can be configured to be viewed and operated via remote control and a transmitted (TX) remote field of view (FOV) from a remote location. The optical assembly is configured so that the NV, IR, and/or TI components can be adjusted, via remote controller; to a preferred adjustment setting based upon the ambient light and thermal heat conditions at hand. These preferred settings can then be recorded for each varying condition, target distance and magnification combination. For example, ambient-light during dawn, dusk or nighttime hours can be both variable and limited. Varying distances and magnification settings can also influence the amount of ambient-light that is available to enter the night-vision system via the sighting system's aperture-opening. The aperture-opening setting and recording feature of the night-vision system allows the shooter to adjust the preferred amount of ambient light allowed into the sighting system's night-vision sensory mechanism. The preferred night-vision setting can also be augmented by artificial light, the amount and intensity of which can be adjusted via remote controller commands sent to the night-vision device. The resultant preferred night-vision settings can vary depending on distance, magnification and available ambient-light. Each preferred night-vision setting can be recorded and stored in the memory. These custom night-vision settings can be performed by the night-vision system and recorded by the shooting parameter device via a wireless signal command that is initiated by the shooter via the remote controller. At the shooter's command, the night-vision system can be configured to store in the memory each of the shooter's preferred night-vision settings associated with each applicable ambient light condition and shooting parameter chosen. Each recording can be associated with an ambient light condition, target distance (and the preferred magnification/focus setting) associated with the target distance at hand. Once recorded, the sighting system's ballistic parameter device can be configured to automatically adjust the night vision's aperture adjustment mechanism (and artificial light source if applicable) to the shooter's preferred night-vision setting in response to the ambient light condition, target distance and zoom magnification combination at hand. Similar adjustments and preferred-settings for the IR and TI components can be made in the same way and recorded for future automatic retrieval and adjustment.

In one embodiment, a sighting system for a projectile launching device can include a digital compass and a remote wind sensing device. The digital compass can provide a precise bearing of the POAI and the remote wind sensing device can provide a precise bearing of the wind direction in the field. A ballistic parameter device and processor can first capture, and then later automatically retrieve the bearing of the rifle (i.e. POAC) relative to the bearing of the wind. The remote wind sensing device also provides digital information associated with the parameters of wind speed, temperature, humidity, pressure and altitude. The POA bearing can be synonymous with the bearing of the flight of the projectile when the projectile is fired from the projectile launching device to the POAC. The effect of wind on the flight of the projectile is a function of the bearing (direction) and speed of the wind relative to the bearing (direction) and speed of the projectile as well as the atmospheric parameters associated with temperature, humidity, pressure and/or altitude. The SOP associated with wind and atmospheric conditions and the associated impacts they have on the flight of the projectile, at any given moment, can be variable. The digital bearing of the wind relative to the bearing of projectile can also be variable.

In one embodiment, a sighting system comprises a stimulus-activated processor configured to initiate storage in the memory. Examples of stimulus activation may include but are not limited to sound-activation, movement-activation, and trigger activation. It may be important to capture and record the complete set of shooting parameters of wind speed, wind direction, projectile direction, and atmospheric conditions as they exist at the moment the projectile is launched. Capturing such shooting parameters at the moment the projectile is launched can provide an accurate correlation of the SOP on the flight of the projectile relative to the POAC and the POIC; wherein SOP=POAC=POIC. The stimulus-activated processor initiates the sighting system to capture and record the digital bearing of the POA relative to the digital direction of the wind at the moment the shot is fired. The stimulus-activated processor also initiates the sighting system to capture and record the target range, target slope, wind speed, and the atmospheric conditions that were present at the moment the shot is fired. Once the shooting parameters of wind speed, wind direction, atmospheric conditions and bearing of the POA are recorded; the shooter can proceed to make his POAC to POIC adjustment and recording procedure in accordance to the methods described herein. Once the POIC adjustment is made relative to the set of stimulus-activated SOP is recorded, the POIC associated with its SOP is recorded and stored in memory. The POIC associated with that particular SOP can later be automatically retrieved for precise automatic POAI adjustment, if and when the shooter is confronted with a similar SOP in the field.

In one embodiment, a sighting system for a projectile launching device can include a cryptically-encoded Ground Positioning System (GPS) device. The GPS device aids fellow sportsmen, law enforcement and/or authorized personnel to locate and monitor the movement and activity of their fellow-comrades from afar. The sighting system further comprises a digital compass (described earlier). When the sighting-system of the present teachings aims at a confirmed target (CT), the combination of the GPS coordinate of the projectile launching device, the digital compass bearing of the respective POAC, and the precise distance to the CT (via range finder and inclinometer) can aid authorized personnel to automatically locate the precise confirmed target coordinate (CTC) of the intended target from a remote location. The CTC can be a processor-induced function of the GPS coordinates of the shooter relative to the slope-corrected distance and compass bearing from the shooter to the CT. The digital information associated with the shooter's GPS coordinate as well as the CTC can be automatically transmitted (e.g., streamed in real time) to fellow comrades and/or central command center. This targeted CTC provides fellow comrades and/or central command with a CTC relative to allied troop's GPS coordinates. Fellow comrades and/or central command can use this targeted CTC for the deployment of additional troops, weaponry or trajectory bearings for; example, a mortar division. The integrated sighting system may be mounted to any hand-held, portable, and/or mobile projectile launching device (such as a mortar launching device) without departing from the spirit of the present teachings. The GPS/CTC features of the integrated sighting system can also help prevent friendly-fire accidents from occurring because; for example, in the event that one allied soldier accidently aims at another allied soldier, the CTC of the soldier being aimed at can be automatically deciphered by the wireless network-integrated sighting system as a friendly target coordinate if the CTC is equal to the GPS coordinate of an allied soldier and/or vehicle. In this particular example, the sighting system can be configured, for example, to automatically override the offending soldier's weapon from being fired until such time that the weapon is turned away from the friendly CTC.

In one embodiment a sighting system for a projectile launching device can include a remote controlled trigger activation device. The trigger activation device allows the operator to wirelessly activate (fire) the projectile launching device from a remote location.

In one embodiment a sighting system for a projectile launching device can include a remote controlled gimbaled robotic apparatus (GRA). The automatic adjustment features of the present teachings, when coupled with the GRA, allow the shooter to operate a projectile launching device in a hands-free manner. The remote control feature of the GRA allows the operator to wirelessly maneuver the vertical, horizontal and rotational movements of the projectile launching device from a remote location. The GRA may include, but is not limited to, a remote-controlled gimbaled tripod. For example, the sighting system and projectile launching device can be attached to a hydraulic or servo-motor driven gimbaled tripod; which can be configured to be remote controlled from a remote location. In this example the remote controlled gimbaled tripod, and the remote controlled sighting system, and the remote controlled trigger-activation device, can each be remote controlled and act in combination as a hands-free projectile launching device operating system that can be viewed, controlled, and/or operated by the shooter or a plurality of shooters from a remote location.

In one embodiment a sighting system for a projectile launching device can include a remote controlled unmanned transport vehicle (TRV). The automatic adjustment features of the present teachings, when coupled with the GRA and the TRV, allow the shooter to operate and transport a projectile launching device in an unmanned and hands-free manner. The remote control feature of the TRV allows the operator to transport the projectile sighting and launching system to various strategic locations in an unmanned fashion and from a remote location. The TRV may include, but is not limited to an all-terrain vehicle (ATV), an aircraft, a marine vehicle, or an unmanned drone. For example, the sighting system and the projectile launching device and the GRA can be attached to the TRV; each of which can be configured to be remote controlled from a remote location. The remote controlled sighting device, the remote controlled GRA, the remote controlled trigger-activation device, and the remote controlled TRV can act in combination as a hands-free projectile launching device operating system that can be viewed, controlled, and/or operated by the shooter from a remote location.

In one embodiment, a sighting system for a projectile launching device comprises a controller assembly device configured to automatically adjust the POAC of the projectile launching device (e.g., in real-time). This automatic adjustment of the POAC is performed by retrieving and adjusting the POIC adjustment command ($POIC_{AC}$) of the automatic sighting-system of the present teachings. This automatic $POIC_{AC}$ function integrates commercially available digital target-recognition system technology and interfaces it with the automatic sighting-system technologies of the present teachings. The digitally recognized moving target, as deciphered by the target recognition system, becomes the 'locked-on' POAC of the moving target, and the POAC's corresponding pre-recorded $POIC_{AC}$ causes the POAC controller assembly to automatically move-in-synch with the re-calibrated hold-over position of the anticipated POIC of the moving target.

In some implementations, the present disclosure relates to a system for sighting of a projectile-launching device. The system includes an aiming system coupled to the projectile-launching device. The aiming system includes an adjustment mechanism configured to change a point-of-aim (POA) of the projectile-launching device based on an input signal. The system further includes a gimbaled robotic apparatus (GRA) configured to receive and provide movable support for the projectile-launching device. The (GRA) is further configured to point the projectile-launching device to a desired direction. The system further includes a trigger activation device configured to allow launching of a projectile from the projectile-launching device. The system further includes a control system in communication with the aiming system, the (GRA), and the trigger activation device. The control system is configured to receive information from the aiming system representative of a current POA setting. The control system is further configured to generate and send the input signal for the aiming system to effectuate the change in POA. The control system is further configured to generate and send a launch signal to the trigger activation device to launch the projectile from a remote location when the change in POA is effectuated by the aiming system.

In some embodiments, the aiming system can include a field of view (FOV) that can be electronically transmitted and viewed from the remote location. The control system can be further configured to generate the signal based on an operator viewing the FOV at the remote location and entering a command into the control system.

In some embodiments, the aiming system can include a friend-or-foe identifier configured to identify a target as a friend or a foe. In some embodiments, the aiming system can be further configured to automatically adjust a point-of-aim-indicator (POAI) to a point-of-impact-coordinate (POIC). The POIC can be for a static or moving target. The gimbaled robotic apparatus can be mounted on a static platform or a moving platform.

In some embodiments, the system can further include a user interface in communication with the control system. The user interface can be configured to allow operation of the projectile-launching device by an operator with disability or limited physical capability. In some embodiments, the aiming system and the control system can be configured to automatically capture, record, and save a set of parameters having information about a point-of-aim-coordinate (POAC) of the POAI and the POIC when the projectile is launched. The control system can be further configured to calculate a new POAI based on the POIC of the projectile.

In some embodiments, the system can further include one or more remote sensors located away from the projectile-launching device and in communication with the control system. The one or more remote sensors can be configured to sense and provide one or more conditions experienced by the projectile during its flight. The one or more remote sensors can be configured to provide information about at least one of wind speed, wind direction, temperature, humidity, and pressure.

In some embodiments, the aiming system can include at least one of a variable-magnification optical component, an auto-focus component, a night-vision sensor, an infra-red (IR) sensor, and a thermal imaging sensor. In some embodiments, the aiming system can include a motion sensing device such as a radar device. In some embodiments, the projectile-launching device can be a rifle.

In some implementations, the present disclosure relates to a method for controlling a projectile-launching device. The method includes sensing one or more conditions that influence a point-of-impact (POI) of a projectile launched from the projectile-launching device, with the POI being different than a current point-of-aim (POA). The method further includes generating a new POA based on the one or more sensed conditions. The method further includes instructing an aiming system to change from the current POA to the new POA. The aiming system is coupled to the projectile-launching device and includes an adjustment mechanism configured to allow the change of POA. The method further includes actuating a trigger activation device to launch the projectile from a remote location upon the change of POA.

For purposes of summarizing the disclosure, certain aspects, advantages and novel features of the inventions have been described herein. It is to be understood that not necessarily all such advantages may be achieved in accordance with any particular embodiment of the invention. Thus, the invention may be embodied or carried out in a manner that achieves or optimizes one advantage or group of advantages as taught herein without necessarily achieving other advantages as may be taught or suggested herein.

BRIEF DESCRIPTION OF THE DRAWINGS

FIG. 13A-1 illustrates another embodiment of a scope adjustment system, wherein the digital system is able to transmit its digital field-of view to a remote receiving device such as a personal computer (PC) or central command center.

FIG. 13C-1 illustrates another embodiment of a scope adjustment system, wherein the digital system is able to transmit its digital field-of view to the view screen of the ballistic parameter device and/or a remote receiving device such as a personal computer (PC) and/or an central command center. These remote receiving devices and/or command systems are, in turn, able to transmit operational adjustment commands back to the ballistic parameter device and/or scope adjustment device from a remote location.

FIG. 13D-1 illustrates another embodiment of a sighting system, wherein the sighting system is partially or fully embodied into the housing of a remote controlled weapons system that can be operated in an unmanned fashion from a remote location.

FIG. 13D-2 illustrates another embodiment of a sighting system, wherein the sighting system is coupled to a remote controlled gimbaled robotic apparatus (GRA) and remote controlled ATV (moving platform).

FIG. 14C-1 illustrates a functional block diagram of one possible embodiment of the detached ballistic parameter device in relation to the sighting system's adjustment system and the various ballistic parameter detectors as illustrated in FIGS. 13C and 13C-1.

FIG. 14C-2 illustrates how the ballistic parameter device can be operated as an attachment to the sighting system, or detached from the sighting system, or integrated into the internal housing of the sighting system (e.g., FIG. 13A).

FIG. 14C-3 illustrates a remote controller mechanism, including several activation buttons that when depressed can activate various components of the sighting system (e.g., via wireless link). Examples of the component activation buttons illustrated include POI coordinate adjustment (POI), zero baseline point of impact coordinate (ZBP), point of aim reference dot adjustment (RD), magnification and focus adjustment (M/F), night-vision adjustment (NV), and a record button (REC) that can be used to record each of the above listed adjustment features.

FIG. 14C-4 illustrates a block diagram that summarizes how the sighting system can operate in Record Mode and a method that can be used to adjust and record the scopes POAC-to-POIC and preferred settings for magnification, focus, and night vision; relative to the sensed ballistic parameters at hand.

FIG. 14C-5 illustrates a block diagram that summarizes how the sighting system can operate in Auto-Mode and a method that can be used for automatic operation of POAC to POIC adjustment as well as the automatic adjustment of the sighting system's magnification, focus, and night-vision settings; relative to the sensed ballistic parameters at hand.

FIG. 14D illustrates one embodiment of a record (e.g., tabulated set) of a plurality of empirical data points.

FIG. 19-A illustrates one embodiment of a method of acquiring and saving the desired settings of scope magnification, focus, and night-vision adjustments based upon the POA distance to the target and the ambient light conditions at hand.

FIG. 19-B illustrates one embodiment of a method of the scope automatically adjusting to the pre-recorded preferred settings made to the scope magnification, focus, and night vision device based upon the actual ballistic parameters at hand.

DETAILED DESCRIPTION OF CERTAIN EMBODIMENTS

Figure 1:
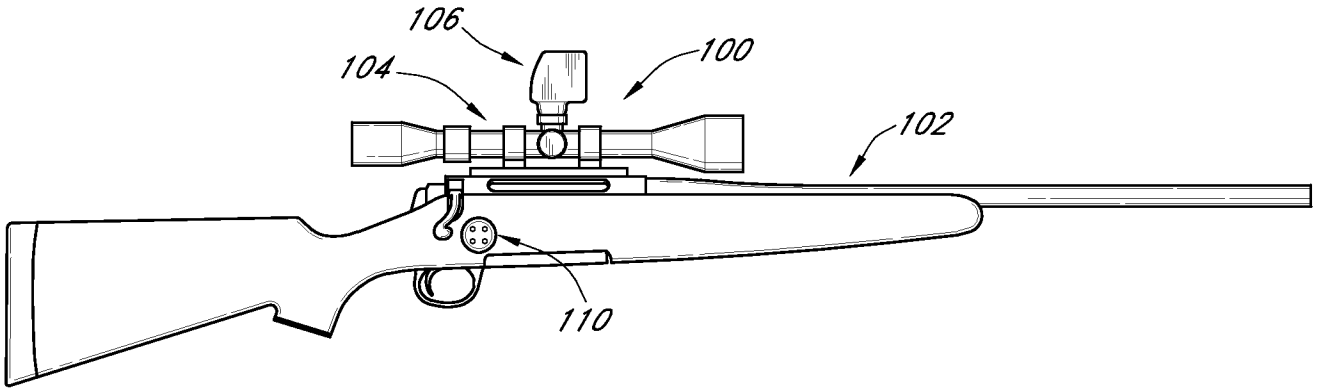
FIG. 1 illustrates one embodiment of a portable aiming unit mounted on an exemplary bolt action rifle.

These and other aspects, advantages, and novel features of the present teachings will become apparent upon reading the following detailed description and upon reference to the accompanying drawings. In the drawings, similar elements have similar reference numerals. The headings provided herein, if any, are for convenience only and do not necessarily affect the scope or meaning of the claimed invention.

Many projectile launching devices such as rifles are equipped with portable sighting devices such as rifle scopes to aid in accurate positioning of the device's point of aim (POA). When a bullet is shot from a rifle, the bullet's point of impact (POI), relative to the scope's targeted POA, can vary depending on various ballistic parameters associated with the bullet itself and other shooting parameters. Some of the common shooting parameters can include, for example, the projectile's specification, the distance to the target, and the wind speed that is present at the time that the projectile is launched.

In order to place the projectile to the same coordinate that the sighting system is aimed, the point of aim indicator (POAI) of the sighting system needs to coincide sufficiently close to the resultant point of impact coordinate (POIC) of the projectile. If it is not, the POAI needs to be sighted-in such that the point of aim coordinate (POAC) is moved towards the POIC. Typically, a shooter sights-in the POAC such that the POAI coincides with the POIC relative to a given set of parameters (SOP). An example of an SOP might be the target distance, the wind speed and the ambient temperature that is present at the time the POAC is being sighted-in. The shooter may then rely on a ballistic table or prior experience to estimate a rise, a drop, and/or horizontal movement of the bullet at other varying sets of shooting parameters. Targets having these varying sets of parameters are often referred to as secondary targets.

In some situations, a shooter may have to estimate the deviation between the POAC and the POIC due to varying target distances and other shooting parameters at hand. As discussed above, most shooters sight-in the sighting system such that the POAC and POIC coincide at a given distance of a static target. An example of a static target would be stationary targets located at 200 yards and having a constant wind speed of 8 MPH. However, when shooting at a secondary target having non-static ever-changing environmental parameters (for example, a new target distance with variable wind speeds), the shooter typically must either estimate the secondary range and parameters at hand, or obtain the secondary target parameter information using a variety of different measuring devices. Examples of such measuring devices may be a laser range finder for distance and an anemometer for wind speed. Once estimated or obtained, the shooter typically must then either calculate or estimate the vertical and windage change in projectile-flight due to the secondary parameters at hand. Naturally, estimating or calculating these secondary adjustments to the POAI can be difficult, particularly when it must be done before the parameters change or when confronted with, for example, hunting or combat situations. Hence, there is further a need for a sighting-system that allows the shooter to more easily shoot at secondary targets having varying parameters other than those determined for the sighted-in range of a static target.

A further difficulty with some projectile sighting-systems is that the shooter may have to estimate the deviation between the POAC and the POIC due to moving targets. As discussed above, most shooters sight the projectile launching device such that the point of aim and point of impact coincide at a given distance and/or set of shooting parameters of a static target. However, when shooting at a moving target, the shooter must attempt to extrapolate the coordinate of the projectile POIC relative to the moving target's POAC. Naturally, estimating where the precise POAI for a moving target should be, relative to where its precise POIC will occur, is difficult or essentially impossible to perform in a consistent fashion. Hence, there is further a need for a sighting-system that automatically adjusts the POAI to the exact POIC of a moving target having varying parameters other than those determined for the sighted-in range of a static target.

A further difficulty with some sighting-systems is that the portable aiming unit and the projectile launching device are coupled together, which requires the shooter to physically maneuver the projectile launching device in order to line-up the POA of the sighting system onto the intended target. Naturally, being in close physical proximity to or in direct physical contact with the projectile launching device can cause the shooter to be at high risk of being vectored-in by enemy fire. As a result, the shooter being in close physical proximity to the projectile launching device can be placed in unnecessary harm's-way of enemy fire. Hence, there is further a need for a projectile sighting and launching control system that can be operated (e.g., wirelessly and/or cryptically) from one or more remote locations; thus allowing the operator to be out of harm's way of enemy fire while at the same time not allowing the weapon's remote operations from being detected by enemy troops.

A further difficulty with some projectile sighting systems is that when the shooter attempts to zero-in his sighting system by adjusting the POAI from the POAC to the POIC, he may need to keep the projectile sighting system and the projectile launching device completely still, otherwise he may lose his original visual reference of the POAC relative to POIC. As a result, the shooter will often have to take multiple shots and then start-over in his attempt to accurately adjust the POAI from the POAC to the POIC during the zeroing-in process. Examples described in U.S. Pat. No. 7,624,528 (Bell, et al.) can allow the shooter to, for example, maintain an adjustable laser-generated point of aim reference dot (POARD) on the POAC of the target itself while the POIC adjustment is made to the POAI. However, the laser-generated POARD can be limited in functionality. For example, the shooter may be unable to visually discern the POARD that is projected onto the target if the POARD is being projected in bright ambient light conditions or at extreme target distances. Another limitation may occur when the shooter may prefer to not have the POARD discernible by enemy troops or targeted wildlife. Hence there is further a need for a POARD that can be confined to the shooter's field of view regardless of target distance, ambient light conditions and/or other conditions that may restrict the applications of a laser-generated POARD.

A further difficulty with some projectile launching devices is the ability to steadily-track moving targets as well as automatically adjust the POAI of the moving target to the precise POIC of the moving target. For example, when shooting at a moving target, the shooter may need to maneuver the projectile launching system quick enough to keep the POAI on the target in a consistent fashion while at the same time attempting to extrapolate the correct hold-over position of the POAI for the moving target. Naturally, keeping the POAI on the moving target, let alone the correct hold-over position can be very difficult. Hence, there is further a need for a sighting-system that can assist in automatically keeping the POAI on the POIC of a moving target.

A further difficulty with some sighting-systems is the inability to monitor in real time and record the shooter's field of view (FOV) from one or more remote locations (e.g., a network). As a result, strategic visual information that could be viewed and utilized by central command or fellow comrades (before, during and/or after combat) is not readily available in real time. The ability to monitor and view the shooter's field of view may be critical for strategic decision-making during the heat of battle or for after-battle review and training. Hence, there is further a need for a sighting-system that can assist the shooter as well as central command and fellow comrades with a real-time visual display of the shooter's field-of-view.

A further difficulty with some projectile sighting systems is that the shooter may often have to manually adjust his preferred zoom-magnification and/or focus settings of the field-of-view as the target distance and/or ambient light conditions change in the field. Naturally, making these secondary magnification and focus settings can be very difficult, particularly when it must be done very quickly as is common in hunting or combat situations. Examples described in U.S. patent application Ser. No. 12/607,822 (Bell, et al.) can allow the shooter to make and save these preferred visual setting to his field of view (FOV) in an automatic fashion. In some situations however, and by way of an example, the shooter may prefer to view and operate the preferred settings of zoom magnification and focus in an unmanned fashion and/or from a remote location. Hence, there is further a need for a sighting-system that can allow the shooter, via remote controls and a transmitted FOV, to easily zoom-in, focus, record, and automatically operate the preferred settings of secondary targets having varying parameters other than those determined for the sighted-in range. Such recorded preferred settings can be later automatically retrieved via processor for automatic zoom and focus adjustment in an unmanned fashion and from a remote FOV from a remote location.

A further difficulty with some projectile sighting systems is that the shooter may often have to manually adjust the night vision, infra-red, and/or thermal imaging settings of his field-of-view as the target distance, ambient light conditions, and/or thermal variations change in the field. Naturally, making these manual adjustments in combination with magnification, focus, and POAI adjustments can be very difficult, particularly when it must be done very quickly as is common in tactical or combat situations. Furthermore, factory-default settings for such auto-adjustments may be unsatisfactory to the shooter whose life is on the line. Hence, there is further a need for a sighting-system that can allow the shooter to more easily adjust and record the custom-preferred settings of secondary targets having varying parameters such as target distance, ambient light conditions, and/or thermal variations in the field. Such preferred settings can be later automatically retrieved for preferred automatic adjustment of night vision, infra-red and/or thermal-imaging of secondary targets having varying parameters other than those previously determined for the sighted-in range of a static target. Hence, there is further a need for a sighting-system that can allow the shooter, via remote controls and a transmitted FOV, to easily adjust, record, and automatically operate the preferred settings of night vision, infra-red and/or thermal-imaging for secondary targets having varying parameters other than those determined for the sighted-in range. Such recorded preferred settings can be later automatically retrieved via processor for automatic adjustment in an unmanned fashion and from a remote FOV from a remote location.

A further difficulty with some projectile sighting systems is the inability to accurately capture and process and then adjust for the complete set of parameters (SOP) in the field in real time. For example, it may require too much time for the shooter and/or spotter to capture and process the SOP; such as wind speed, wind direction, temperature, humidity etc., before the projectile is launched, and/or before the parameters in the field change. Hence, there is further a need for a sighting-system that is capable of capturing, processing and adjusting-for accurate ever-changing SOP in real-time.

A further difficulty with some projectile sighting systems is that the shooting parameters, such as wind speed, wind direction and temperature are traditionally captured within close-proximity to the shooter and that such close-proximity parameters may be substantially different than the parameters that are present in the open field (e.g., between the weapon and the target). For example, the wind speed captured in a combat bunker or hunting blind can be significantly different than the wind speed just outside of the bunker or blind. As a result, the parameters captured via traditional methods may be inaccurate when compared against the parameters that are present in the field at the moment the projectile is fired. Hence, there is further a need for a sighting-system that is capable of obtaining accurate parameter information from a remote location(s) and in real-time.

A further difficulty with some sighting-systems is the inability to monitor in real time the shooter's GPS coordinate relative to other allied troops and the confirmed target coordinates (CTC) of their intended target. For example, the ability to monitor and view a single shooter's GPS coordinate as well as a plurality of allied troop GPS coordinates relative to the CTC of their intended targets may be critical for strategic decision-making during the heat of battle or for after-battle review and training. As a result, strategic GPS/CTC network tracking information that can be viewed and utilized by central command, fellow comrades, and/or the shooter himself (before, during and/or after combat) is currently not readily available in real time. Hence, there is further a need for a sighting-system that can assist the shooter as well as central command and/or fellow comrades with real time GPS/CTC network capabilities.

A further difficulty with operation of some sighting-systems is the inability to automatically decipher between enemy verses allied (friendly) targets. Naturally, friendly-target recognition can be difficult during combat situations. Currently, projectile sighting-systems are independently operated; are not network-linked; and do not provide an automatic override feature in the event of friendly-target identification. As a result, the shooter has no definitive way of determining whether or not the target they are aiming at is a confirmed enemy target. Hence, there is further a need for a sighting-system that is capable of automatic friendly-target recognition and friendly-fire override capabilities.

A further difficulty with operation of some projectile launching devices is that the shooter operating a sighting-system that is attached to a projectile launching device has to be in good physical condition in order to hold, maneuver, sight, and fire the weapon at an intended target. Naturally, such physical prerequisites can prevent persons with limited physical capabilities or disabilities from being able to operate such weapons. For example, soldiers, who may have become injured or partially paralyzed in the line of duty, may no longer be able to physically maneuver, aim, or engage conventional projectile sighting and launching systems. Hence, there is further a need for a projectile sighting and launching system that can be remotely operated (e.g., wirelessly and/or cryptically) by a person with limited physical capabilities or disabilities from a remote location and out of harm's way of enemy fire.

Thus, there is an ongoing need to improve the methods and manner in which projectile sighting and launching systems are sighted-in, adjusted, and safely operated. There is a need for a projectile sighting and launching system and method that allows a shooter to automatically capture (from a remote location), process and adjust for the ever-changing parameters of distance, the environment, the atmosphere, and/or levels of ambient light and thermal contrast. A projectile sighting and launching system that can be operated from a remote location with the capability to place the projectile at varying non-static desired target locations, having varying parameters, in an improved and safe manner. There is also a need for a network sighting system and method that facilitates friendly-target recognition and allied GPS coordinate locations relative to confirmed target coordinates (CTC) of enemy targets.

In certain situations a difficulty with sighting-in a riflescope can be that the target distance from the scope to the target needs to be located at intervals of 100 yards. In some situations, a method of sighting-in a scope is generally restricted to 100 yard intervals because the vertical and horizontal adjustment mechanisms of the scope's internal POAI movement are based upon fractional increments of one (1) Minute of Angle (MOA). For example, at 100 yards, an adjustment in movement for a scope having a ¼ MOA is approximately ¼ inch. At 200 yards the same scope will have an adjustment in movement of about ½ inch etc. Some optical scopes are manufactured so that they can be adjusted to various fractions of 1-MOA in a predicable manner. Thus it can be desirable to provide a sighting system whose method of zeroing-in does not rely on predetermined yardage increments or incremental adjustment movements.

Further difficulties associated with some method of zeroing-in a riflescope includes: The manual movements associated with scope adjustment typically require that the shooter remove one or more of his hands from the shooting position. Furthermore, the manual adjustments associated with reticle adjustment movements can be tedious, awkward, and often results in the shooter breaking his concentration on the target. Thus it can be desirable to provide a riflescope that can be adjusted without the shooter having to remove his arms or hands from the projectile launching device while at the same time maintaining his concentration, shooting posture, and the scope sight picture.

The scope is usually limited to just one zero-point setting. Once the scope is sighted-in to a singular set of ballistic parameters (for example, target distance, wind speed etc.), the scope's single zero-point setting will no longer be applicable for secondary targets having a singular set of ballistic parameters that vary significantly from the original singular set of ballistic parameters. Thus it can be desirable to provide a riflescope sighting system that can make and record numerous zero-point settings for a large variety of ballistic parameter combinations.

When ballistic parameters in the field vary significantly from the singular zero-point set of ballistic parameters, the shooter generally needs to calculate and extrapolate a hold-over position every time he finds himself shooting at a target whose parameters vary substantially from his original set of zeroed target parameters. For example, extrapolation may be necessary in windy conditions, mountainous terrain, or in shooting environments where the altitude or temperature or humidity or barometric pressure vary significantly from the atmospheric environment where the scope was originally zeroed-in. When taking all of these ballistic parameters into account, extrapolating precisely where the projectile's POI will be, and then moving the projectile launching device to an accurate hold-over position to that location, all within a moment's notice before pulling the trigger is difficult or virtually impossible to perform. Thus it can be desirable to provide a sighting system that automatically adjusts the scope reticle to the POIC in response to the various shooting parameters at hand (for example, varying target distances, wind conditions, terrain, altitude temperature etc.).

At long distances, the incremental MOA movements associated with each movement or click of some scope adjustment mechanism may cause the reticle position to move too much, relative to the point of impact (POI) position. For example, a scope adjustment interval of ¼ inch at 100 yards can cause the reticle position to move 1.5 inches on a target located at 600 yards. If the shooter requires that his scope reticle be adjusted by only 0.5 inch at 600 yards, some MOA-based scopes are incapable of performing such adjustments since the minimum adjustment that can be made to the ¼ MOA scope at 600 yards is 1.5 inches. Thus it can be desirable to provide a sighting system whose adjustment mechanism allows for seamless, non-incremental, and precise movements of the point-of-aim reticle position.

A further difficulty with some method of operating a scope is that in addition to the previously mentioned problems associated with reticle movement, manual adjustments associated with the scope's zoom-magnification, focus, and night-vision settings can also be tedious and require to the shooter to move his arms and hands which often results in the shooter breaking his concentration on the target. In addition, once these methods of vision-enhancing adjustments are made to the scope, such adjustments are typically only applicable to the target distance and ambient light conditions that are present at the time that the adjustments are performed. Thus it can be desirable to provide a vision-enhancing scope adjustment system that can be made while a shooter maintains the shooting posture and the scope sight picture. It can also be desirable to provide a sighting system that automatically adjusts its magnification, focus and night-vision settings to various target distances and shooting parameters at hand (for example, varying target distances, varying ambient light levels etc.).

A further difficulty with some method of operating a scope and projectile launching device combination is that when the zoom-magnification and/or focus features of the scope are adjusted to various levels of magnification, the resultant parallax that often occurs can cause the scope reticle to move (e.g., relative to the original target position). Thus it can be desirable to provide a sighting system that can record the actual Point of Impact Coordinate of the projectile (e.g., relative to the magnification setting selected) so that the effects of parallax are already taken into account, and therefore automatically compensated for, when the final Point of Impact Coordinate adjustment is made and recorded.

A further difficulty with some method of operating a scope and projectile launching device combination is that experienced sniper teams, mortar divisions etc. generally rely on more than one person to quickly gather, process, and implement the ever-changing shooting parameters and POI adjustments in the field. Some of the technical reasons for requiring these teams can include a fact that it is virtually impossible, using current technologies, for one person to gather all of the necessary data needed to determine a precise POI coordinate and then make the proper adjustment in a quick enough fashion to maintain the offensive posture on the battlefield. Thus, it can be desirable to provide a precise real-time automatic adjustment sighting system that can be operated by a single individual (and/or optional unmanned method of operation as described herein).

A further difficulty with some method of operating a scope and projectile launching device combination is that they are generally designed for accurate engagement of stationary targets from a stationary position. To compensate for moving targets or firing from a moving position, the skilled shooter typically needs to extrapolate and determine a precise hold-over position in anticipation of the target literally moving into the anticipated line of fire. The challenges associated with hitting a moving target or a target from a moving platform (especially from long distances) can be difficult to achieve with today's technologies. Such challenges generally rely on the intuitive skill and experience of our military's elite sniper teams. Thus it can be desirable to provide an automatic sighting system that allows for shooting at moving targets and/or shooting from a moving platform.

A further difficulty with some method of operating a scope and projectile launching device combination is that the shooter typically needs to always be in physical contact with the scope and/or projectile launching device in order to adjust and operate the same with his arms, hands, and fingers. This is because in some situations, the shooter typically must hold, rotate, and adjust the projectile launching device and sighting system to the desired settings, shooting angle, target coordinate, and/or hold-over position. However, in combat situations, the shooter's physical proximity to the scope and projectile launching device places him in mortal danger of becoming a target himself. Thus it can be desirable to provide a remote controlled sighting system and projectile launching device shooting system that can be viewed and automatically and/or manually operated, in an un-manned fashion, from a remote location, that is not in close proximity to the scope or projectile launching device.

A further difficulty with some method of operating a scope and projectile launching device combination is the inability to determine the direction (bearing) of wind relative to the direction (bearing) of the flight of the projectile. The influence of wind on the flight of the projectile is not only a function of wind speed and wind direction but rather wind speed and wind direction relative to the bearing of the flight of the projectile. The shooter typically needs to try to extrapolate an accurate horizontal hold-over position of the projectile launching system relative to these ballistic parameters in order to accurately hit the target. Thus it can be desirable to provide a ballistic parameter sensing device that captures and records the information (e.g., digital information) associated with wind speed and wind direction relative to the bearing of the flight of the projectile and the resultant POI relative to the POA. Such shooting parameter sensing information recorded at the moment the shot is fired can be later used in determining and automatically establishing an accurate POA to POI adjustment such that the establishment of an accurate hold-over position is no longer necessary.

A further difficulty with operating a projectile sighting and launching device combination is determining the confirmed target coordinate (CTC) of the intended target relative to the proximity of allied troops. In combat situations, an accurate CTC of the intended target would aid fellow comrades and/or authorized military and law enforcement personnel to vector-in and work in unison with respect to engaging the intended target. Thus it can be desirable to provide a sighting system that can aid in determining the CTC of the intended target relative to allied troops.

It can also be desirable to provide an automatic field of view adjustment system where the preferred settings for zoom magnification, focus, night-vision, infra-red and/or thermal imaging can be pre-recorded for various combinations (sets) of shooting parameters, and then later automatically retrieve such preferred settings when similar shooting parameters are later encountered in the field.

It can also be desirable to provide a sighting system whose field of view can be observed and operated from a remote location. Such remote operation can allow the sighting system to be operated by military and law enforcement personnel in an un-manned and safe manner as well as at moving targets and/or from a moving platform.

It can also be desirable to provide projectile sighting and launching system that can be observed and operated by a person with physical disabilities and/or limited physical capabilities.

FIG. 1 illustrates a rifle 102 having a scope adjustment system 100 mounted thereon. The system 100 comprises an adjustment mechanism 106 mounted onto a scope 104. As described below in greater detail, different embodiments of the adjustment mechanism 106 can be either mounted to an existing scope, or be an integral part of a scope. The system 100 further comprises a remote controller 110 configured so as to allow a shooter to control the adjustment mechanism 106 without having to significantly interrupt the shooter's scope sight picture or the shooting posture.

It will be appreciated that the remote controller (110 in FIG. 1) may comprise any number of configurations of various types of switches and combinations thereof. In the description herein, the controller is depicted as an assembly of four switches—two for controlling the elevation adjustment of the scope, and two for controlling the windage adjustment of the scope. It should be understood, however, that such a switch arrangement is exemplary, and any number of other configurations of switches may be utilized without departing from the spirit of the present teachings.

For example, the remote controller may comprise a touch-screen activation system, a keyboard, or a single joystick-type device having a stubby stick manipulator adapted for easy manipulation by a trigger finger. Such a device may include internal switching mechanisms that provide either on-off function for controlling the exemplary elevation and windage adjustments. Alternatively, the internal switching mechanism may allow proportional type response to the shooter's manipulation of the switch, such that a hard push results in a greater response than a slight push of the joystick.

Furthermore, although the remote controller is depicted to be located adjacent the trigger in the description, it will be appreciated that it could be operated independent of a projectile launching device located at other locations of a projectile launching device without departing from the spirit of the present teachings. It should be apparent that any number of configurations of the remote controller (location and type) may be employed so as to be adaptable to various types of firearms or any other projectile launching devices.

The portable aiming device is described herein in context of bolt-action and lever-action rifles. It will be understood, however, that the scope adjustment system may be adapted to work in any projectile launching devices, including but not limited to, a semi-auto rifles, select-fire firearms, handguns, bows, rocket-launchers (sometimes referred to as bazookas), mortar-launchers, etc. Thus, it will be appreciated that the novel concepts of the portable sighting device may be utilized on different platforms without departing from the spirit of the present teachings.

In a rifle scope, a point of aim (POA) is typically indicated by some form of a reticle. Common reticle configurations include a cross-hair type, a dot type, or some combination thereof. In a cross-hair reticle, the POA is typically at the intersection of two or more lines. In a dot reticle, the POA is the dot itself. For the purpose of description herein, the POA is indicated by a simple dot or a simple cross-hair. It will be appreciated, however, that the scope adjustment system may be employed with any number of reticle configurations without departing from the spirit of the present teachings.

Typically, the point of aim indicator (POAI) in a rifle scope can be adjusted for elevation to account for rise and fall of the projectile at its point of impact (POI). The POAI can also be adjusted for windage to account for influences on the projectile that affect the horizontal displacement of the projectile at the POI. An elevation adjustment assembly is typically disposed at the top portion of the scope, and the windage adjustment assembly is typically disposed at one of the sides of the scope.

Figure 2C:
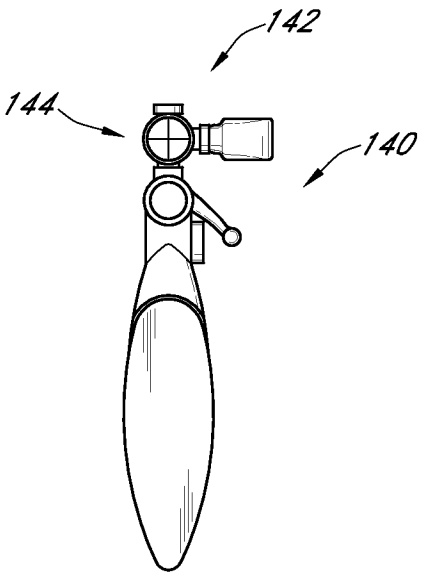
FIGS. 2A-C illustrates various end views of a rifle having various embodiments of the scope adjustment system adapted to allow adjustments of elevation and/or windage of a scope.
Figure 2B:
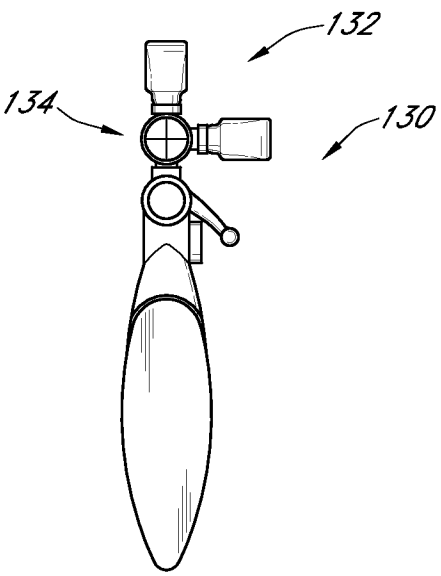
Figure 2A:
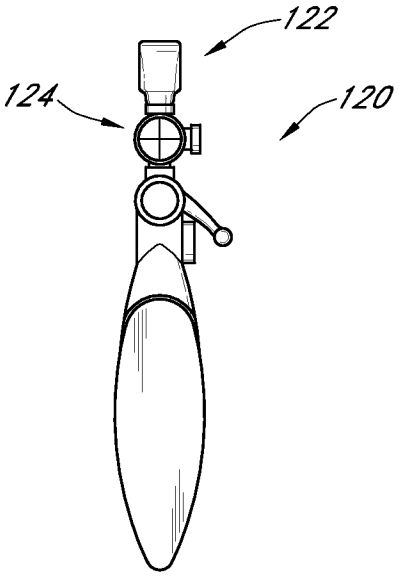

As shown in FIGS. 2A-C, the scope adjustment system may be implemented to allow adjustment of the elevation and/or the windage. In FIG. 2A, the end view of a rifle 120 illustrates an adjustment system 122 adapted to control the elevation adjustment of a scope 124. In FIG. 2B, the end view of a rifle 130 illustrates an adjustment system 132 adapted to control both the elevation and windage adjustments of a scope 134. In FIG. 2C, the end view of a rifle 140 illustrates an adjustment system 142 adapted to control the windage adjustment of a scope 144. Thus, it will be appreciated that the scope adjustment system may be adapted to control any of the controllable features of a scope, either singularly, or in any combination thereof.

Figure 3:
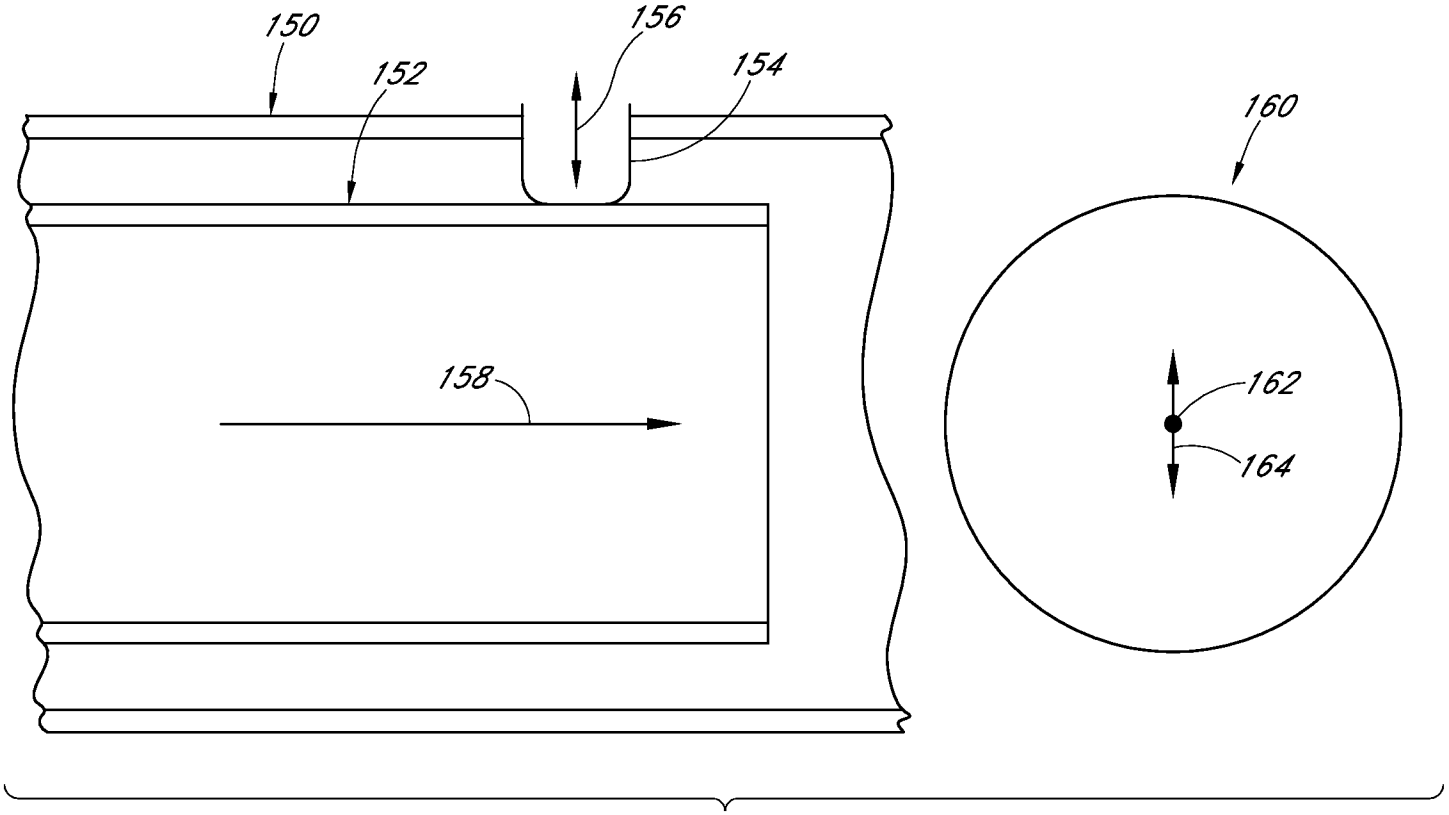
FIG. 3 illustrates a cutaway view of a scope depicting a adjustment tube disposed within the sighting system's housing, wherein lateral movements of the adjustment tube causes lateral adjustment of a point of aim with respect to the rifle.

FIG. 3 now illustrates a cutaway view of a portion of a scope having a housing 150 and an adjustment tube 152. The adjustment tube 152 may house optical elements (not shown) and the reticle (not shown). The adjustment of the POA may be achieved by moving the adjustment tube 152 (thereby moving the reticle position) relative to the housing 150 and initial position on the target (not shown). Such motion of the adjustment tube 152 may be achieved by an actuator 154 adapted to move along a first direction indicated by an arrow 156. The first direction 156 is generally perpendicular to an optical axis indicated by an arrow 158. When the actuator 154 pushes against the adjustment tube 152, the tube 152 moves away from the actuator 154. When the actuator 154 is backed-out, the adjustment tube 152 moves towards the actuator 154, induced by some bias not shown in FIG. 3.

The motion of the adjustment tube 152 along the first direction 156 causes a POA 162 in a scope field of view 160 to move along a direction 164 that is generally parallel to the first direction 156. It will be understood that the first direction 156 in FIG. 3 may represent a vertical direction for the elevation adjustment, or a horizontal lateral direction for the windage adjustment. As described below in greater detail, the actuator 154 may be moved by using different movement mechanisms.

One aspect of the present teachings relates to a scope adjustment system that allows a shooter to remotely control the actuator motion, thereby allowing the shooter to change the POA without having to take the sighting eye off the scope or significantly altering the shooting posture. It can be noted that while the scope adjustment system described above is presented as an elongated actuator and adjustment tube, one or more of the foregoing features related to the concept, principle and/or method of POA to POI adjustment can also be applied to digital scopes and fields-of-view whose alignment and adjustment of POA to POI is not necessarily confined to optical tubes or actuators, but rather precise visual field-of-view movements that can also be controlled via the present teachings of remote control and methods of POA to POI adjustment, recording, storage and/or processor retrieval. Various embodiments of the scope adjustment system are described below.

Figure 4A:
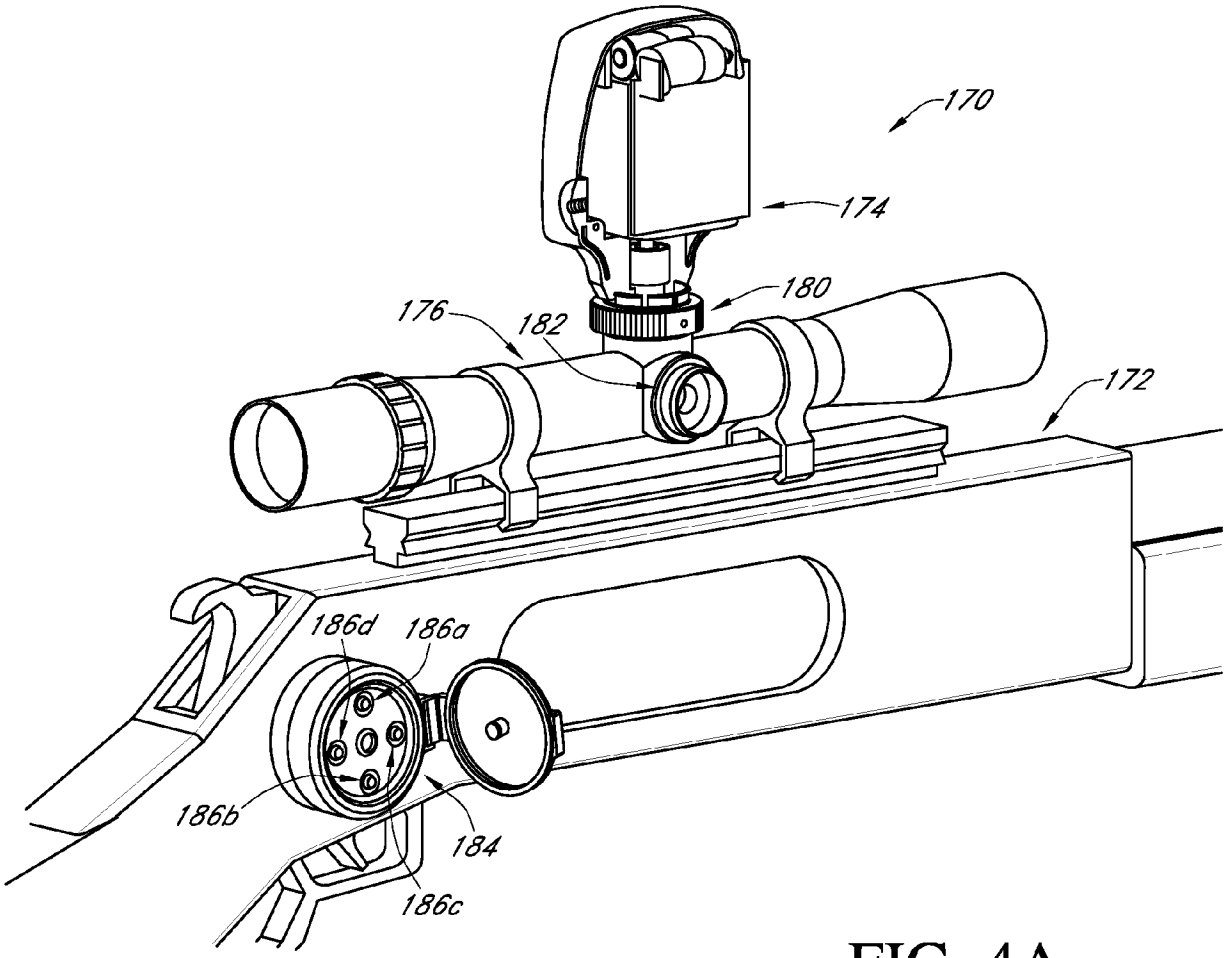
FIG. 4A illustrates one embodiment of the scope adjustment system mounted on an exemplary lever action rifle.

FIG. 4A illustrates one embodiment of a scope adjustment system 170 comprising an adjustment mechanism 174 mounted on a scope 176. The scope 176 is mounted on a rifle 172. The scope adjustment system 170 further comprises a remote controller 184 disposed near a trigger, so as to allow the shooter to manipulate the controller 184 with the trigger finger.

The scope adjustment system 170 in FIG. 4A is depicted as having the adjustment mechanism 174 coupled to the elevation adjustment portion by a coupling 180. It will be appreciated that another similar adjustment mechanism may be coupled to the windage adjustment portion 182 without departing from the spirit of the present teachings. Alternatively, an adjustment mechanism may be adapted to be a singular unit that couples to both the elevation and windage adjustment portions.

The remote controller 184 in FIG. 4A (and the controller 234 in FIG. 6 and the controller 390 in FIG. 13A) is depicted as having four buttons 186*a-d*. The top and bottom buttons 186*a* and 186*b* may be assigned to control respectively up and down movements of the POA in the scope field of view. Similarly, the front and rear buttons 186*c* and 186*d* may be assigned to control respectively left and right movements of the POA (if so equipped). However, the buttons can be configured in any sequence and the remote controller may also include more or less than four buttons without departing from the spirit of the present teachings (e.g., FIG. 14C-3). For example, a fifth button may be used to engage a record option of tracking the incremental adjustments being made to the vertical and windage deviations from POA to POI. Additional buttons may also be included that further control the optical magnification, focus, and/or night vision features of the scope's optical embodiments 388. The manner in which the remote controller 184 is mounted to the rifle 172, and the manner in which the remote controller 184 communicates with the adjustment mechanism 174, are described below in greater detail.

Figure 4B:
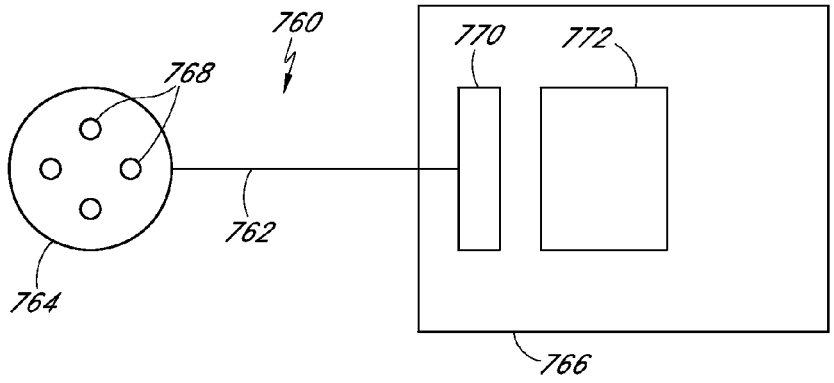
FIGS. 4B-C illustrates some possible embodiments of a signal link between a remote controller and an adjustment mechanism of the scope adjustment system.
Figure 4C:
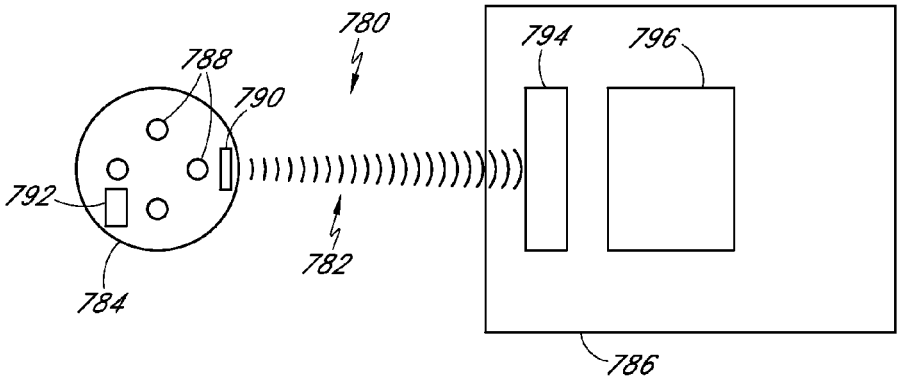

FIGS. 4B-C illustrates some possible embodiments of a signal link between the remote controller and the adjustment mechanism. Such links may be used for the scope adjustment system 170 of FIG. 4A or any other scope adjustment systems described herein.

FIG. 4B illustrates one embodiment of a signal link 760 comprising a wire connection 762 between a remote controller 764 and an adjustment mechanism 766. Manipulation of switches 768 may form switching circuits in a switching circuitry 770 that in turn induces the operation of one or more motors 772.

FIG. 4C illustrates another embodiment of a signal link 780 comprising a wireless transmitted signal 782 transmitted from a transmitter 790 of a remote controller 784. The transmitter 790 may be powered by a power source 792 such as a battery. Manipulation of switches 788 induces the transmitter to transmit corresponding signals 782 that are received by a receiver 794 disposed in an adjustment mechanism 786. The receiver 594 may then induce the operation of one or more motors 796 in response to the received signals.

Figure 5:
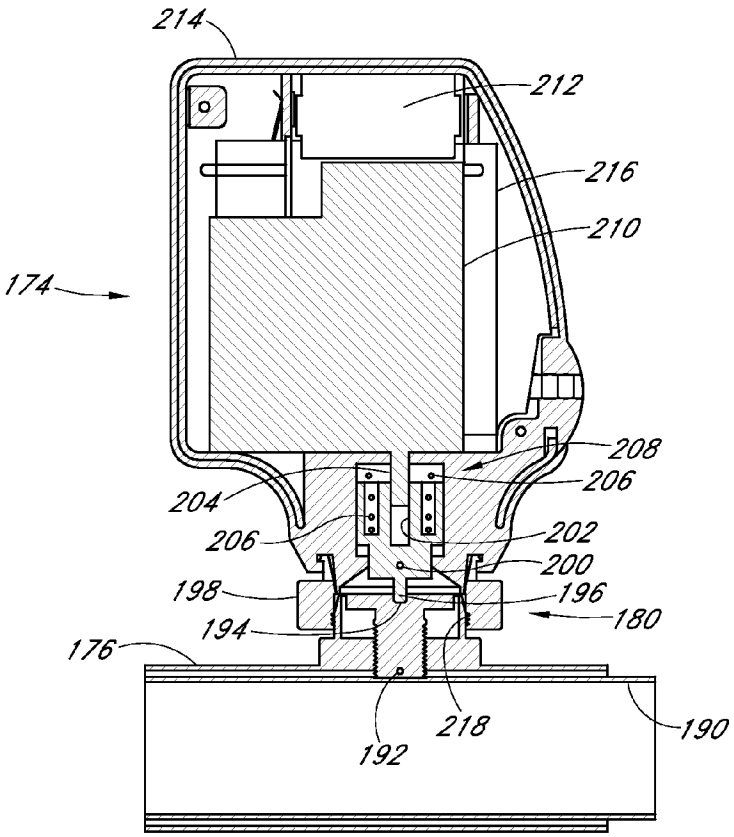
FIG. 5 illustrates a side cutaway view of part of the scope adjustment system of FIG. 4A.

FIG. 5 now illustrates a more detailed cutaway view of the adjustment mechanism 174. Overall, the adjustment mechanism couples a motor therein to an existing actuator, thereby allowing the motor to move the actuator. One embodiment 174 of the adjustment mechanism illustrated in FIG. 5 is adapted such that the coupling 180 comprises a threaded collar 198 that mates to a threaded portion (for receiving a cover) of an existing structure 218. An existing threaded actuator 192 disposed within the structure defines a slot 194 dimensioned to receive a turning tool such as a flathead screwdriver or a coin. Thus, by turning the threaded actuator 192 by a tool, the actuator 192 can move an adjustment tube 190 in a manner described above in reference to FIG. 3.

The adjustment mechanism 174 couples to the existing structure 218 by the collar 180. The threaded actuator 192 is turned by a flat head 196 of a driver member 200. The driver member 200 defines a recess 202 on the opposite end from the flat head 196, and the recess 202 is dimensioned to receive a motor shaft 204 therein, thereby providing a coupling 208 between the driver member 200 and a motor 210. Thus, when the motor shaft 204 turns, the flat head 196 turns in response, thereby causing motion of the threaded actuator 192 along a direction generally perpendicular to the optical axis of the scope. In one embodiment, the recess 202 is deep enough to accommodate the travel range of the driver member 200 with respect to the driver shaft 204. The coupling 208 between the motor 210 and the driver member 200 may also include a spring 206 that constantly urges the flat head 196 of the driver member 200 against the slot 194 of the threaded actuator 192.

In the embodiment 174 of the adjustment mechanism, the motor 210 is powered by a battery. The motor 210 rotates in response to a motor signal from a control unit 216 that results from a signal from the remote controller (not shown). A housing 214 houses the battery 212, motor 210, control unit 216, and the driver member 200.

It should be apparent that the motor 210 and the battery 212 can be selected from a wide variety of possible types, depending on the performance criteria. It will be appreciated that the motor 210 may be powered by a power source other than a battery without departing from the spirit of the present teachings. For example, the adjustment mechanism may be adapted to be powered by an external source, such as a battery adapter.

It will also be appreciated that the adjustment mechanism may be adapted to couple (e.g., retrofit) to numerous other types of scopes. For example, some scopes may have knobs (instead of slots) for turning the threaded actuators therein. In such scopes, coupling may, for example, be achieved by removing the knob(s) from the scope, and appropriately attaching the adjustment mechanism so as to couple the motor to the threaded actuator. Such attachment may utilize structures on the scope that allow the knobs to be attached thereon. It will also be appreciated that an independent adjustment mechanism may be incorporated into the housing and design of a rifle scope 13A. Such self-contained adjustment mechanism features could be fully integrated into the scope's internal housing at the time of manufacturing and is thus not be reliant on being adapted or retrofitted to a previously manufactured scope.

One aspect of the present teachings relates to an adjustment mechanism having a motor shaft oriented generally parallel to the optical axis of the scope. It will be seen from the description below that such orientation of the motor shaft, along with its coupling to the actuator (that extends generally perpendicular to the motor shaft), provides certain advantageous features.

Figure 6:
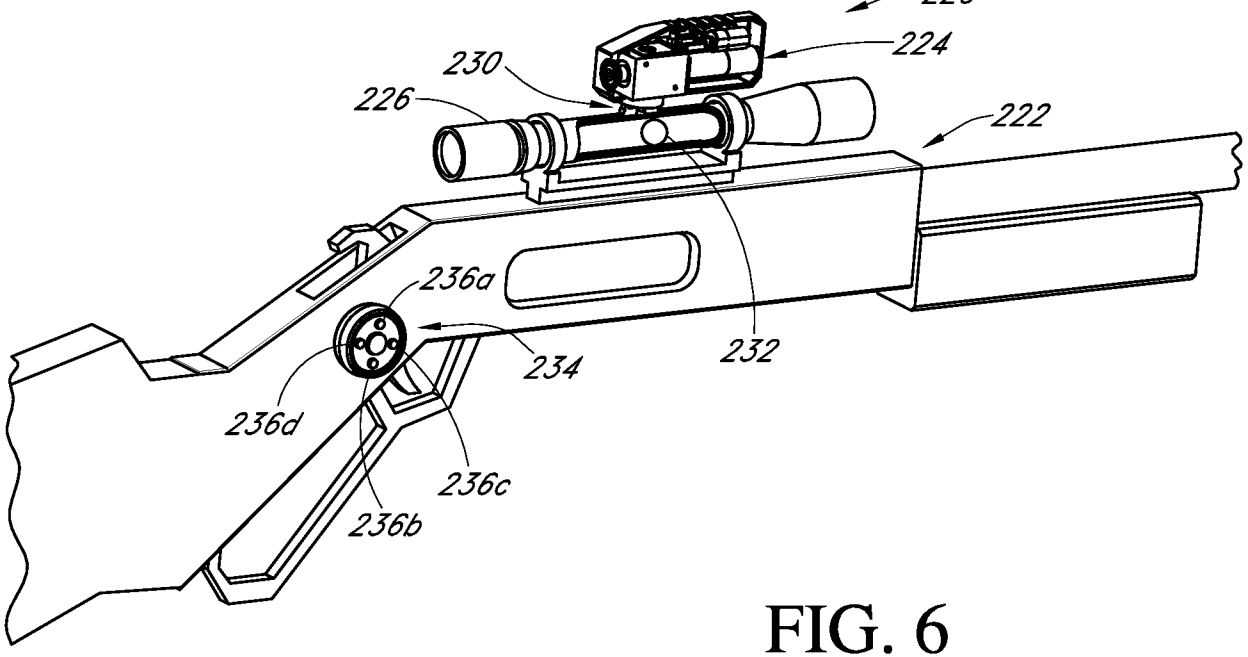
FIG. 6 illustrates another embodiment of the scope adjustment system.

FIG. 6 now illustrates one embodiment of a scope adjustment system 220 having such motor shaft orientation and perpendicular actuator. The system 220 comprises an adjustment mechanism 224 mounted on a scope 226. The scope 226 is mounted on a rifle 222. The system 220 further comprises a remote controller 234 disposed near a trigger, so as to allow the shooter to manipulate the controller 234 with the trigger finger.

The scope adjustment system 220 in FIG. 6 is depicted as having the adjustment mechanism 224 coupled to the elevation adjustment portion by a coupling 230. It will be appreciated that another similar adjustment mechanism may be coupled to the windage adjustment portion 232 without departing from the spirit of the present teachings. Alternatively, an adjustment mechanism may be adapted to be a singular unit that couples to both the elevation and windage adjustment portions.

The remote controller 234 in FIG. 6 is depicted as having four buttons 236*a-d*. The top and bottom buttons 236*a* and 236*b* may be assigned to control respectively up and down movements of the POA in the scope field of view. Similarly, the front and rear buttons 236*c* and 236*d* may be assigned to control respectively left and right movements of the POA (if so equipped). The remote controller 234 may communicate with the adjustment mechanism 224 in a manner described above in reference to FIGS. 4B-C.

Figure 7:
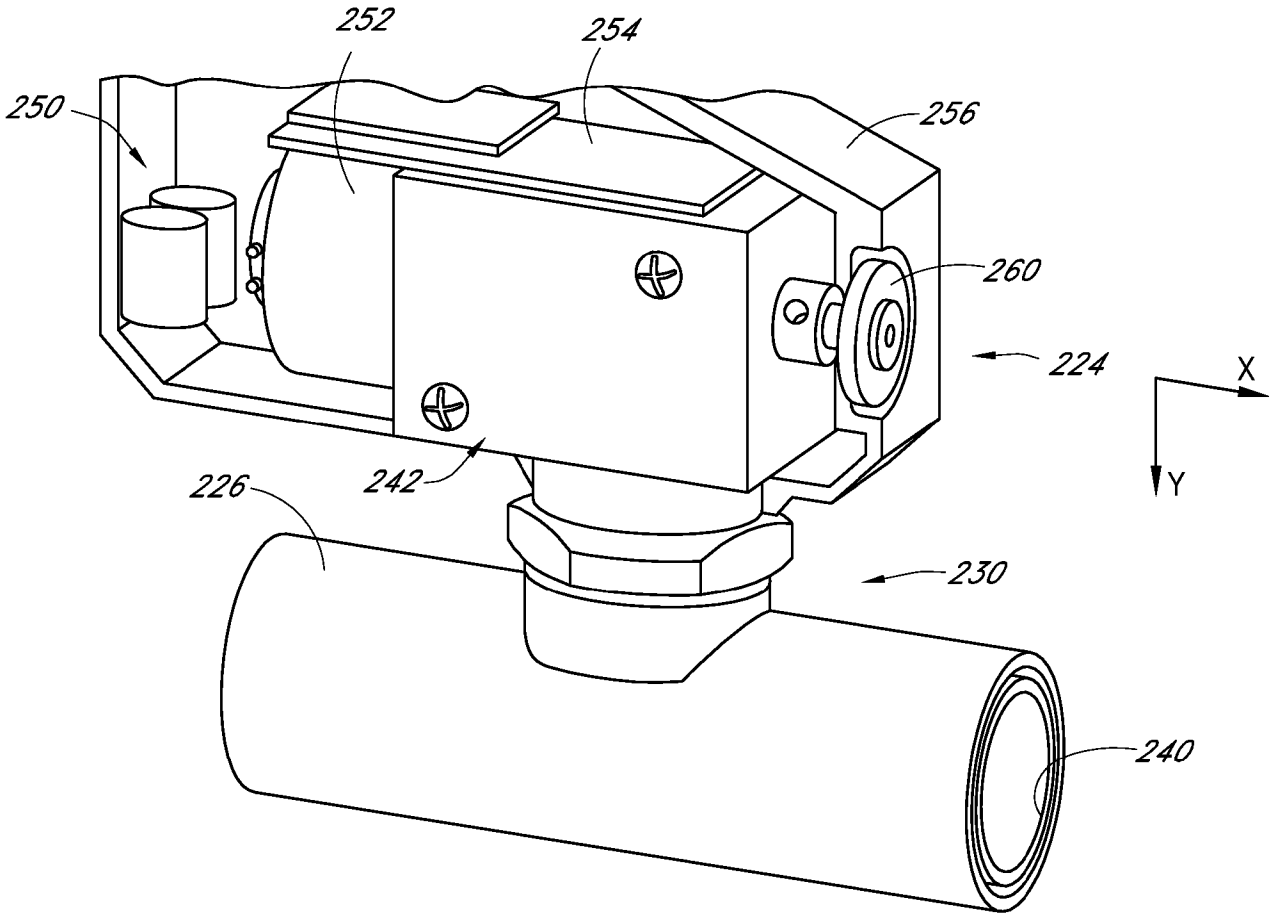
FIG. 7 illustrates a perspective partial cutaway view of part of the scope adjustment system of FIG. 6.

FIG. 7 illustrates a partial cutaway view of the adjustment mechanism 224 having a motor 252 mounted such that its shaft (not shown in FIG. 7) extends along a direction generally parallel to the optical axis. Again, the motor may be powered by a battery 250, or other source of power may be utilized. The motor 252 is controlled by a control unit 254 via a motor signal in response to an input signal from the remote controller (not shown).

The adjustment mechanism 224 further comprises a transfer mechanism 242 that facilitates transfer of motion along the X-axis to motion along the Y-axis in a manner described below. The motor shaft being oriented along the X-axis further allows the motor angular displacement (proportional to the X-motion and the Y-motion) to be visually monitored by a dial indicator 260. Such dial may face the shooter, and be calibrated with indicator marks to indicate commonly used POA displacement units. For example, many POA adjustment dials and knobs are calibrated in units of ¼ MOA (minute of angle). The dial indicator 260 may provide additional visual feedback to proper functioning of the scope adjustment system 224. It will be appreciated that the X-axis orientation of the motor shaft allows easier implementation of the indicator dial without complex coupling mechanisms.

In FIG. 7, the adjustment mechanism 224 is shown to be coupled via the coupling 230. The internal components within the transfer mechanism 242 and the coupling 230 are described below in greater detail. The transfer of the X-motion to the Y-motion allows moving of an adjustment tube 240 with respect to the scope tube 226 in a manner described below. In the embodiment 224 shown in FIG. 7, the battery 250, motor 252, and the transfer mechanism housing are enclosed within an outer housing 256.

Figure 8:
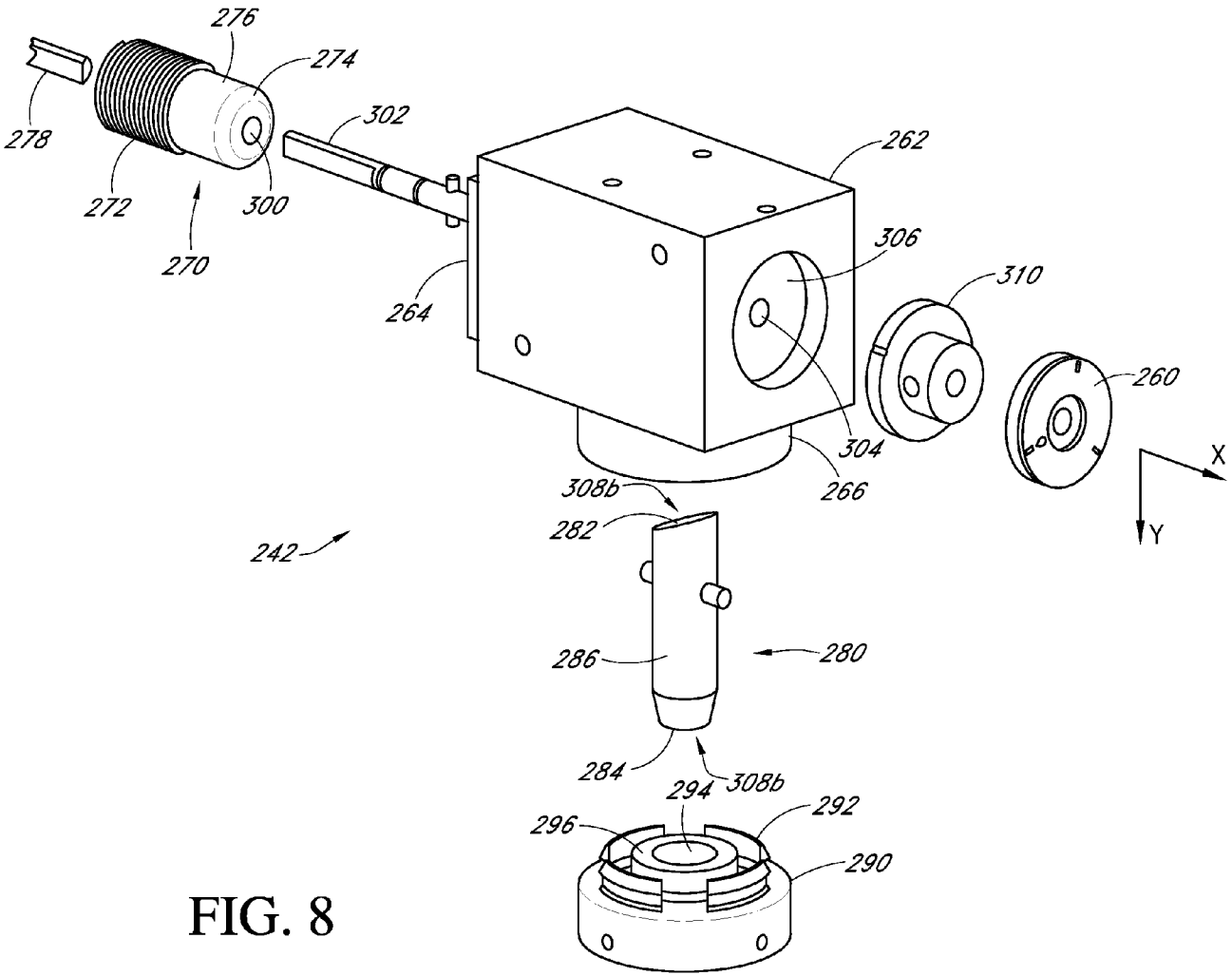
FIG. 8 illustrates a partially disassembled view of the part of the scope adjustment system of FIG. 7, showing the relative orientation of a driving bolt that induces generally perpendicular motion of an actuator.

FIG. 8 now illustrates a partially disassembled view of the transfer mechanism 242. The mechanism 242 comprises a housing 262 having an input portion 264 and an output portion 266. The input portion 264 is adapted to receive a bolt 270. In one embodiment, the bolt 270 comprises an elongate member having a threaded portion 272, an engagement surface 274, and a smooth portion 276 there between. The threaded portion 272 is adapted to engage its counterpart threads (shown in FIGS. 9 and 10) within the housing 262. The bolt 270 defines an aperture 300 that extends along the axis of the bolt 270. The aperture 300 is dimensioned to allow the bolt to be rotated by a motor shaft 278, while allowing relatively free longitudinal (sliding) motion of the shaft 278 within the aperture 300. In one embodiment, the aperture and shaft cross sections are dimensioned and include a flat (key) portion in an otherwise round shape, so as to allow positive rotational coupling there between while allowing the bolt 270 to slide on the shaft 278. Thus, when the shaft 278 is turned by the motor, the shaft 278 causes the bolt 270 to rotate as well. Because the bolt's threaded portion 272 is in engagement with the counterpart threads in the housing 262, rotating bolt causes the bolt 270 to move along the X-axis relative to the housing 262. The keyed coupling via the aperture 300 allows the bolt 270 to slideably move relative to the shaft 278.

One aspect of the present teachings relates to transferring the motion of a driven bolt along a first direction to the motion of an actuator along a second direction. In FIG. 8, the bolt 270 is driven along the X-axis in the manner described above. The transfer mechanism 242 further comprises an assembly 280 having an actuator 286 that extends along the Y-axis. The actuator 286 comprises a generally elongate member having a first end 308*a* and a second end 308*b*. The first end 308*a* defines an angled surface 282 that forms an angle relative to a plane perpendicular to the axis of the actuator 286. The angled surface 282 engages the engagement surface 274 of the bolt 270 to cause transfer of directionality of motion in a manner described below. The second end 308*b* defines an adjustment tube engagement surface 284 that engages the adjustment tube (240 in FIG. 7).

The first end 308*a* of the actuator 286 is positioned within the housing 262 through the output portion 266 of the housing 262 and engages the bolt 270 in a manner described below. The second end 308*b* of the actuator 286 is positioned within the scope (226 in FIG. 7). In one embodiment, the second end 308*b* of the actuator 286 extends through an aperture 294 defined by a guide member 296. The guide member 296 may be a part of an interface assembly 290 that allows formation of the coupling 230 (FIG. 7) of the adjustment mechanism 224 to the scope 226. The interface assembly 290 may further comprise latching members 292 that allow the coupling 230 to be secure.

As also seen in FIG. 8, the X-axis orientation of the motor shaft 278 allows a simple coupling of the motor output to the dial indicator 260 described above in reference to FIG. 7. In one embodiment, the transfer mechanism 242 further comprises a dial coupling pin 302 that extends in the X-direction. The motor end of the pin 302 is dimensioned to fit into the keyed aperture 300 defined by the bolt 270. The dial end of the pin 302 is dimensioned to extend through a dial coupling aperture 304 defined by the housing 262 at a location generally opposite from the input portion 264. The area adjacent the dial coupling aperture 304 may be recessed to form a recess 306 dimensioned to receive a dial coupling member 310. The coupling member 310 couples the pin 302 to the dial 260. It should be understood that there are a number of ways the dial 260 can be coupled to the motor shaft 278 without departing from the spirit of the present teachings.

Figure 9:
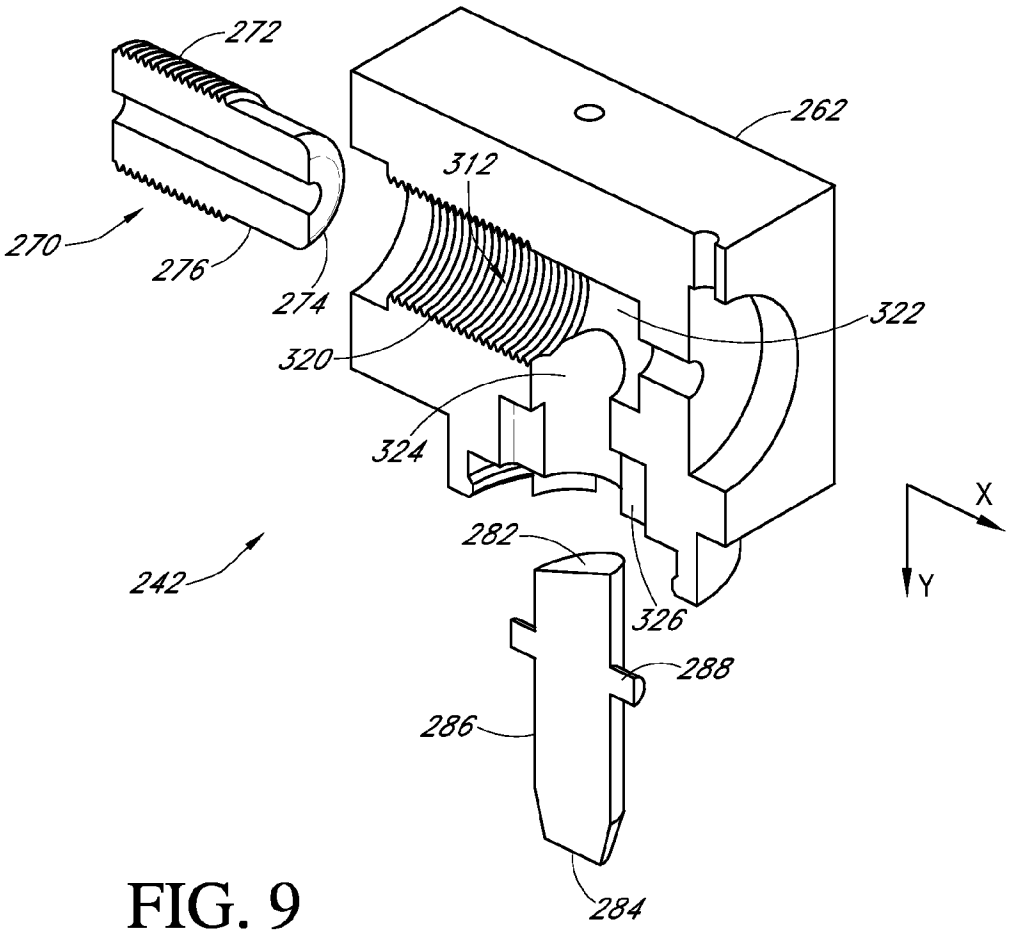
FIG. 9 illustrates a cutaway view of part of the scope adjustment system of FIG. 8, showing the positioning of the bolt with respect to the actuator.

FIG. 9 now illustrates a cutaway view of the transfer mechanism 242 showing the internal structure of the housing 262. The housing 262 defines an input aperture 312 having a threaded-wall portion 320 and a smooth-wall portion 322. The input aperture 312 extends generally along the X-axis. The threaded-wall portion 320 is adapted to mate with the threaded portion 272 of the bolt 270, and the smooth-wall portion 322 is dimensioned to receive the smooth portion 276 of the bolt 270, and to allow X-motion of the engagement surface 274.

The housing 262 further defines an output aperture 324 that extends generally along the Y-axis. The output aperture 324 is dimensioned to receive the actuator 286 and allow Y-motion of the actuator 286 as a result of the engagements of the angled surface 282 and the adjustment tube engagement surface 284 with the engagement surface 274 of the bolt 270 and the adjustment tube (240 in FIG. 7), respectively.

Because the orientation of the angled surface 282 with respect to the bolt 270 (the angle between the bolt's axis and angled surface's normal line) affects the manner in which motion is transferred, it is preferable to maintain such an orientation angle substantially fixed. One way of maintaining such a fixed orientation angle is to inhibit the actuator 286 from rotating about its own axis with respect to the bolt 270. In one embodiment, the actuator 286 includes guiding tabs 288. The housing 262 further defines guiding slots 326 adjacent the output aperture 324. The guiding tabs 288 and the guiding slots 326 are dimensioned so as to inhibit rotational movement of the actuator 286 about its axis, while allowing Y-motion of the actuator 286.

Figure 10:
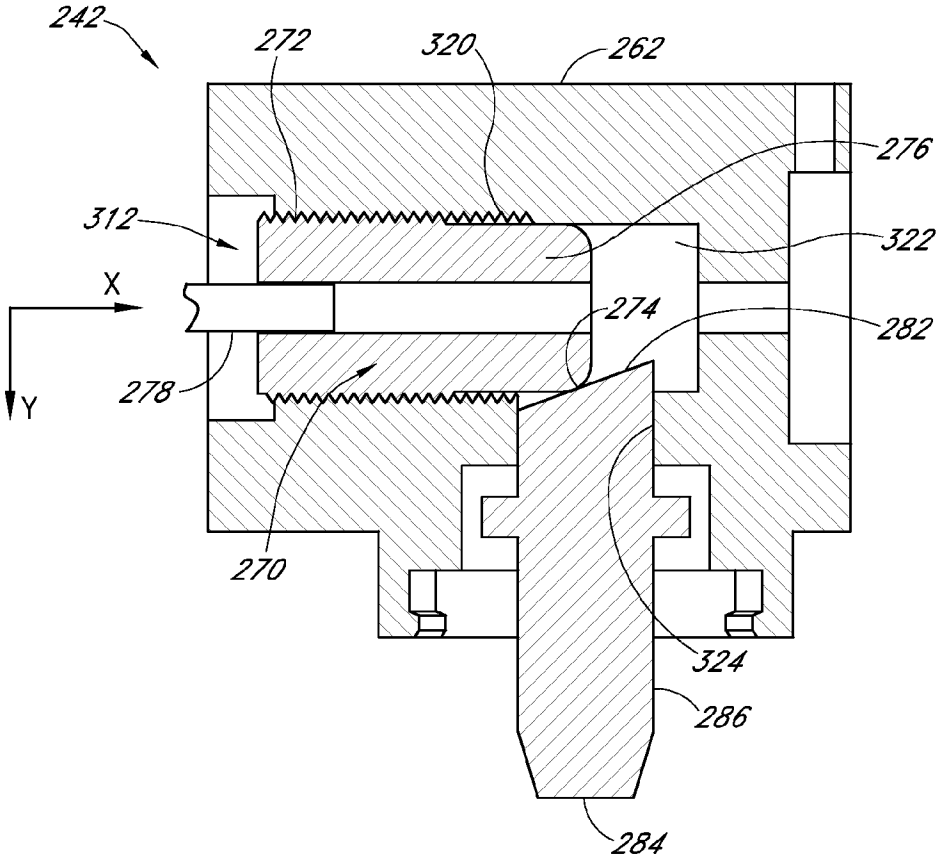
FIG. 10 illustrates a side view of part of the scope adjustment system of FIG. 9, showing the engagement of the bolt with an angled surface of the actuator.

FIG. 10 now illustrates a sectional side view of the transfer mechanism 242. In particular, the engagement between the bolt 270 and the actuator 286 is shown clearly. Along the X-axis, the threaded portion 272 of the bolt 270 mates with the threaded-wall portion 320 of the input aperture 312 and the smooth portion 276 of the bolt 270 extends into the smooth-walled portion 322 of the input aperture 312. Along the Y-axis, the actuator 286 extends into the output aperture 324 such that the angled surface 282 engages the engagement surface 274 of the bolt 270.

With such a transfer mechanism configuration, rotation of the bolt 270 by the shaft 278 causes the bolt 270 to move along the X-axis. If the bolt 270 moves towards the angled surface 282, the transferred motion causes the actuator 286 to move away from the bolt 270. Such a motion of the actuator 286 causes the adjustment tube engagement surface 284 to push against the adjustment tube. As previously described, the adjustment tube may be biased (by some spring, for example) towards the actuator. Thus, if the bolt 270 moves away from the angled surface 282 (via the counter-rotation of the bolt), the actuator 286 is able to move towards the bolt 270, and the bias on the adjustment tube facilitates such movement of the actuator 286. Thus, it will be appreciated that the Y-motion of the actuator 286 is induced by the X-motion of the bolt 270.

Figure 11:
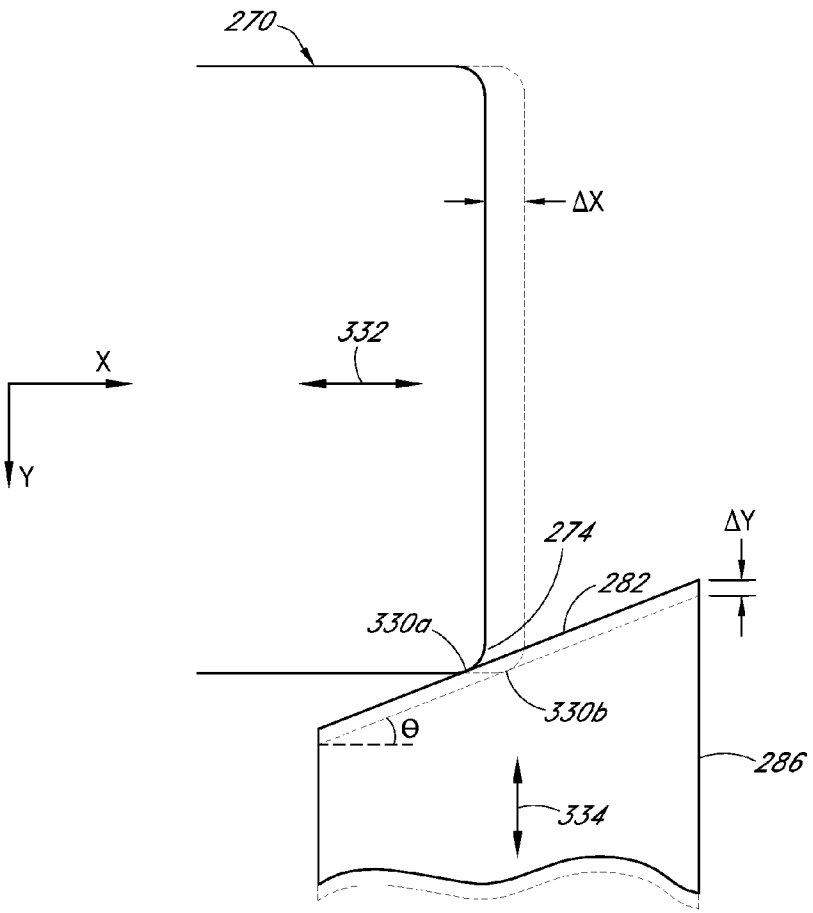
FIG. 11 illustrates how the motion of the bolt along the exemplary X-direction is translated into the exemplary Y-direction, wherein the angle of the angle surface determines the ratio of movement magnitudes between the X and Y movements.

FIG. 11 illustrates an expanded view of the engagement between the bolt 270 and the actuator 286. In particular, FIG. 11 shows how the configuration of the angled surface 282 affects the movement transfer. In one embodiment, the plane defined by the angled surface 282 is substantially perpendicular to the plane defined by the bolt's axis (X-axis) and the actuator's axis (Y-axis). In such a configuration, angle □ defines the angle of the angled surface 282 with respect to the X-axis.

As previously described, the bolt 270 motion is substantially restricted along the X-axis (as shown by an arrow 332), and the actuator 286 motion is substantially restricted along the Y-axis (as shown by an arrow 334). As such, two exemplary engagement positions, 330*a* and 330*b*, of the engagement surface 274 are depicted as solid and dotted lines, respectively. The X-displacement between the two positions of the bolt 270 is denoted as ΔX. The corresponding positions of the actuator 286 are depicted respectively as solid and dotted lines. The corresponding Y-displacement of the actuator 286 is denoted as ΔY. From the geometry of the engagement configuration, one can see that ΔX and obey a simple relationship $$\Delta Y = \Delta X \tan \theta. \quad (1)$$

One can see that tan θ is effectively a reduction (or an increasing) term. For θ between 0 and 45 degrees, the value of tan θ ranges from 0 to 1. For θ between 45 and 90 degrees, the value of tan θ ranges from 1 to a large number. In the scope application, a fine control of ΔY is usually desired. Thus, by selecting an appropriate angle θ, one can achieve the desired ΔY resolution without having to rely on a fine resolution motor.

As an example, an angle of 20 degrees yields a reduction factor of approximately 0.364. If one selects an exemplary thread count of 32 (threads per inch) for the bolt threads, one rotation of the bolt results in ΔX of approximately 0.03125 inch, and the resulting ΔY would be approximately 0.03125 inch×0.364=0.0114 inch. It should be understood that any number of other thread pitches of the bolt and angles of the angled surface may be utilized without departing from the spirit of the present teachings.

It will be appreciated that the X-Y motion transfer performed in a foregoing manner using an angled surface benefits from advantageous features. One such advantage is that because any value of the angle of the angled surface can be selected during fabrication of the actuator, the reduction factor comprises a continuum of values, unlike discrete values associated with reduction gear systems. Another advantage is that for a given reduction value (i.e., given angle), the substantially smooth angled engagement surface allows a substantially continuous motion transfer having a substantially linear response.

It will be appreciated that the novel concept of transferring motion via the angled engagement surface can be implemented in any number of ways. In the description above in reference to FIGS. 8-11, the bolt 270 and the actuator 286 are generally cylindrical shaped structures. It should be understood, however, that any number of other shaped structures may be utilized for the bolt and/or the actuator. Furthermore, the bolt does not necessarily have to be moved via the threaded means. It could be pushed/pulled in a non-rotating manner by some other linear driving device. Thus, for example, a non-rotating bolt having a non-circular sectional shape may engage an angled surface of an actuator having a non-circular sectional shape, and provide similar reduction factor in transferred motion without departing from the spirit of the present teachings. Moreover, while the transfer mechanism 242 is described for use in conjunction with the adjustment of a telescopic sight for a firearm, such transfer mechanism (or some mechanism similar to it) can also be used in any of a number of different implementations where fine control adjustment is needed without departing from the spirit of the present teachings.

It will also be appreciated that in certain embodiments, the motion transfer between a driving shaft and an actuator is achieved by other means. For example, a cam device may be attached to the driving shaft, and one end of the actuator may be adapted to engage the cam so as to provide a variable actuator position depending on the cam's (thus driving shaft's) orientation with respect to the actuator. In another example, a driving shaft may be oriented generally parallel (but offset) to an actuator. The end of the shaft may comprise a curved surface such that an end of the actuator engages the curved surface of the shaft. When the shaft is made to rotate, the curved and offset surface causes the actuator to change its position.

Figure 12A:
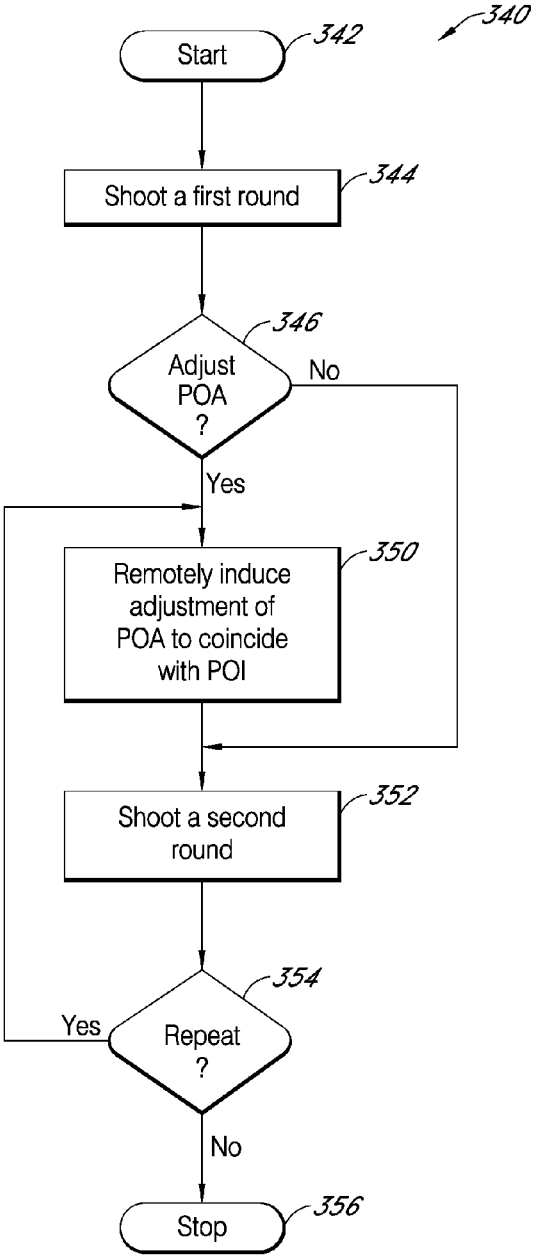
FIG. 12A illustrates one possible process for adjusting a point of aim with respect to a point of impact of a projectile.
Figure 12B:
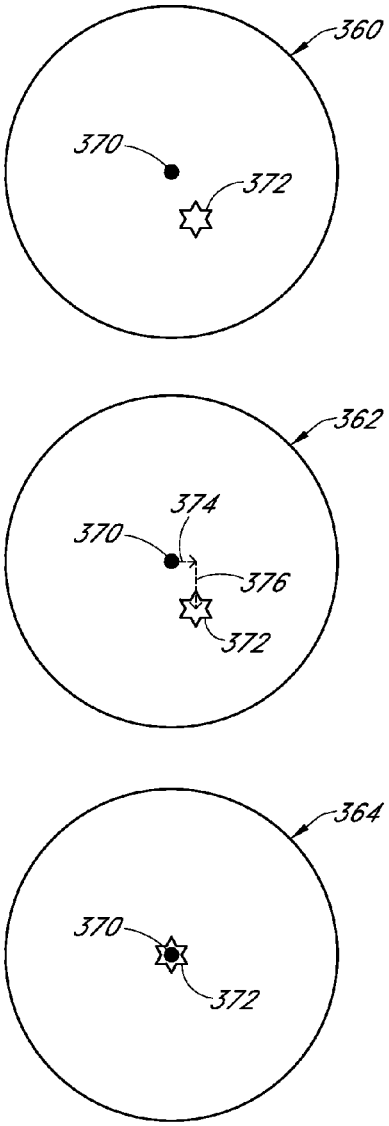
FIG. 12B illustrates a relative position of the point of aim and the point of impact during the process of FIG. 12A.

The scope adjustment system described above allows a shooter to adjust the POA to coincide with the projectile's POI while maintaining the scope sight picture and not significantly altering the shooting posture. FIG. 12A illustrates one possible implementation of a process 340 for such adjustment of the POA. FIG. 12B illustrates various scope sight pictures corresponding to various steps of the process 340.

The process 340 begins at a start state 342, and in state 344 that follows, the shooter shoots a first round at a target. After the first shot is made, a scope sight picture 360 shows that a POI 372 of the first round is displaced from a POA 370. Such POA-POI discrepancy is depicted for the purpose of describing the adjustment process. The POA may coincide with the POI sufficiently, in which case, adjustment is not necessary. In a decision state 346, the shooter determines whether the POA should be adjusted. If the answer is "No," then the scope adjustment is not performed, and the shooter can either shoot a second round in state 352, or simply stop shooting in state 354.

If the answer to the decision state 346 is "Yes," then the shooter remotely induces adjustment of the POA in state 350 such that the POA 370 is moved to the POI 372. One possible movement sequence of the POA 370 is depicted in a scope sight picture 362, as a horizontal (windage) correction 374 followed by a vertical (elevation) correction 376. It will be appreciated that the movement of the POA to the POI may comprise any number of sequences. For example, the vertical movement may be performed before the horizontal movement without departing from the spirit of the present teachings. Furthermore, the POA movement sequence depicted in FIG. 12B assumes that the scope adjustment system controls both the elevation and windage adjustments. As previously described, however, only one of elevation or windage adjustments may be performed in a similar manner without departing from the spirit of the present teachings.

Once the POA is adjusted in state 350, the shooter, in state 352, may shoot a second round to confirm the adjustment. A scope sight picture 364 depicts such a confirmation, where the POA 370 coincides with the POI 372.

The portion of the process 340 described above may be repeated if the shooter determines in a decision state 354 to do so. If the adjustment is to be repeated, the process 340 loops back to state 350 where another remotely induced adjustment is made. If the adjustment is not to be made ("no" in decision state 354), the process 340 ends in state 356.

It will be understood that the meaning of POA coinciding with POI does not necessarily mean that a particular given projectile's POI coincides precisely with the POA. As is generally understood in the art, the intrinsic accuracy of a given rifle may cause several POIs to group at the target, regardless of the shooter's skill. Thus, the POA preferably should be positioned at the center of the group of POIs. In certain situations, the shooter may decide that even if the second shot does not place the POA precisely on the POI, the adjustment is good enough for the intended shooting application. Thus, it will be appreciated that whether or not the adjusted POA coincides precisely with the POI in no way affects the novel concept of scope adjustment described herein.

It will also be appreciated that the quick and efficient POA adjustment described above does not depend on the shooter's knowledge of the ballistic parameters such as target distance, wind speed, or bullet properties, provided that these parameters do not change significantly during the adjustment. The POA adjustment is simply performed based on the initial empirical POA-POI discrepancy. If one or more parameters change, the POA may be re-adjusted in a similar manner, again in a quick and efficient manner. For example, a change in the ammunition may change the bullet type and the ballistics of the projectile's trajectory, thereby changing the POI. A target distance change may cause the POI to change from that of the previous distance. A change in wind speed or direction also may cause the POI to change.

It will be appreciated that various embodiments of the rifle scope described herein allows a shooter to adjust the POA with respect to the POI without having to disturb the shooting posture or the scope sight picture. Such an advantage is provided by various embodiments of the remote controller disposed at an appropriate location (such as adjacent to the trigger for the trigger finger manipulation or adjacent a thumb-operated safety for thumb manipulation), and various embodiments of the adjustment mechanism that responds to the manipulation of the remote controller. As is known in the art, maintaining a proper shooting posture greatly improves the shooter's ability to deliver the bullet to a desired target location.

It will also be appreciated that the aforementioned advantageous features can naturally be extended to other forms of hand-held firearms (such as handguns) and other projectile launching devices (such as bows, crossbows, bazookas, mortars, etc.) equipped with optical sighting devices. As is also known, a proper shooting posture and maintaining of such posture in these non-rifle applications also improve the shooter's ability to deliver the projectile to its intended target location in an accurate manner.

FIGS. 13-20 now illustrate various embodiments of an integrated sighting system that advantageously incorporates one or more ballistic parameter in determining and effecting a corresponding POA adjustment. In one aspect, such a system allows a shooter to acquire a target, and the one or more ballistic parameter. The system further determines the necessary POA adjustment based on the ballistic parameter(s), and causes the POA to be adjusted accordingly. It will be appreciated that such a system can be particularly useful in situations where some of the ballistic parameters can change relatively quickly (such as hunting).

Figure 13A:
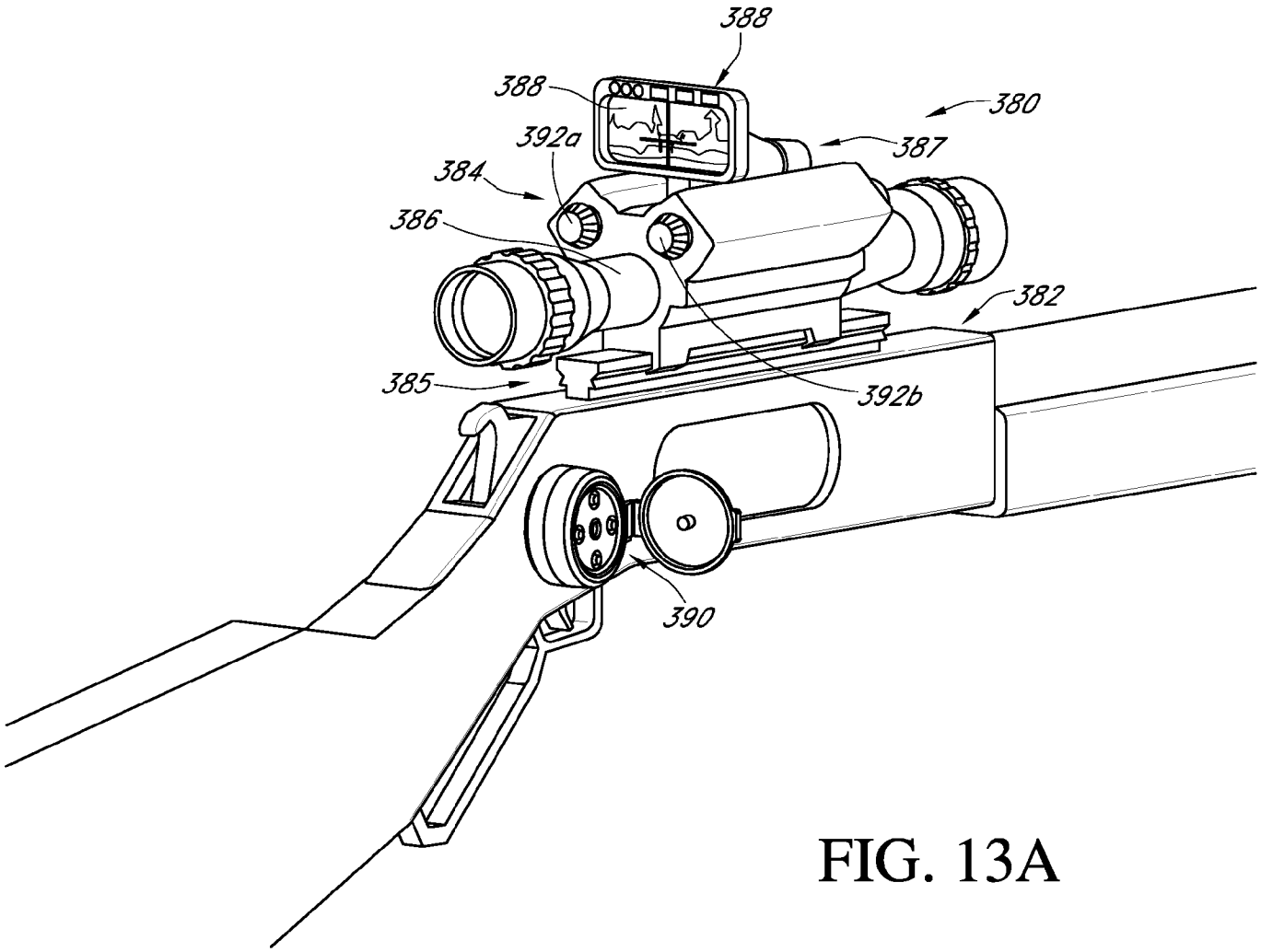
FIG. 13A illustrates another embodiment of a scope adjustment system, wherein the system includes a digital display of the sighting system's field-of-view, an embodied adjustment mechanism, processor, and ballistic parameter sensors that provides at least one ballistic parameter associated with the projectile or the shooting environment to a ballistic parameter device and processor that predicts where the point of impact will be at based on the input parameter.
Figures 1, 13A:
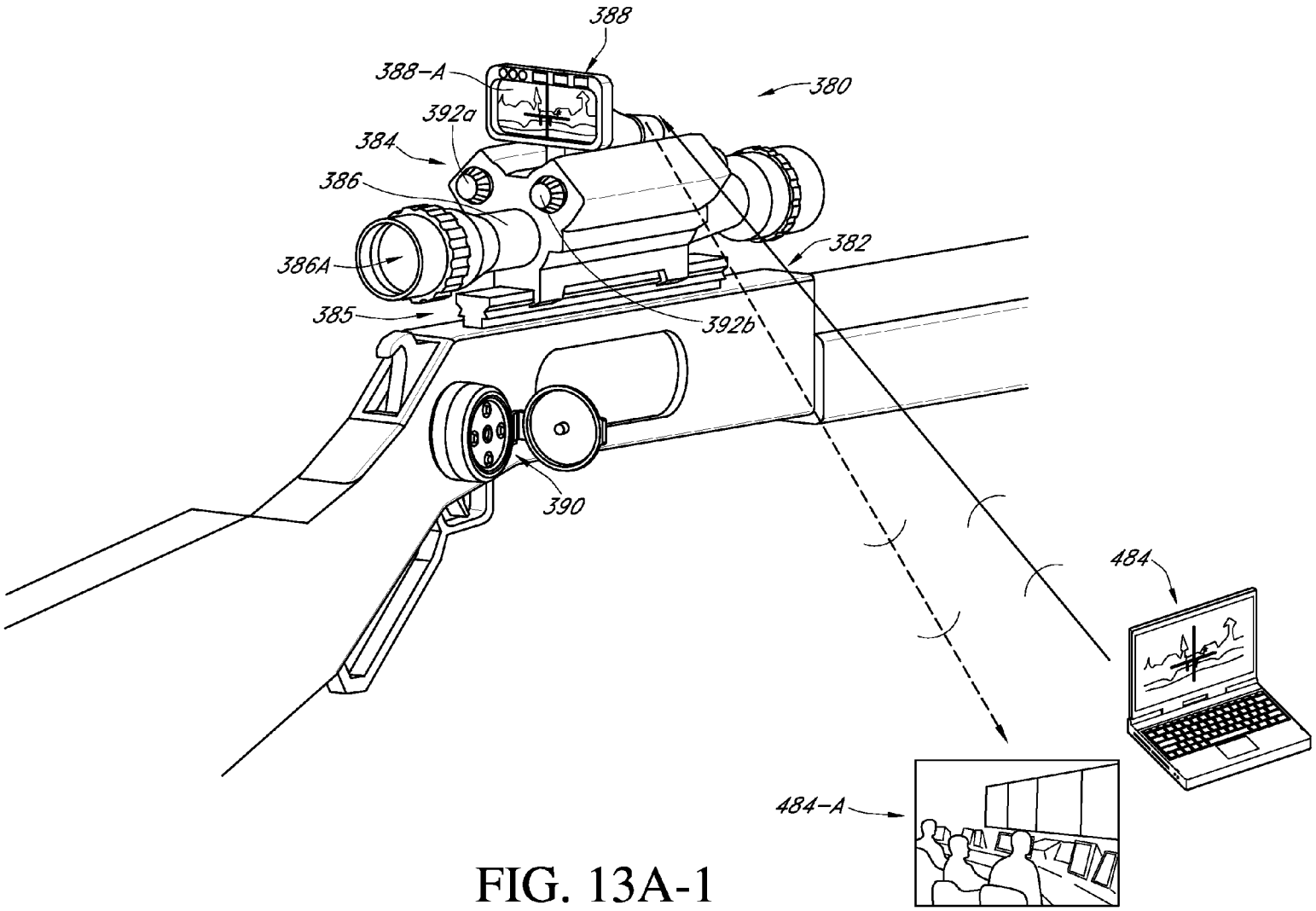

FIG. 13A illustrates one embodiment of an integrated sighting system 380 having a scope 386 with an automatic POA/POI adjustment system 384 coupled thereto. The integrated sighting system 380 can further include an integrated ballistic parameter system (described in greater detail in reference to FIG. 14C), an automatic optical auto-zoom and auto-focus device 385, a digital display screen 388, and a night vision device 387. The adjustment system 384 may include a remote controller 390 that can function in a manner described herein, and/or as selector switches for various other functions as described in reference to FIG. 14C-3. The integrated sighting system 380 may also incorporate installation of or coupling with an internal compass and/or GPS device (e.g., as described in reference to FIG. 14C-1) to help sportsmen, law enforcement and/or military personnel to locate and monitor the movement and activity of others from remote locations (e.g., as described in reference to FIG. 13E). In certain situations, the internal compass and GPS features can also help authorized personnel to locate the Confirmed Target Coordinate (CTC) of intended target 492 from a remote location 485. The integrated sighting system 380 of FIG. 13A is shown to be mounted on a rifle 382 but it may be mounted to any hand-held, hands-free, portable, and/or mobile projectile-launching device(s) without departing from the spirit of the present teachings.

In FIG. 13A-1 the visual fields of view 388, 386-A of this embodiment can be either digitally displayed (388-A), and/or viewed via glass optics 386-A. If the scope has digital display capabilities, such digital information can be viewed by the shooter, and/or transmitted via a communication link such as a wireless-link to an independent handheld monitoring and/or recording device such as a laptop computer 484, or a central-control monitoring-command center 484-A. Such hand held devices and/or central command centers can be operated, for example, by authorized personnel of law enforcement, military or other government agencies as well as sportsmen, shooter or hunting club organizations.

These independent devices and command centers can allow the shooter to observe the targets being aimed and fired-upon from a remote location. These independent devices and/or command centers can also allow the shooter and/or authorized personnel to over-ride the automatic features of the scope in the event they want to take-over manual control of the scope from a remote location. In addition, the shooter or authorized personnel can make and record new POA/POI, magnification, and/or night vision adjustments to the scope from the remote locations. The digital recordings of these automatic POA/POI and magnification adjustments can be recorded and stored in the sighting system's built-in memory or in other devices (such as an SD card) from a remote location.

In FIGS. 13A and 13A-1, the adjustment system 384 may use any of the previously described adjustment mechanisms without departing from the spirit of the present teachings. The system 384 in FIGS. 13A and 13A-1 are depicted as having an automatic electronically-controlled elevation adjustment indicator dial 392*a* and an automatic electronically-controlled windage adjustment indicator dial 392*b*. These automatic electronically-controlled adjustment mechanisms can be controlled by a combination of an internal processor and internal ballistic parameter device, one embodiment of which is shown in FIG. 14C-1, all of which may be internally housed and integrated into the sighting system's design. A transfer mechanism similar to that described above in reference to FIGS. 8-10 may be utilized to effect and monitor each of the elevation and windage adjustments. Alternatively, any number of other transfer mechanisms may be utilized in the adjustment system without departing from the spirit of the present teachings.

Figure 13B:
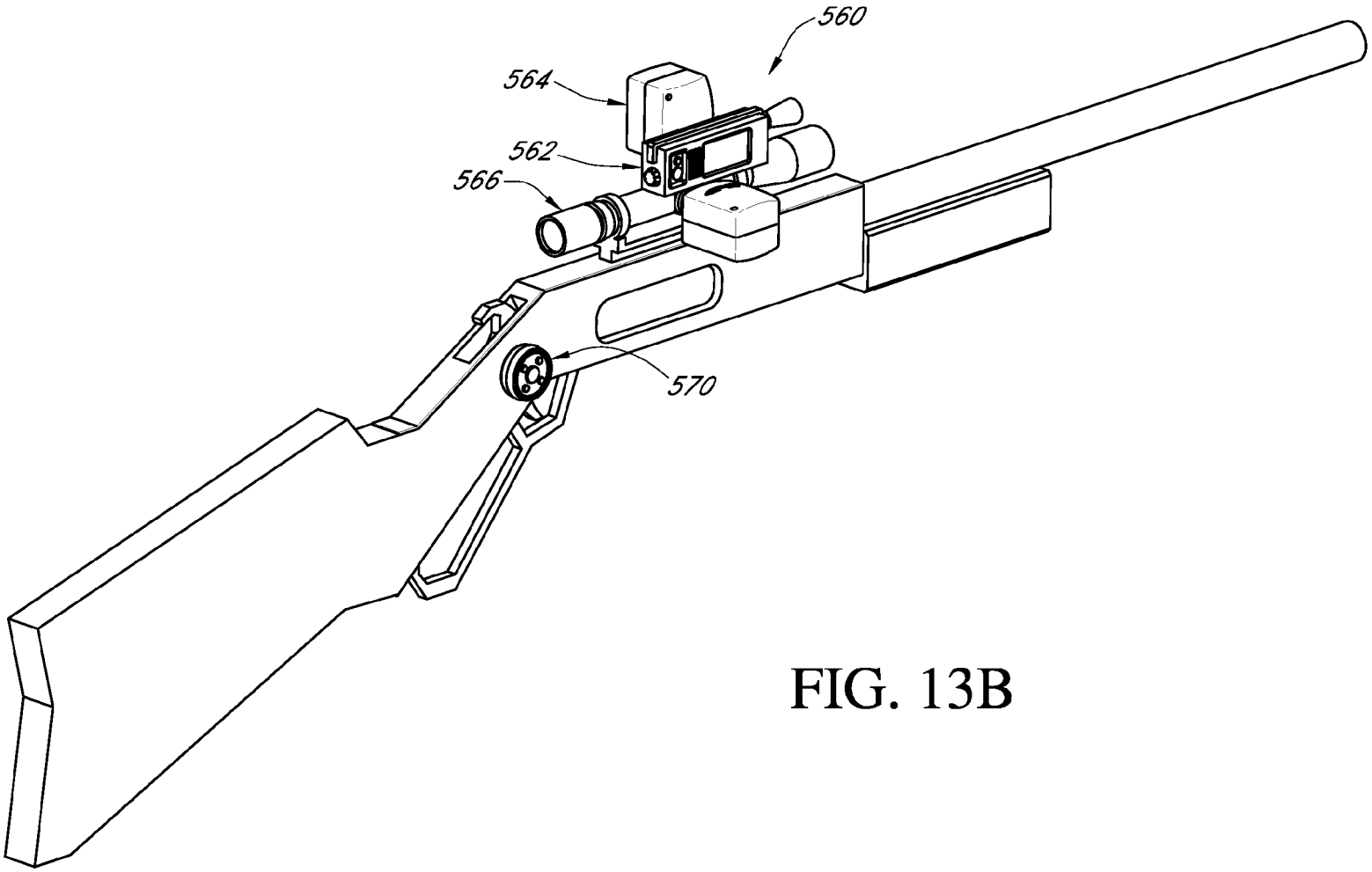
FIG. 13B illustrates another embodiment of a scope adjustment system having a detached ballistic parameter device, similar in function to the embodied ballistic parameter device of FIG. 13A, wherein, the ballistic parameter device and adjustment system can be retrofitted to a scope (e.g., a commercially available scope) or operated from an independent optical sighting device such as a telescope, binocular, monocular, spotting scope, etc.

FIG. 13B illustrates another embodiment of a sighting system 560 having a scope 566 with an adjustment system 564 coupled thereto, and a ballistic parameter device 562 detached from the adjustment system 564. In certain implementations, this embodiment can be retrofitted to an existing scope such that the scope can be converted into an automatic sighting system having similar functionalities as the scope described in reference to FIG. 13A. The ballistic parameter device 562 is shown to be attached to the scope 566, but not to the adjustment system 564. Thus the adjustment system 564 can be attached to an existing scope as illustrated in FIG. 4A or integrated into the housing of a scope as illustrated in FIG. 13A. The ballistic parameter device, which is independent of the adjustment system in this example, can control the adjustment system. The ballistic parameter device may determine one or more ballistic parameters (e.g., described in greater detail in reference to FIG. 14C), determine the adjustment based on the ballistic parameter(s), and communicate a signal representative of the adjustment to the adjustment system 564. As described herein, such communication of the signal between the ballistic parameter device 562 and the adjustment system 564 may be achieved by either a wire-based link or a wireless link. Some benefits of having the ballistic parameter device being configured in this fashion can include the ability to operate the automatic sighting system from an independent location and with less weight being placed on the projectile launching device (e.g., rifle) (due to the removal of the ballistic parameter device from the projectile launching device) as well as the ability to retrofit this configuration to an existing scope (e.g., a commercially available scope) as previously described.

Figure 13C:
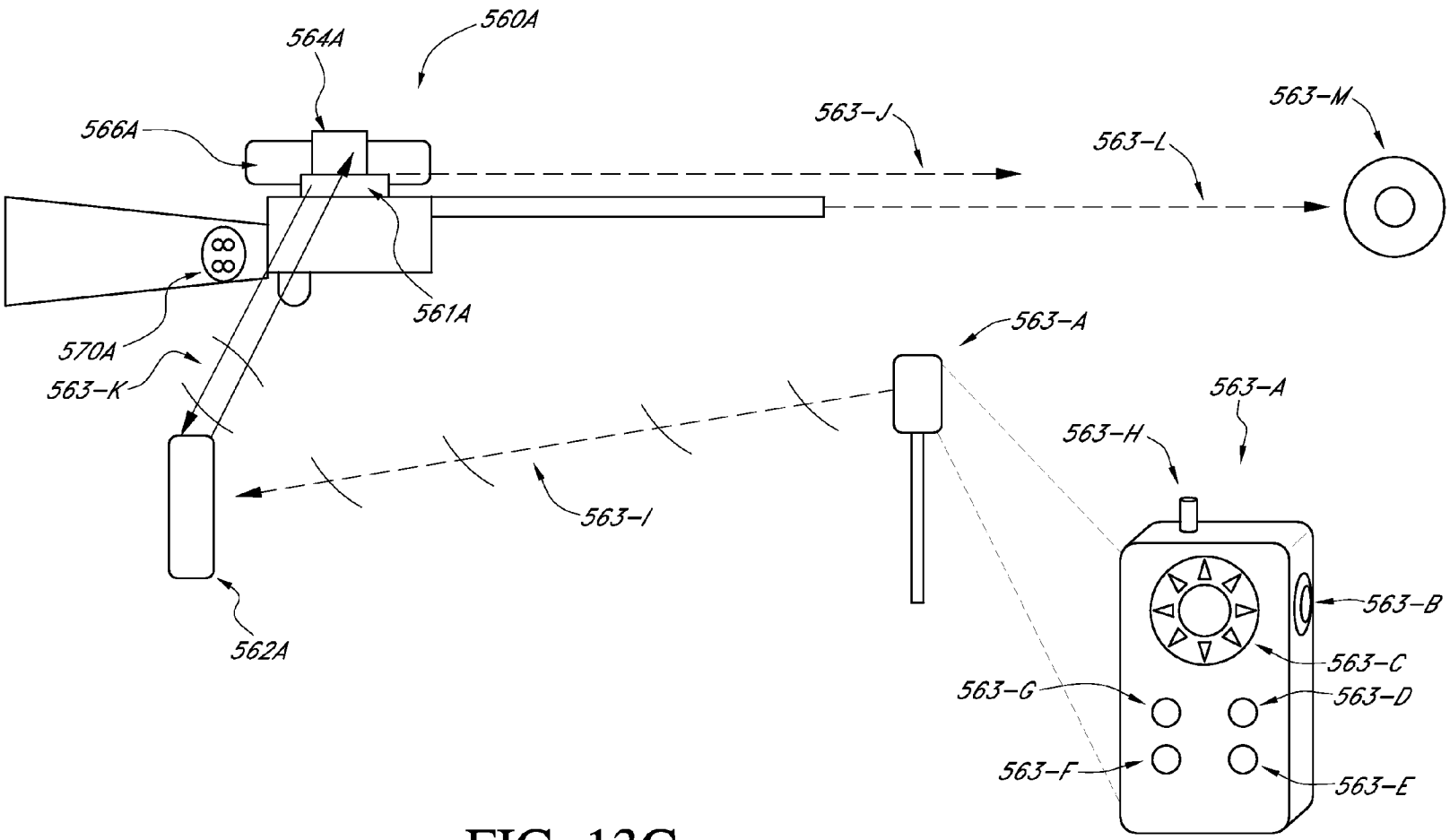
FIG. 13C illustrates another embodiment of a scope housing system having a scope with an adjustment system receiving its digital transmission commands from a detached ballistic parameter device. The detached ballistic parameter device obtains its ballistic parameters from the sighting system's rangefinder, inclinometer and compass, and a remote ballistic parameter sensing device.
Figures 1, 13C:
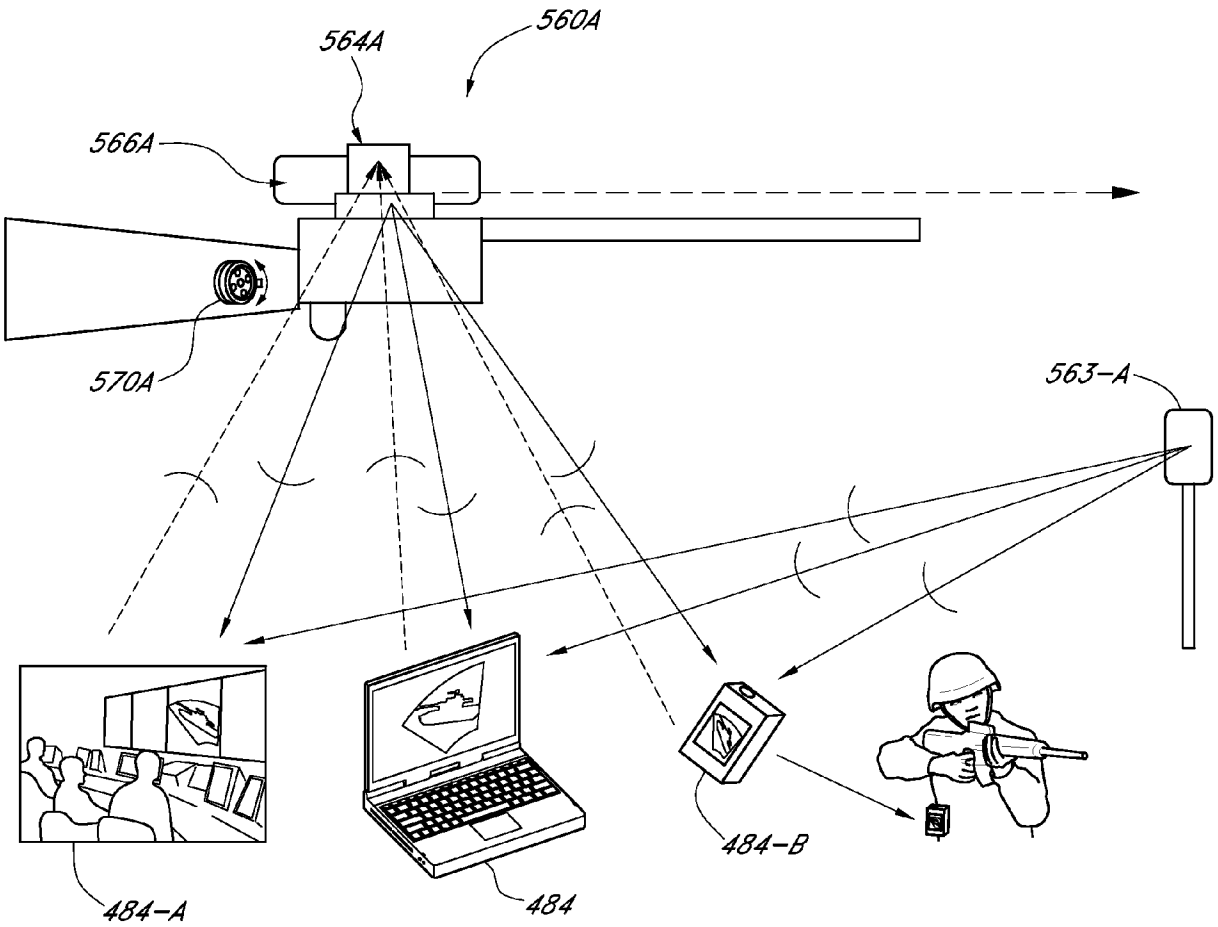

FIG. 13C illustrates another embodiment of a scope housing system 560A having a scope 566A that integrates an adjustment system 564A having one or more features as described herein coupled thereto or integrated therein during manufacture. Similar in function to the embodiment described in reference to FIG. 13B, this embodiment also has a ballistic parameter and controller device 562A that can be easily detached from both the adjustment system 564A and the scope housing system 560A. However, unlike the embodiment of FIG. 13B where the rangefinder, inclinometer digital compass and GPS devices are integrated into the ballistic parameter device, these devices or components can be incorporated into the housing of the scope. The ballistic parameter and controller device 562A can receive the digital transmissions from these aforementioned ballistic parameter sensing devices. In addition, the ballistic parameter device also can receive wind, temperature and various other ballistic parameter information from a remote sensor 563-A. Based upon the ballistic parameter information received, the ballistic parameter device can automatically determine a proper POA to POI adjustment, and then transmit the proper adjustment commands to the adjustment system 564A for proper adjustment. The ballistic parameter controller device can be wire-based linked or wireless link that may receive yardage and slope data from the range finder and/or inclinometer 561A. The ballistic parameter and controller device 562A can also be fed wind data, temperature data and other environmental field data from a remote sensing device 563A. The remote sensing device 563A may be wirelessly linked to the ballistic parameter and controller device 562A. The ballistic parameter and controller device 562A may be hand-held or attached to a shooter's belt (e.g., FIG. 14C-2), or positioned in any manner that the shooter prefers. The ballistic parameter and controller device 562A may be a small notebook computer, a programmable iPod, or any similar device capable of downloading and executing the necessary parameter software or application software (APP). The ballistic parameter and controller device 562A may determine one or more ballistic parameters from the data gathered from the range finder and inclinometer 561A and the remote sensing device 563A and then calculate the required POA to POI adjustment based on these ballistic parameter(s). The ballistic parameter and controller device 562A may then transmit a data signal representative of the required or desired vertical and windage adjustment for the POA to POI adjustment to the adjustment system 564A. As described herein, such communication of the signal between the ballistic parameter controller device 562A and the adjustment system 564A may be achieved by either a wire-based link or a wireless link.

The rifles illustrated in FIGS. 13B and 13C also depict a remote controller 570, 570A which may be configured to control the adjustment system 564, 564A directly, control the adjustment system 564, 564A via the ballistic parameter controller device 562, 562A, control the operation of the ballistic parameter controller device 562 and 562A, or any combination thereof. The link between the remote controller 570 and the ballistic parameter controller device 562, 562A and/or the adjustment system 564 564A, may be achieved by wireless link, wire-based link, or any combination thereof.

The adjustment system 564, 564 A in FIGS. 13B and 13C comprises the elevation and windage adjusting mechanisms. In some implementations, the adjustment mechanisms are not limited to only electro-mechanical devices, but may also include a software-controlled adjustment display; visible on a digital field-of-view screen or super-imposed over a glass-optics field-of view. It will be appreciated that such depiction is in no way intended to limit the scope of the present teachings with respect to the usage of the detached ballistic parameter controller devices 562, 562A. Such a device can also be used in conjunction with either of the elevation or windage adjusting mechanism separately without departing from the spirit of the present teachings. It will also be appreciated that such a device can be used in conjunction with any of the various embodiments of the adjusting mechanisms described herein.

It will also be appreciated that although the detached ballistic parameter device 562 in FIG. 13B is depicted as being mounted to the scope 566, such device could be mounted in other locations on the rifle or in other locations detached from the rifle without departing from the spirit of the present teachings. For example, the ballistic parameter device could be adapted to be mounted on the forestock, under the barrel, or it could be attached to the belt of the shooter (e.g., FIG. 13C-1) or an independent optical sighting device such as, but not limited to, a commercially available telescope, pair of binoculars, monocular, spotting scope, theodolite, and/or integrated into the housing of a proprietary optical sighting device such as a custom-made high powered telescope. The detached ballistic parameter device can be operated by an individual other than the shooter (for example, sniper team spotter, mortar team member etc.) whose proximity is in close or closer vicinity with and subject to the same environmental parameters of the projectile and projectile launching device. The ballistic parameter device, the scope, and/or the adjustment system may also be integrated into a single integrated scope design as depicted in FIG. 13A.

It will also be appreciated that by having a detached ballistic parameter device, such a device could be used in conjunction with an existing adjustment system without having to retrofit or replace the scope/adjustment assembly. Some of the possible functionalities of the detached ballistic parameter device 562 are described below in greater detail.

FIG. 13C-1 illustrates an embodiment having similar digital viewing and operating capabilities as the examples of FIG. 13 and FIG. 13A-1, except that the digital display (388 in FIGS. 13A and 13A-1) is not physically coupled to the scope assembly (380 in FIGS. 13A and 13A-1). Instead, in FIG. 13C-1 the digital field of view is illustrated as being detached from the scope and housed in a separate embodiment 484-B. The embodiment of 484-B can also act as a handheld transmitting and receiving device. The handheld device 484-B can be capable of receiving digital ballistic information from a remote sensor 563-A as well as transmitting digital operating commands to and receiving signals from the scope assembly 560-A. The handheld device 484-B can be operated in close proximity to the scope and projectile launching device or from a remote location. The handheld device 484-B can operate in a similar fashion as a handheld device illustrated as a PC 484, or a central command center illustrated as 484-A. The handheld device 484-B can have a digital view screen coupled thereto and remote control command buttons similar in function to those of the remote controller (e.g., FIG. 14C-3). The digital view screen can be viewed and operated by the shooter or an independent operator from a remote location.

FIGS. 13-D, 13D-1 and 13D-2 illustrate that the remote viewing and operating features of the sighting system as described herein, when coupled to a projectile launching device 382-A, can be attached to a remote-controlled gimbaled robotic apparatus (GRA) 388-B, 388-B1, and 388-B-2. In these illustrations, the GRA can be, for example: 1). FIG. 13-D a remote controlled tripod 388-B coupled (e.g., retrofitted) to a government-issued weapon (operated from a stationary platform); 2). FIG. 13-D-1, an integrated scope/weapon/tripod 388-B-1 (also operated from a stationary platform); and 3). FIG. 13-D-2 a remote controlled GRA 388-B-2 that can be integrated with a projectile launching device 382-A and a remote controlled ATV 389 (operated as a transport vehicle (TRV)). It is noted, however, that one or more features of the present teachings can include any example of a commercially available or custom-made gimbaled robotic apparatus (GRA) operated from the ground or air from a stationary and/or TRV, without departing from the present teachings. The GRA can be configured to be able to adequately perform vertical and horizontal rotations in a quick and precise fashion and be configured to be wirelessly operated from a remote location. The GRA can be wirelessly operated using a computing device such as a laptop computer 484 or similar handheld device. The handheld device 484, and/or central command center of FIG. 13C-1 can operate the GRA and the automatic sighting system from a remote location 388-H.

In FIG. 13-D the example gimbaled robotic apparatus (GRA) tripod system 388-D securely holds a combat-issued rifle in-place 388-C whereas the example of FIG. 13-D-1 integrates the tripod GRA with a remote-controlled weapon system 382-A. In both examples, the tripod GRA systems are able to rotate the projectile launching device both vertically 388-D and horizontally 388-E via wireless commands 388-F (FIG. 13-D). The tripod gimbaled robotic apparatus (GRA) in FIG. 13-D can include a trigger activation device 388-G that can be retrofitted to the government-issued projectile launching device. The trigger activation device allows the shooter to accurately shoot the projectile launching device from a remote location 388-H when used in combination with the gimbaled robotic tripod and automatic sighting system. The trigger activation device can include a wireless receiver and controller that can be activated via wireless commands that are transmitted from the laptop computer 484 or similar handheld device. The example trigger activation device 388-G includes a battery-operated servo-motor that can be controlled to randomly fire single-shots on an as-needed basis or in quick succession (for example, semi-automatic). The trigger activation device 388-G can also operate on fully-automatic projectile launching device where the operator can keep the trigger-activation device continuously depressed from a remote location by keeping the firing-button on his handheld device continuously depressed. For fully-automatic projectile launching device, depressing the firing button (located on the handheld device 484) can signal the trigger-activation device to fire and keep firing until such time that the firing button is released.

It is noted that the wireless trigger-activation device 388-G and remote operating device (e.g., remote controller) can be used separately on a projectile launching device that is operated independently of the digital scope and gimbaled robotic apparatus without departing from the spirit of the present teachings. For example, a shooter may wish to attach the trigger activation device 388-G to his rifle and place his rifle in a traditional bench rest that securely holds his rifle. Without holding the rifle or touching the trigger, the shooter can then proceed to fire the rifle at his intended target by depressing the firing-button on his handheld device 484. This hands-free method of firing and/or sighting-in a projectile launching device can be desirous for a shooter wanting to keep his rifle still when the shot is fired. This hands-free method of firing and/or sighting-in a projectile launching device can be desirous to a shooter with certain physical disabilities that may preclude him from holding and/or firing the projectile launching device 388-J.

The automatic scope sighting system coupled with the gimbaled robotic tripod and trigger activation device (FIG. 13-D) can be retrofitted to most hand-held or portable projectile launching devices and/or integrated into the example weapons systems of FIGS. 13-D-1 and 13-D-2 and effectively take the place of the shooter having to hold the rifle and view the scope from the same location that the weapon is being operated from. The un-manned weapons systems of FIG. 13-D, 13-D-1 and 13-D-2 can be operated by, for example, a sniper who prefers to remain out-of-view and/or out of inclement weather and/or out-of-harms-way of enemy gunfire etc. The unmanned systems depicted in FIGS. 13-D, 13-D-1 and 13-D-2 can also be operated by handicapped, military and law enforcement personnel 388-J that are physically challenged and unable to hold a weapon with their hands and/or arms.

The un-manned scope and weapon systems illustrated in FIG. 13-D and FIG. 13-D-1 can be portable and easily transported in a backpack of a soldier or law enforcement officer. They can also expandable, collapsible, and slope-adjustable; and can be securely anchored into the ground using stakes 388-I and/or other similar anchoring devices without departing from the present teachings. In addition, the unmanned weapons systems depicted in FIG. 13-D-1 and FIG. 13-D-2 can be manufactured and assembled as integrated operating systems without departing from the present teachings. These integrated operating systems may be comprised of the sighting system of the present teachings, where the sighting system is integrated into the uniform housings of a projectile launching device weapon (for example, rifle, machine gun, or mortar weapon) and gimbaled robotic apparatus (GRA) that is coupled to and integrated with a stationary and/or TRV that is operated from either a ground and/or air-based platform.

In FIGS. 13-D and 13-D-1 the vertical and horizontal adjustment commands of the un-manned gimbaled robotic apparatus (GRA) can be determined by an operator who makes such adjustments in response to the sighting system's field-of-view, as displayed on the digital view-screen 388-K, FIG. 13-D of the handheld device 484 or the central control center FIG. 13C-1. The digital view-screen 388-K can be the same digital image as viewed through the view finder of the sighting-system 388-A. The sighting system's digital field-of-view can be digitally transmitted 388-L, streamed in real-time, from the sighting system's built-in transmitter to the receiver of the handheld device 484. The digital field-of view can also be viewed from a Head-Mounted Display (HMD) 388-O which can be observed from either a CRT or a CGI super-imposed image that is projected over a see-through field-of-view without departing from the present teachings. The wireless vertical, horizontal and trigger-activation commands can then be wirelessly transmitted 388-F from the handheld device 484 back to the independent receivers of the scope adjustment system, gimbaled robotic apparatus (GRA), transport vehicle (TRV) 389, FIG. 13-D-2 and trigger activation device (TAG) 388-G, FIG. 13-D (if applicable). Such transmission commands can be sent from the handheld device 484 (FIG. 13-D) to any one of the illustrated gimbaled robotic apparatuses from a remote and/or strategic location that may vary in distance from several feet to many miles away. The wireless link between the sighting-system and unmanned GRA to the shooter and/or command center may be performed via radio frequency, satellite link, internet link, and/or any other wireless connection without departing from the spirit of the present teachings When operating the remote controlled gimbaled robotic apparatus (GRA), the shooter controls the vertical and horizontal movements of the robot. The vertical and horizontal movements of the GRA allows the shooter to adjust the sighting system's field-of-view 388-A (FIG. 13-D) to his preferred POA 388-M, which can be observed via the screen 388-K of the handheld device 484. The shooter can make such field of view adjustments to his weapon and sighting system to the desired coordinate of his intended target in the same manner he would maneuver a hand-held firearm (such as a rifle and scope) using his arms and fingers. The coordinate of the intended target is achieved once the GRA is rotated to the position to where the sighting system's POAI 388-N is placed on the intended target (POA) 388-M. The transmitted commands of the GRA can be controlled by, but are not limited to, keyboard buttons, computer mouse, toggle switch, finger-touch pad or any other similar controlling mechanism without departing from the spirit of the present teachings.

Once the shooter rotates the digital field-of view from a remote location to the desired POA position, and the POAI 388-N, as viewed on the digital screen 388-K is placed on the target 388-M (POA), the automatic zoom and adjustment features of the scope, as described earlier herein, can become engaged in automatically making the proper magnification, night vision (if applicable) and POA to POI adjustments to the field-of-view. These automatic adjustment features of the field-of-view allow the un-manned projectile launching system FIGS. 13-D and 13-D-1 to accurately aim and fire the weapon, from a remote location. Once the operator rotates the GRA so that the POAI 388-N field-of-view 388-K of the sighting system 388-A is placed on the target 388-M, he can then fire the weapon by depressing the trigger-activation command-key on the handheld device 484. By depressing the trigger-activation command-key, a wireless signal is transmitted 388-F from the handheld device 484, and is received by the receiver of either the trigger activation device 388-G; or the integrated firing mechanisms of FIGS. 13-D-1 and 13-D-2. The trigger-activation device 388-G FIG. 13-D can be a battery operated device that contains a servo-motor that is designed to quickly push against the trigger with enough pressure so as to fully activate the projectile launching device's trigger assembly. The projectile launching device's trigger can stay depressed until the shooter releases the trigger-command key. Thus the trigger can remain depressed for fully-automatic weapons, or the trigger can be selectively depressed when shooting semi-automatic weapons.

The shooter can also augment and/or override the automatic features of the sighting system's magnification, night vision, and/or POA/POI adjustments by manually taking control of such automatic features, using his hand-held device 484 from his remote and secure location. Such manual controls allow the shooter to further calibrate and/or manually zoom-in-and-out on a target so as to get a better visual view and confirmed identification before firing-upon his intended target. Authorized personnel can also take-over manual-control of the GRA and sighting system's automatic features from the central command center in the event the shooter becomes incapacitated or must flee from his strategic location due to eminent danger, risk, or requirement of strategic maneuvering.

Figure 13D:
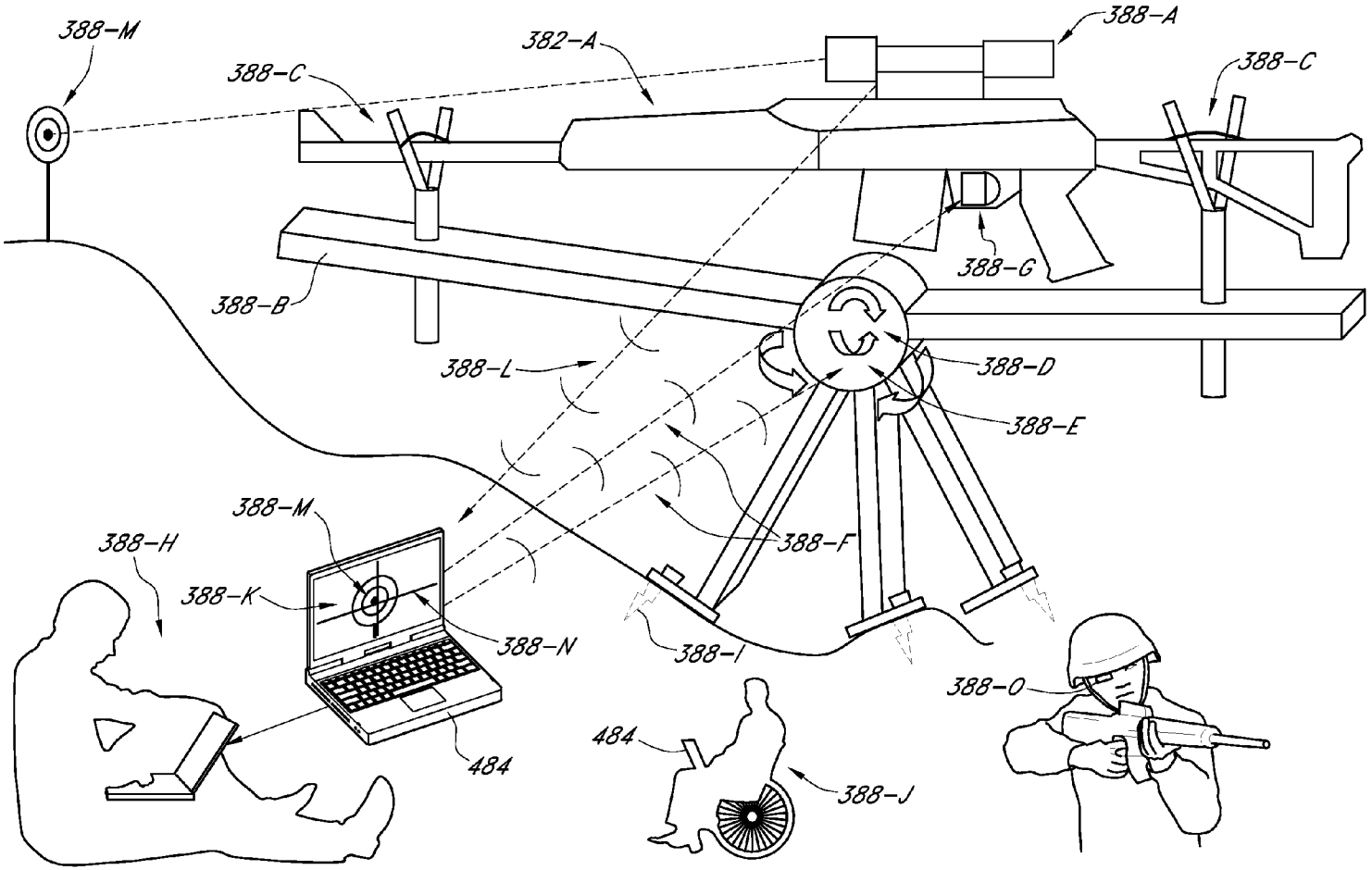
FIG. 13D illustrates another embodiment of a sighting system, wherein the sighting system coupled to a portable projectile launching device can be attached to, and operated in a hands-free manner with the aid of a gimbaled robotic apparatus (GRA) rotation device and a trigger-activation mechanism, each of which can be remote controlled from a hand held device and/or central command system, and/or shooter with disabilities.
Figures 1, 13D:
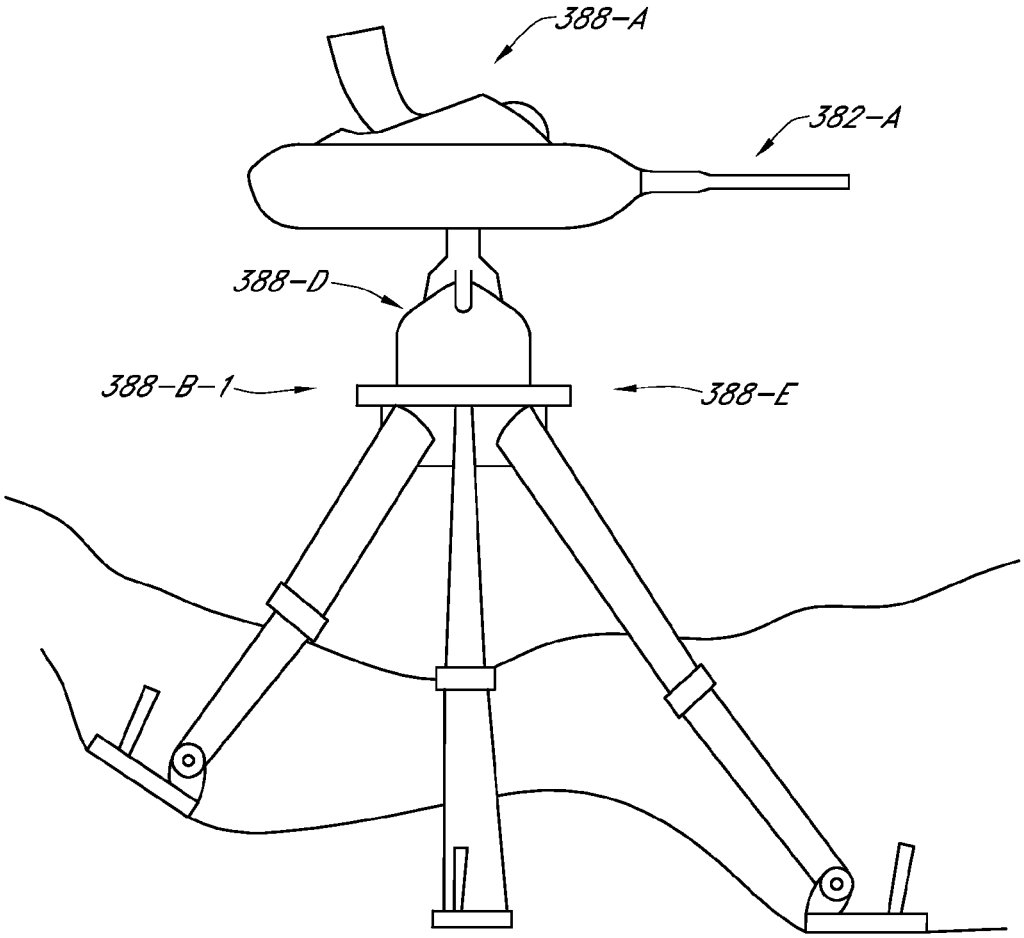
Figures 2, 13D:
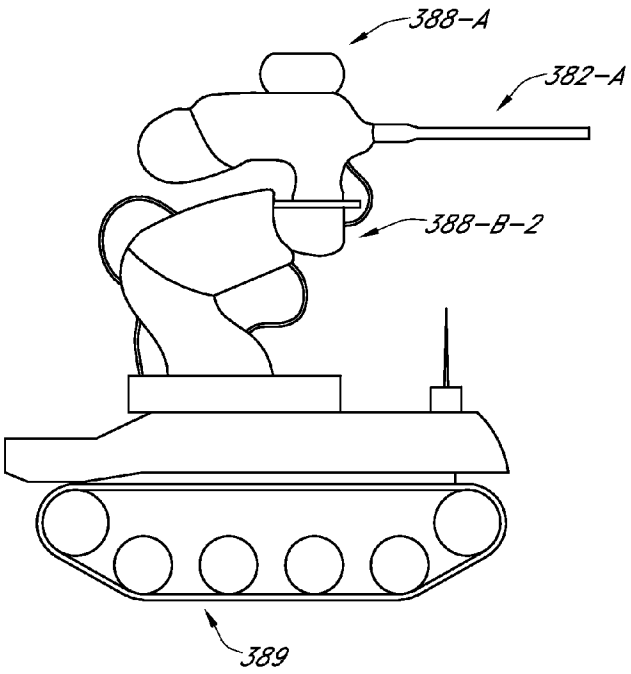
Figure 13E:
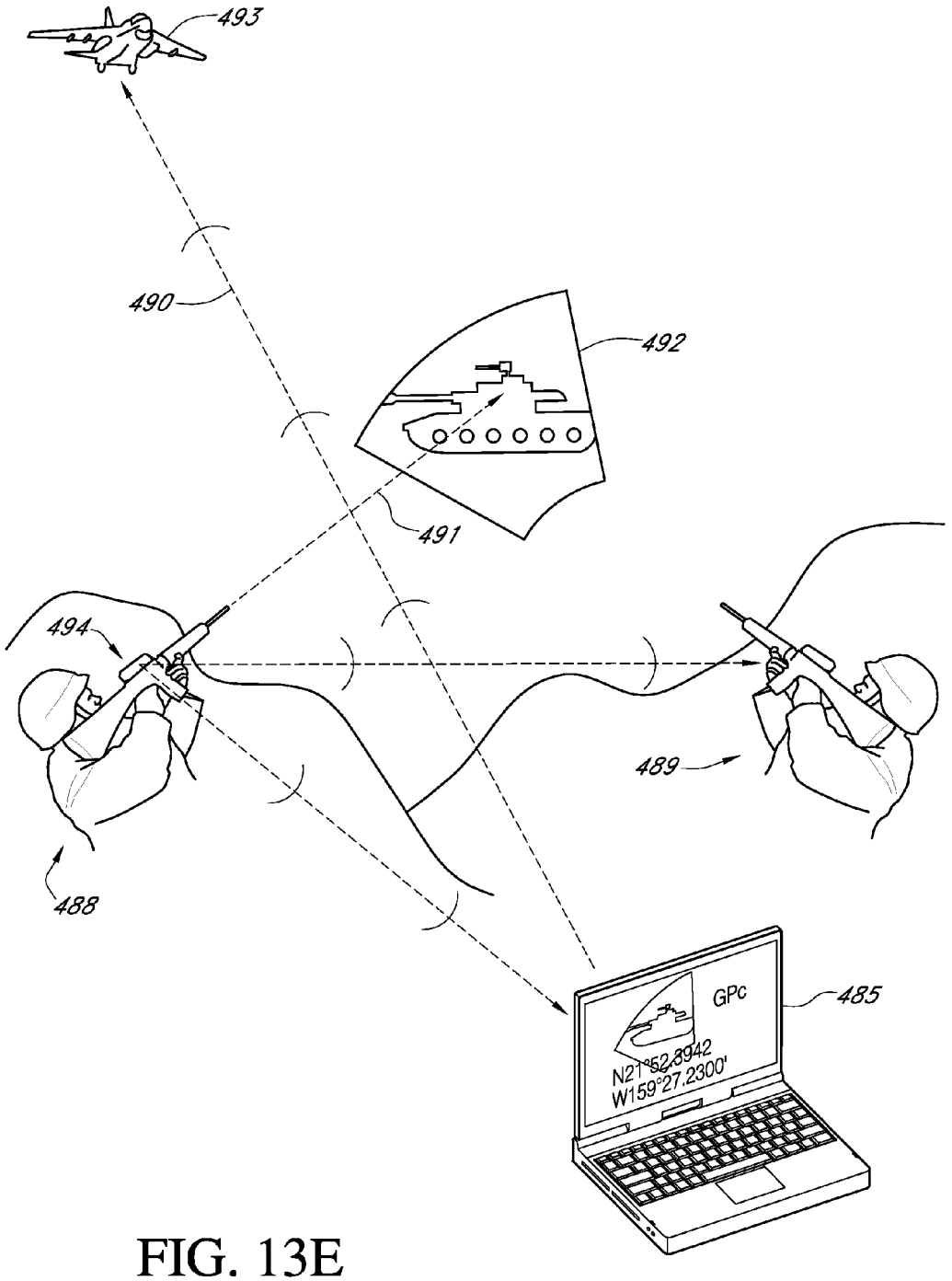
FIG. 13E illustrates the digital sighting system being operated in a combat situation; wherein the Confirmed Target Coordinate (CTC) of the enemy target can be precisely located by utilizing the combination of the sighting system's internal rangefinder, inclinometer, digital compass, and GPS device.

FIG. 13E illustrates the digital sighting system 494 being operated in a combat situation. The digital sighting system 494 can include a Ground Positioning System (GPS) device, a rangefinder and digital compass (refer to FIG. 14C-1). The GPS device aids fellow military, law enforcement and/or authorized personnel to locate and monitor the movement and activity of their fellow-comrades from a remote location. In addition, the combination of the GPS coordinate of the shooter 488 (FIG. 13E) relative to the compass bearing and target distance 491 from the shooter to the enemy target 492 can provide the digital information necessary in determining an accurate Ground Positioning Coordinate (GPC) of the enemy target 492. These digital parameters, when transmitted from the sighting system 494 to a central command center 485 and/or fellow comrades 489, can provide the necessary or desired digital information for central command 485 and/or fellow comrades 489 to determine the GPC of the enemy target 492. This determined GPC of the enemy target 492 can then be transmitted 490 from the central command 485 to other troops or mortar divisions on the ground or to allied air and artillery reinforcements 493.

In summary, FIG. 13E illustrates how the combination of the sighting system's rangefinder, GPS device and internal compass can allow authorized personnel to effectively locate the Ground Positioning Coordinate (GPC) of the enemy target from a remote location. Central command can then transmit this calculated GPC to additional troops or artillery reinforcements. The integrated sighting system 494 may be mounted to any hand-held, portable, and/or mobile weaponry without departing from the spirit of the present teachings. Examples of such portable weaponry include but are not limited to mortar launching devices, bazookas, canons etc.

In addition, the integrated sighting system depicted in FIG. 13E may be configured for operation using the un-manned GRA depicted in FIG. 13D without departing from the present teachings. The configuration of FIG. 13D can be set-up and operated in an un-manned fashion from a remote location. The combination of the GPS coordinate of the sighting system 494; distance, and bearing to the enemy target (relative to the GPS coordinate of the sighting system 494) can be obtained and transmitted by the unmanned sighting system 494 to the shooter and/or central command from a remote location. The coordinates of which can then be conveyed from the shooter and/or central command center to authorized individuals and/or deployment divisions.

It is noted that while the illustrations pertaining to the GPC locating feature of the sighting system is associated with a military combat application; the GPC locating feature can also be used in numerous other applications without departing from the present teachings. Examples of such applications include but are not limited to law enforcement swat teams, survey and/or scouting personnel, professional hunting guides, game wardens, and sporting enthusiasts.

Figure 13F:
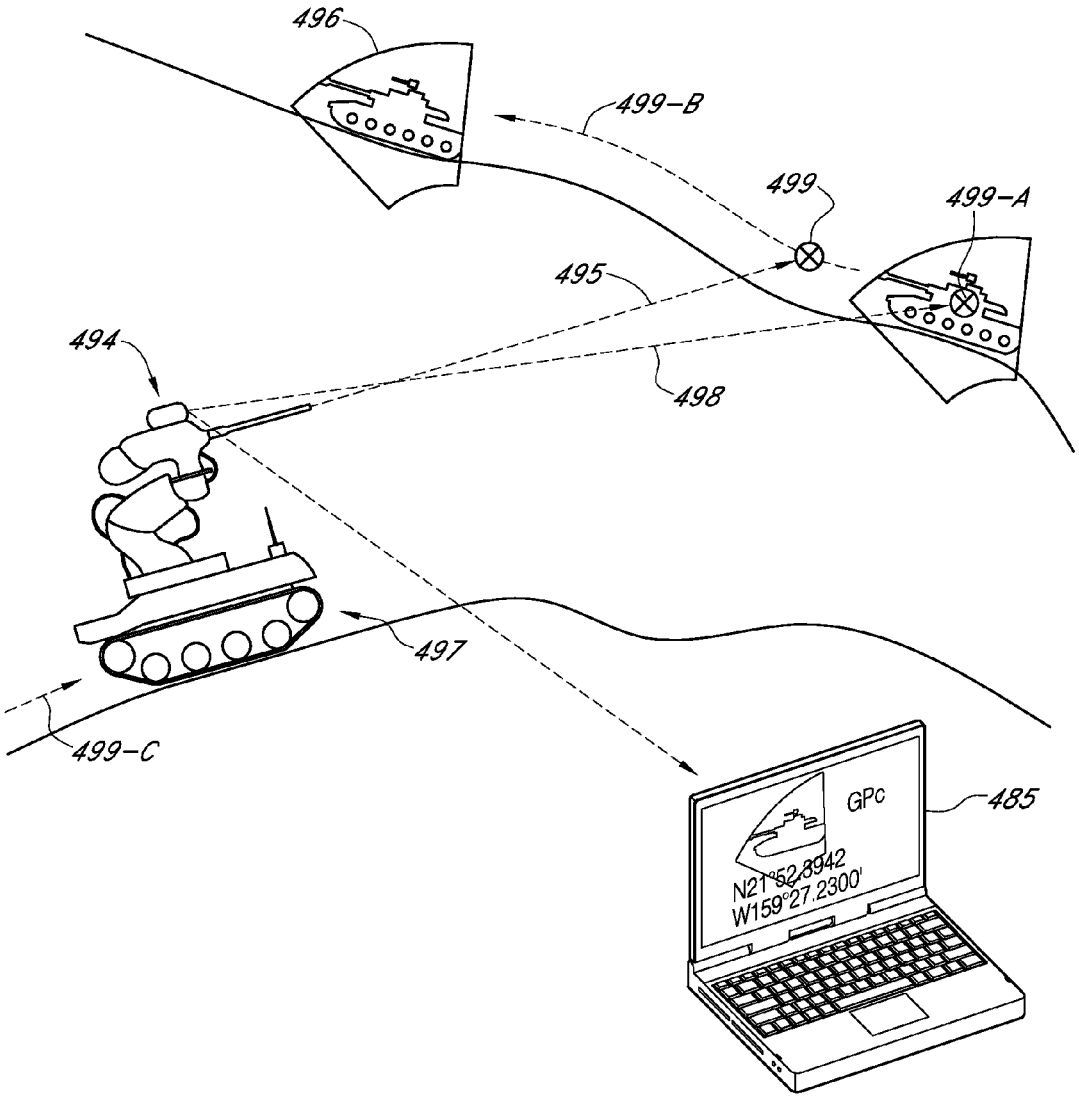
FIG. 13F illustrates the digital sighting system being operated in a combat situation against a moving target from a transport vehicle (TRV).

FIG. 13F illustrates a sighting system for a weapons system that operates on a novel principle that the POAC of the sighting system and the POAC of the weapon's barrel 495 can be synonymous and can be automatically adjusted (in real-time) to compensate for a moving target 496 (and/or stationary targets) from a TRV 497. This automatic adjustment of the barrel's POAC can be performed by re-calibrating the X, Y coordinate of the pre-recorded POI coordinate command 498 of the automatic sighting-system 494. This automatic barrel POAC adjustment function can integrate commercially available digital target-recognition system and/or speed-measuring (e.g., Doppler radar) technologies and interfaces it/them with the automatic sighting-system technologies of the present teachings. The digitally recognized moving target 496, as deciphered by the target recognition system and/or example Doppler device, becomes a 'locked-on' POAC of the moving target, and the POAC's corresponding pre-recorded POI coordinate command causes the POAC of the weapon's barrel 495 to automatically move-in-synch with the re-calibrated hold-over position of the X, Y coordinates of the anticipated POIC of the moving target 499. The re-calibrated hold-over coordinate 499 (relative to the anticipated POIC of the moving target 499-A) can be a function of the muzzle velocity of the projectile relative to the distance to the target and the traveling-speed 499-B of the recognized target and/or the traveling speed of the weapon's platform 499-C. The traveling speed of the moving target 499-B and/or weapon's platform 499-C can be automatically determined via the example Doppler radar device or calculated in real-time via the changing coordinates of GPS of the moving platform 497 relative to the confirmed target coordinate (CTC) of the moving target 496 (when taking into account the inertia of the moving platform if applicable). This re-calibrated POIC method of adjusting the barrel of a weapons system to a moving-target can be compatible with targets derived from night-vision and thermal-imaging technologies and can be observed and operated by a portable device 485 and/or central command station from a remote location.

Figure 14A:
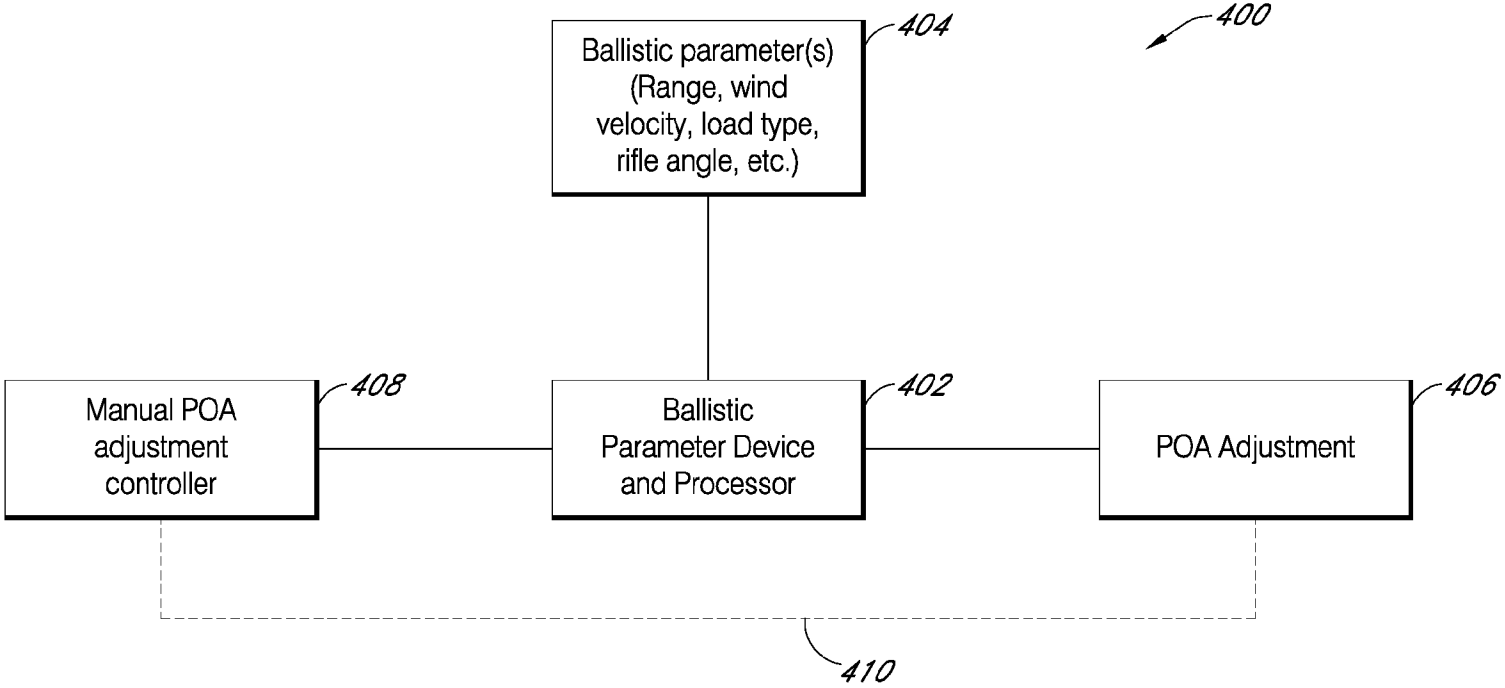
FIG. 14A illustrates a functional block diagram showing how the processor can be configured to integrate the ballistic parameter to induce adjustment of the point of aim with respect to the point of impact.

FIG. 14A illustrates a functional block diagram 400 showing integration of some various components of the integrated sighting system. The sighting system comprises a ballistic parameter device and processor 402 functionally coupled to a POA adjustment system 406 and an adjustment controller 408. In one embodiment, the adjustment controller 408 may optionally control the POA adjustment system 406 (as indicated by a dashed line 410) directly in a manner similar to that described above in reference to FIGS. 1-12.

The sighting system further comprises a ballistic parameter input 404 that inputs one or more parameters to the processor 402. Such ballistic parameters may include, but are not limited by, target range, wind velocity, ammunition type, or rifle's shooting angle. The ballistic parameter device and processor 402 determine a POA adjustment based on the input of the ballistic parameter(s). Some possible methods of determining the POA adjustment are described below in greater detail.

In general, it will be appreciated that the ballistic parameter device and processors comprise, by way of example, computers, program logic, or other substrate configurations representing data and instructions, which operate as described herein. In other embodiments, the processors can comprise controller circuitry, processor circuitry, processors, general purpose single-chip or multi-chip microprocessors, digital signal processors, embedded microprocessors, microcontrollers and the like.

Furthermore, it will be appreciated that in one embodiment, the program logic may advantageously be implemented as one or more components. The components may advantageously be configured to execute on one or more processors. The components include, but are not limited to, software or hardware components, modules such as software modules, object-oriented software components, class components and task components, processes methods, functions, attributes, procedures, subroutines, segments of program code, drivers, firmware, microcode, circuitry, data, databases, data structures, tables, arrays, and variables.

Figure 14B:
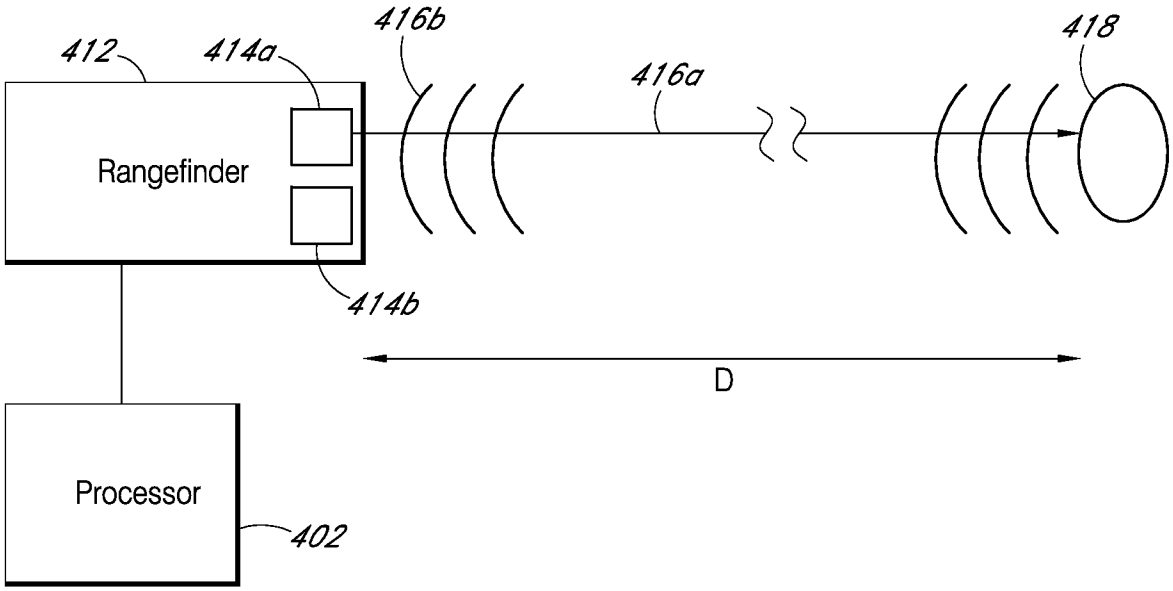
FIG. 14B illustrates simplified operating principles of a rangefinder that may be used in conjunction with the processor of FIG. 14A.
Figure 14C:
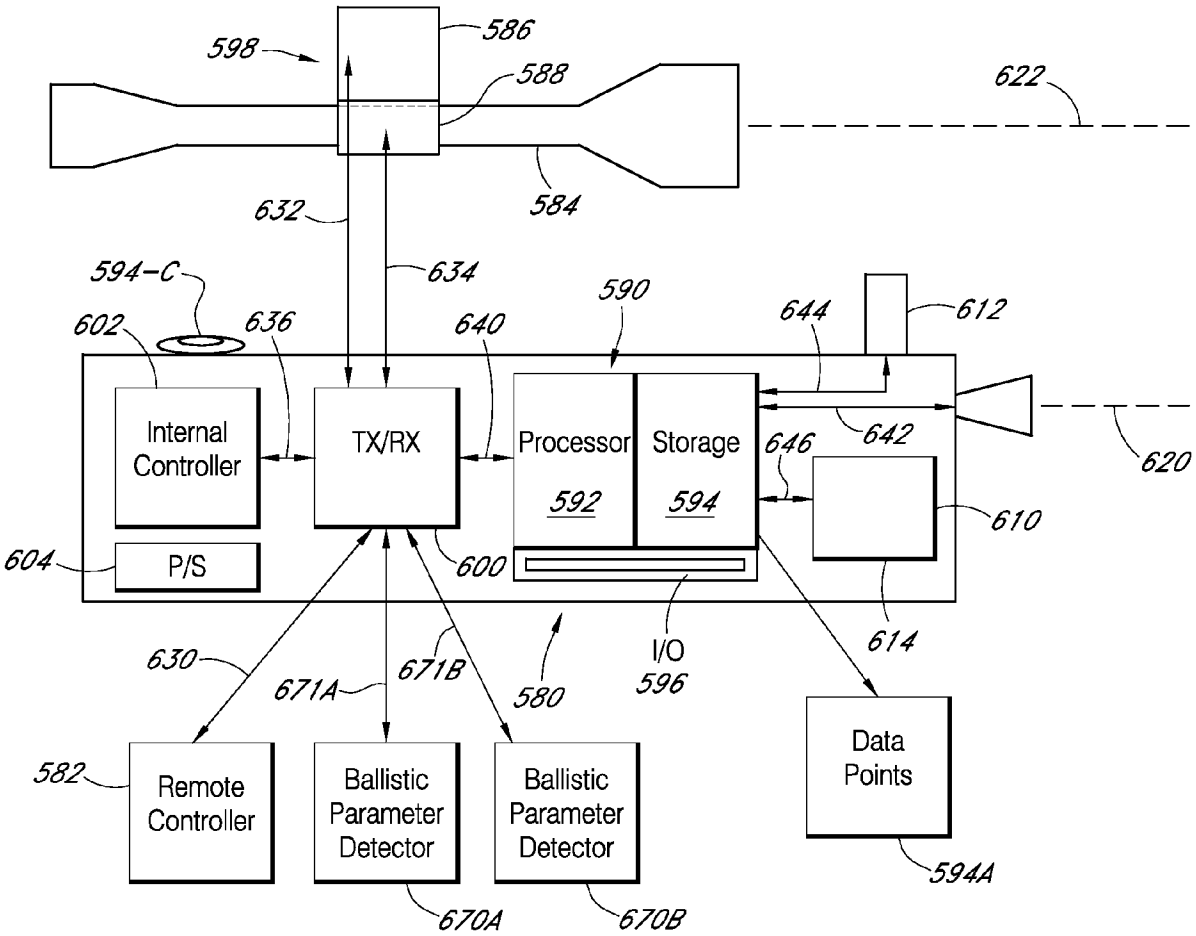
FIG. 14C illustrates a functional block diagram of one possible embodiment of the detached ballistic parameter device in relation to the sighting system's adjustment system and the various ballistic parameter detectors as illustrated in FIG. 13B.
Figures 1, 14C:
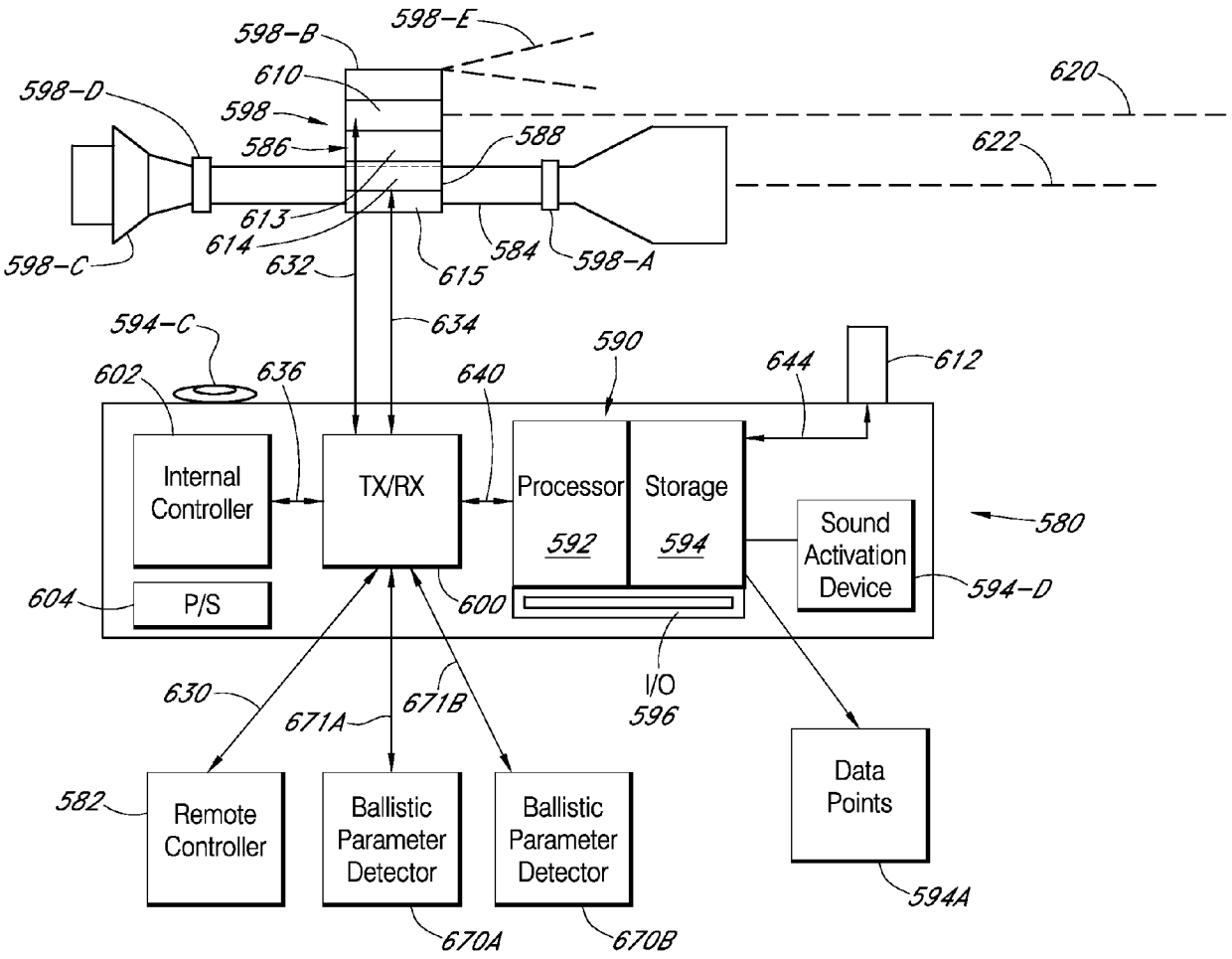
Figures 2, 14C:
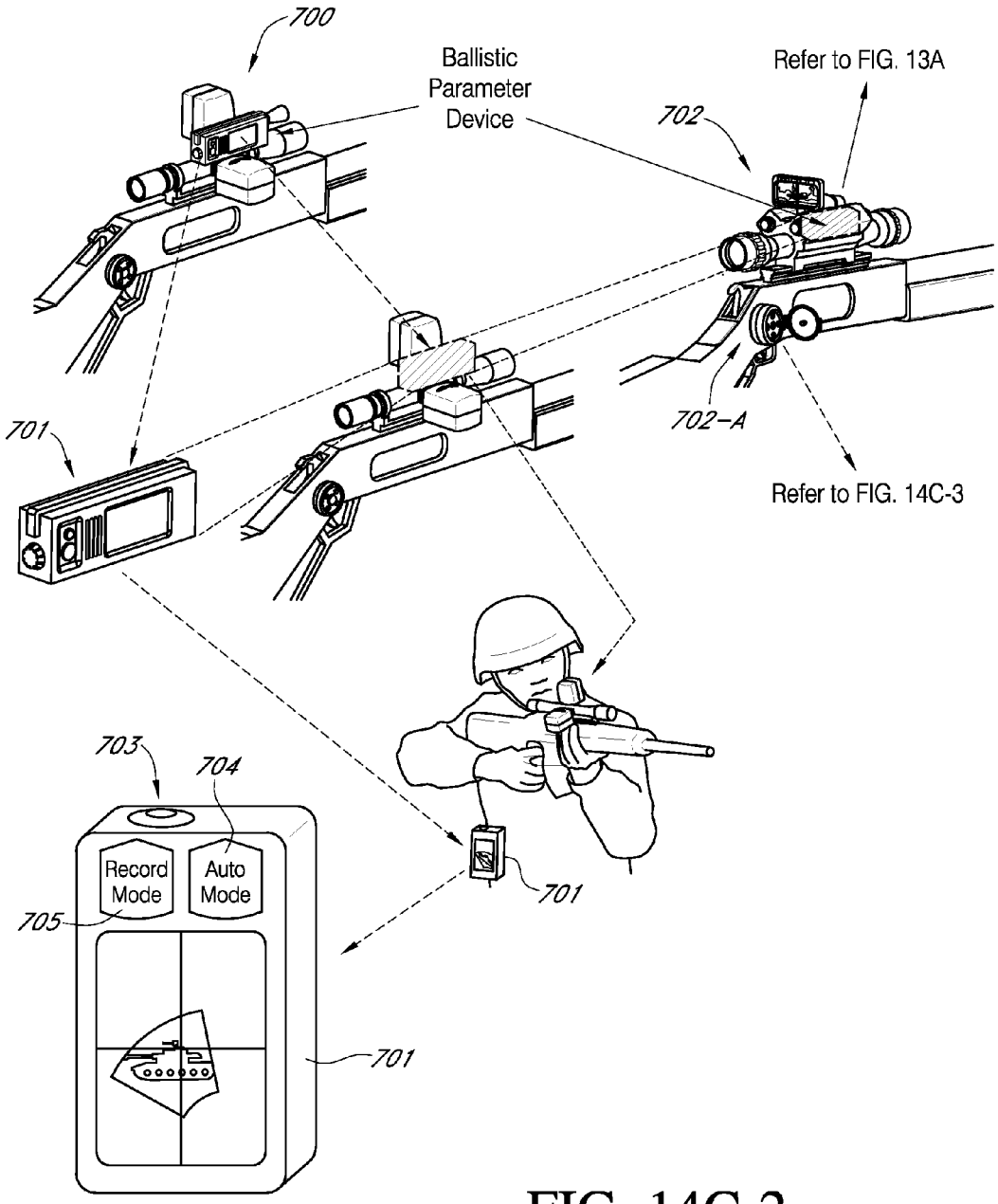
Figures 3, 14C:
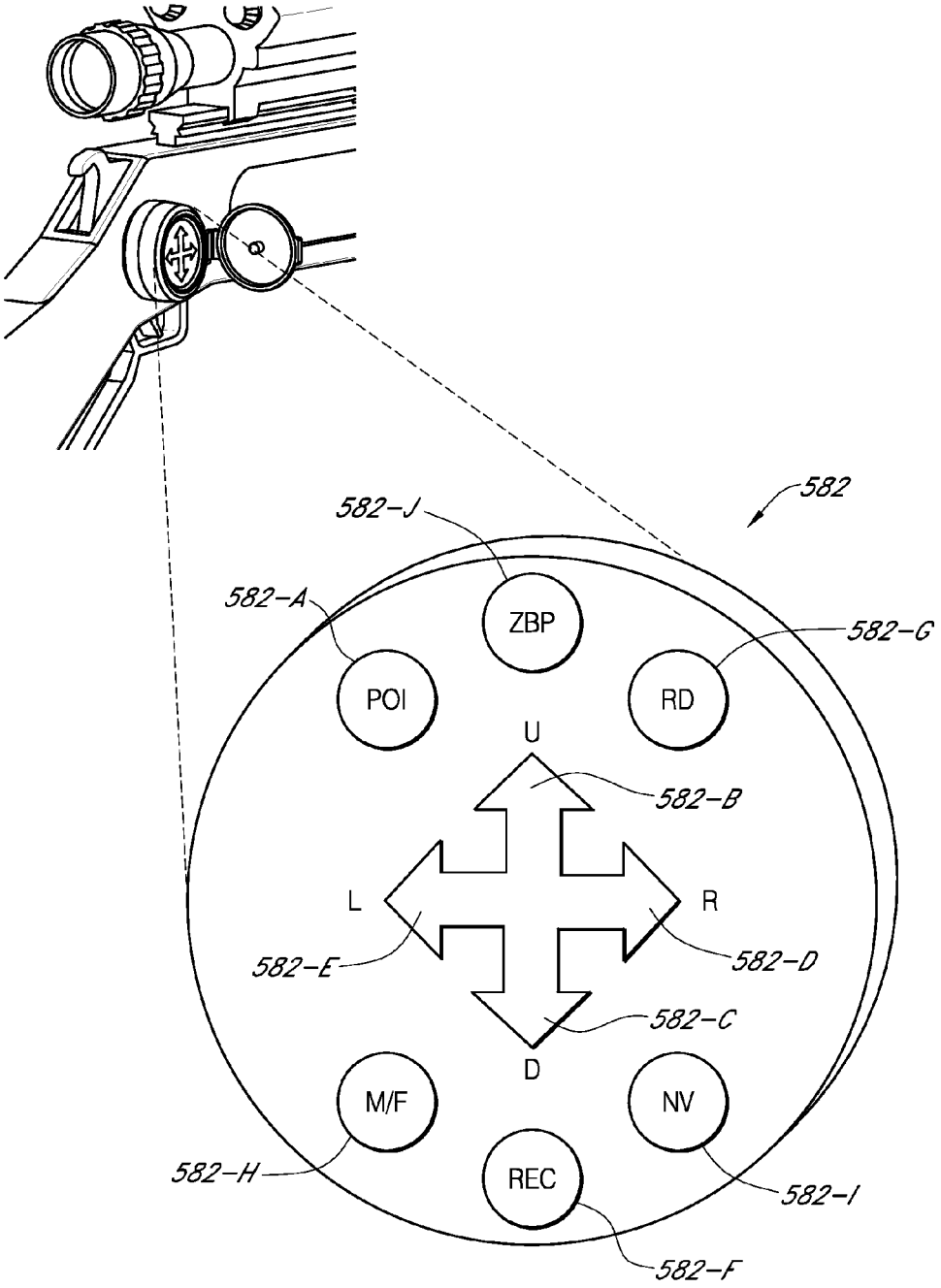

FIG. 14B illustrates a simplified operational principle of a rangefinder 412. The exemplary rangefinder 412 comprises a transmitter 414*a* that transmits a beam 416*a* of energy towards an object 418 whose range is being measured. The object 418 scatters the beam 416*a* into a scattered energy 416*b* and some of the scattered energy 416*b* may return to the rangefinder 412 so as to be detected by a detector 414*b* therein. By knowing the time that elapsed between the transmission of the beam 414*a* and the receipt of the scattered energy 416*b*, and the speed of the energy beam in the medium (air, for example), the rangefinder 412 can determine the distance D between it and the object 418. Such range information can then be transferred to the processor 402 to be used for the scope adjustment.

FIGS. 14C and 14C-1 illustrate two separate functional block diagrams of a ballistic parameter device 580 and its interaction with an adjustment mechanism 598 mounted to a scope 584. The device 580 may be a part of an integrated sighting system as previously described above in reference to FIG. 13A, an attached device of 13B, a detached device of 13C or any combination thereof. The difference between the block diagram of FIG. 14C and FIG. 14C-1 is that the block diagram of FIG. 14C pertains to a ballistic parameter device and adjustment mechanism combination that is either attached to the scope FIG. 13B (as in the case of retrofitting a scope) or integrated into the housing of the scope FIG. 13A (as in the case of a self-contained scope). FIG. 14C-1 on the other hand pertains to a ballistic parameter device 580 that can be physically detached from scope 584 and adjustment system 598 (refer to FIG. 13C). A purpose for the configuration of FIG. 13C can be that it allows the total overall weight and size of the scope to be reduced significantly due to the fact that the ballistic parameter device does not need to be incorporated into the scopes housing FIG. 13A nor does it need to be fully attached to the scope FIG. 13B. This smaller size and weight configuration of FIG. 13C may prove to be more beneficial in combat situations.

FIG. 14C-1 illustrates a block diagram of the detached ballistic parameter, device 580 and its interaction with the sighting system's built-in rangefinder 610, digital compass 613, inclinometer 614, GPS device 615, POAI to POIC adjustment system 598, a POA reference dot (POARD) adjustment mechanism 598-D, a night-vision adjustment system 598-A, a magnification and focus adjustment system 598-C, and an artificial light adjustment system 598-B having an adjustable projected beam of light 598-E, mounted on a scope 584. For the purpose of description herein, it will be understood that a dot such as the POARD can include a circular-shaped dot, as well as any shaped reference indicator.

The ballistic parameter device 580 (FIG. 14C) is depicted as having exemplary ballistic parameter detectors such as a rangefinder 610, a wind velocity and detector 612, and an inclinometer 614. It will be understood that these detectors are exemplary only, and in no way intended to limit the scope of the present teachings. A ballistic parameter device may have one or more of the aforementioned devices, one or more other ballistic parameter detecting devices not described above, or any combination thereof.

The exemplary rangefinder 610 may be configured to determine the range along a ranging axis 620. Preferably, the ranging axis 620 has a known orientation relative to an optical axis and compass bearing 622 of the scope 584.

The exemplary wind velocity and direction detector 612 may comprise a mechanically driven operating system (for example, a windmill-type device or a deflection device that responds to both the velocity and direction of the wind relative to the flight path and direction of the bullet), an electrical-based system (such as a pressure differential device), or any combination thereof (refer to FIG. 13C). In certain embodiments, such wind velocity and direction detector system may be configured to respond to both wind velocity and wind direction along the lateral direction with respect to the optical axis and its corresponding digital compass bearing 622.

The exemplary inclinometer 614 may comprise a commercially available device configured for use as described herein. Alternatively, the inclinometer 614 may simply comprise a means for inputting the shooting angle, determined either by an independent device or by an estimate.

FIGS. 14C and 14C-1 illustrate that the ballistic parameter device 580 may receive ballistic parameters from one or more other ballistic parameter detectors 670A and 670B. Though only two other ballistic parameter detectors are illustrated, the system may include any number of ballistic parameter detectors. Ballistic parameter detectors 670A and 670B may sense the various ballistic parameters from the scope position itself (as is the case with the rangefinder 620, inclinometer 614, and compass 613) or from a remote location (as is the case with the thermometer, altimeter, barometer, hygrometer, light meter, anemometer and vane) and then transmit the digital readings from these various sensors to the ballistic parameter device 580, one or more of temperature, altitude, air pressure, humidity, ambient light levels and wind velocity and wind direction, in a manner known in the art. It will also be understood that these detectors can be attached to the scope as depicted in FIGS. 13A and 13A-1, or detached from the ballistic parameter device and operated from a remote location, as depicted in FIGS. 13C, 13C-1, 25, and 26. The ballistic parameter device 580 is further depicted as having an exemplary transmitting and receiving (TX/RX) device 600. The ballistic parameter detectors 670A and 670B may provide detected ballistic parameters to the ballistic parameter device 580 via the TX/RX device 600 using links 671A and 671B, which may be wired or wireless links. In some embodiments, ballistic parameter detectors 670A and 670B may be integrated into the ballistic parameter device 580 or the scope 584.

The ballistic parameter device 580 of FIGS. 14C and 14C-1 are further depicted as having an exemplary computing device 590. The computing device 590 is depicted as including a processor 592, a storage device 594, stimulus-activated digital information capturing device 594-B, a power on/off button 594-C and an input/output (I/O) device 596. The computing device 590 is shown to receive ballistic parameters from such sensors as the wind velocity and wind direction detector 612 (via line 644); the slope via the sighting system's inclinometer 614, and compass bearing information via the digital compass 613, as depicted by line 632; and the transmissions of such parameters as ambient light, temperature, humidity, barometric pressure, altitude etc., as depicted as lines 671A and 671B. The ballistic parameter input(s) from such exemplary detectors may be processed by the processor 592 to determine the POA adjustment as described herein. The storage 594 may be configured to capture the detector information 612, 632, 670-A, 670-B, at the moment that the projectile is launched (example, at the moment a bullet is fired). This snapshot of digital parameter information is captured, at or near the moment the projectile is launched, via the stimulus-activation device 594-B. The storage 594 of the snapshot of captured information (via 594-B) may also be configured to capture the detector information and/or manual adjustments made via the various command buttons located on the remote controller 582.

For example purposes, say the snapshot of the tabulated set of parameters (SOP) captured at the moment of stimulus activation includes: 475 yards to target; wind speed 26 mph; wind direction N25 degrees W; bullet bearing S15 degrees W. The resultant SOP captured is relative to the actual POI Coordinate (POIC) which is relative to a Zero-Baseline point of Impact Coordinate ($POIC_{ZB}$); wherein SOP=POAC=POIC (or substantially equal to each other). Thus, the SOP, when captured, recorded and stored relative to a POAC to POIC adjustment command), can later be automatically retrieved, for comparative purposes, when the automatic operating feature of the sighting system attempts to accurately determine an accurate POAC to POIC adjustment command relative to a similar set of ballistic parameters that may be encountered in the field at a future time.

Using the above example of tabulated parameter readings of 475 yards distance, 26 mph wind speed, wind direction of N25 degrees W, and bullet bearing of S15 degrees W; the resultant Point of Impact Coordinate (POIC) adjustment, from the $POIC_{ZB}$ of '$X_0$, $Y_0$' is 'X-23, Y+15'. In other words, the automatic POI adjustment needed to be performed for this particular SOP can include a horizontal adjustment of the sighting system's windage adjustment mechanism of 23 units to the left of the Zero Baseline Point of Impact Coordinate ($POIC_{ZB}$) and a vertical adjustment of 15 units up from the $POIC_{ZB}$ of '$X_0$, $Y_0$'. The definition of "units" in this particular example is for descriptive purposes only and does not necessarily pertain to or require use of any particular type of unit. Once the SOP relative to its POIC adjustment command is recorded, this new point of impact coordinate (POIC) essentially allows the automatic sighting system to become pre-recorded to this particular combination of SOP and its corresponding POIC adjustment command. This pre-recorded correlation of POIC unit adjustments made relative to the SOP can become a digital adjustment command that can be automatically implemented for future POAC to POIC adjustment in the event the shooter is faced with a similar set of parameters in the field. This same method of capturing, recording and implementing these SOP-to-POIC coordinate commands can be recorded for an indefinite number of secondary POICs, each of which is directly correlated to its own unique SOP.

Once these SOPs and their corresponding POIC adjustment commands, as well as the preferred field of view settings for magnification, focus, night vision etc. are performed and recorded, they can be stored in memory 594 and/or on an I/O device 596 (i.e. SD card). The storage 594 and/or I/O device may store a plurality of these POI-to-parameter specific data points. Each data point may indicate a desired POAI adjustment command, relative to a SOP, such that the automatic adjustment command for the point of aim indicator substantially coincides with the POIC relative to the SOP at hand.

The I/O device 596 may allow a user to either input information into the computing device 590, or output information from the computing device 590. Such device may comprise a drive adapted to receive a memory storage device such as a magnetic disk device, scan disk (SD) card, micro SD card, flash drive stick, blue tooth or a memory card. Alternatively, the I/O device may comprise a port adapted to allow the computing device to communicate with an external computer, for example via wireless link, blue tooth, or cable. One possible use of the I/O comprises transferring of a ballistic table for a given ammunition type from the external computer. The use of ballistic tables is described below in greater detail.

The TX/RX device 600 may receive a signal representative of a POA adjustment determined and sent (via line 640) by the computing device 590. The device 600 may then transmit the adjustment signal to the adjustment system 598. The adjustment system 598 is depicted as comprising an exemplary elevation adjustment mechanism 586 and an exemplary windage adjustment mechanism 588. Line 632 denotes a link (wire-based or wireless) between the TX/RX device 600 and the elevation adjustment mechanism 586, and line 634 denotes a link between the device 600 and the windage adjustment mechanism 588. It will be appreciated that the adjustment system 598 may comprise either of the elevation 586 or the windage adjustment mechanism 588 alone, or together as shown, without departing from the spirit of the present teachings.

The ballistic parameter device 580 is further depicted as having an exemplary built-in control unit 602. Such unit may be configured to allow a user to manually send a POA adjustment signal to the adjustment system 598 via the TX/RX device 600 (as shown by line 636). The built-in control unit 602 may also be configured to allow the user to manipulate the various functions of the ballistic parameter device 580 via a remote controller 582, or hand held devices and/or central command station(s), as illustrated in FIGS. 13C-1, 13-D, 13-E.

Alternatively, the functionality of the built-in control unit 602 may be replaced, supplemented, or duplicated by a remote controller 582, and/or a hand held device 484-B (FIG. 13C-1), and/or a laptop computer 484 (FIG. 13C-1), and/or central command center(s) 484-A (FIG. 13C-1). The remote controller 582 may be similar to the other controllers described herein (for example, 570 in FIG. 13B, 570A in FIGS. 13C, and 13C-1, and 582 in FIG. 14C-1, 702-A in FIG. 14C-2, and 582 in FIG. 14C-3), and may be configured to be linked to the TX/RX device 600 of the ballistic parameter device 580 (as shown by line 630, either wire-based or wireless). The remote controller 582, and/or, hand held device and/or command center FIGS. 13C-1, 13-D, 13-E may be configured to allow manual control of the adjustment system 598 via the TX/RX device 600. The remote controller 582 may also be configured to allow the user to manipulate the various functions of the ballistic parameter device 580 (as illustrated in FIG. 14C-3).

In FIG. 14C-3 the remote controller 582 can be configured to allow the user to manipulate one or more functions of the ballistic parameter device 580 (FIG. 14C-1). These same functions can also be operated from a hand held device and/or central command center as illustrated in FIGS. 13C-1, 13-D, 13-E and 14C-2 without departing from the present teachings. Examples of such functions that can be performed include the following:

1. Control, operation and record activation of the POAI for making the POAC-to-POIC adjustment 582-A:
   a. Depressing the POI (Point of Impact) button 582-A engages the POAI adjustment mechanism 598 (FIG. 14C-1), in the scope 584 (FIG. 14C-1). Once the PAOI adjustment mechanism 598 (FIG. 14C-1) is engaged, the POAI can be adjusted (refer to FIG. 14C-3), either vertically up or down 582-B, 582-C, or horizontally left or right 582-D, 582-E.
   b. The POAI can be adjusted vertically upward by depressing the "U" (Up) arrow key 582-B. The POAI can be adjusted vertically downward by depressing the "D" (Down) arrow key 582-C.
   c. The POAI can be adjusted horizontally to the right by depressing the "R" (Right) arrow key 582-D. The POAI can be adjusted horizontally to the left by depressing the "L" (Left) arrow key 582-E.
   d. Once the proper POA to POI adjustment is made, this new digital POI coordinate (POIC) can then be recorded by depressing the REC (record) button 582-F. It is noted that if the POA to POI adjustment being performed and recorded is the very first POI coordinate (POIC) to be recorded onto the ammunition-specific I/O device 596 (FIG. 14C-1), this first recorded POIC can be a zero-baseline point of impact coordinate ($POIC_{ZB}$). When recorded, the $POIC_{ZB}$ becomes the zero baseline from which some or all secondary POI coordinates (POICs) are founded upon. Unlike the secondary POICs, the $POIC_{ZB}$ can be recorded by pressing the ZBP button 582-J on the remote control transmitter 582. Pressing the ZBP button 582-J, the sighting system's ballistic parameter device 582 (FIG. 14C-1) recognizes and establishes this particular POI coordinate as being the zero baseline point of impact coordinates ($POIC_{ZB}$). The shooting parameter device 580 (FIG. 14C-1), recognizes the $POIC_{ZB}$ as having a digital horizontal (x) coordinate of "0" (zero) and a digital vertical (y) coordinate of "0" (zero). The $POIC_{ZB}$ has the "x, y" coordinate of "0, 0". The $POIC_{ZB}$ of 0, 0 becomes a reference point from which some or all secondary POI adjustments are digitally tracked and measured from. Methods and step-by-step procedures of how each of the above push-button functions is operated are presented later.

2. Control and operation of the POA Reference Dot (POARD):
   a. Depressing the "RP" (Reference Dot) button 582-G engages the POA reference dot adjustment mechanism 598-D (FIG. 14C-1). Once the reference dot adjustment mechanism 598-D is engaged, the reference dot 1026-A (FIG. 23-A) can then be adjusted either vertically or horizontally via the remote controller 582.
   b. The reference dot can be adjusted vertically upward by depressing the "U" (Up) arrow key 582-B. The reference dot can be adjusted vertically downward by depressing the "D" (Down) arrow key 582-C.
   c. The reference dot can be adjusted horizontally to the right by depressing the "R" (Right) arrow key 582-D. The reference dot can be adjusted horizontally to the left by depressing the "L" (Left) arrow key 582-E.
   d. Methods and step-by-step procedures of how each of the above functions are operated and recorded are presented later.
3. Control, operation and record activation of magnification and focus setting:
   a. Depressing the "NV" (Night-Vision) button 582-I engages the night-vision adjustment mechanism. Once the Night-Vision adjustment mechanism is engaged, the shooter can then control the preferred amount of ambient light allowed to enter the sighting system's night-vision aperture opening. The preferred aperture opening can vary with target distance, ambient light conditions and magnification settings.
   b. The aperture opening can be "Opened-Up" by depressing the "U" (Up) arrow key 582-B. The aperture opening can be "Closed-Down" by depressing the "D" (Down) arrow key 582-C.
   c. Once the preferred night-vision setting is made for each particular shooting distance/light/magnification combination, the digital adjustment setting can then be recorded by depressing the "REC" (record) button 582-F.
   d. Methods and step-by-step procedures of how each of the above functions are operated and recorded are presented later.
4. Control, operation and record activation of the artificial light feature of the night-vision setting:
   a. It is noted that while references made to the night-vision adjustment system refers to adjustments and recordings made with respect to ambient light entering the aperture opening, such adjustments and recordings can also be made to other forms of light without departing from the present teachings. Examples of other light forms may include but are not limited to infra-red light, green light etc. Sources of these various light forms may be artificial in origin and may originate from a separate light-emitting device that is incorporated into the night-vision assembly and configured to be wirelessly controlled from the remote controller 582-I without departing from the present teachings. Such artificial light-emitting devices can be adjusted in intensity so as to augment the availability of natural ambient light or lack of the same. The ability to manipulate and control the amount and intensity of artificial light on the intended target may be necessary when producing and recording a preferred night-vision setting. For example, some shooting environments, such as overcast nights, may not have enough ambient light available for the night vision device to illuminate the target satisfactorily. In cases such as this, the artificial light may be needed for obtaining a clear view of the target. The sources of artificial light and the adjustment of the intensity of the same may also be controlled via wireless remote control, and recorded in unison with the preferred aperture opening adjustment setting as previously described. The artificial light adjustment and recording feature is activated and adjusted in unison with the aperture opening device.
   b. Depressing the "NV" (Night-Vision) button 582-I engages the artificial light adjustment mechanism. Once the Night-Vision adjustment mechanism is engaged, the shooter can then control the preferred amount of artificial light allowed to enter the sighting system's night-vision aperture opening. The preferred aperture opening can vary with target distance, ambient light conditions and magnification settings.
   c. The artificial light can be turned-on by depressing the "R" (Right) arrow key 582-D. The amount of light intensity can be increased by keeping 582-D depressed until the desired light level is obtained. The intensity of artificial light can be decreased by depressing the "L" (Left) arrow key 582-E. Keeping the "L" (Left) arrow key depressed will turn-off the artificial light.
   d. Once the preferred night-vision setting is made for each particular shooting distance, magnification and preferred light combination, the digital adjustment parameters for the artificial light setting can then be recorded by depressing the "REC" (record) button 582-F.

The ballistic parameter device 580 is further depicted as having an exemplary power supply 604. In certain embodiments, the power supply 604 comprises a battery (or batteries) which may have recharging capabilities. Such recharging capabilities may be utilized by plugging a commercially available ac/dc transformer power adapter "plug" into a receptacle of the power supply 604.

Figures 4, 14C:
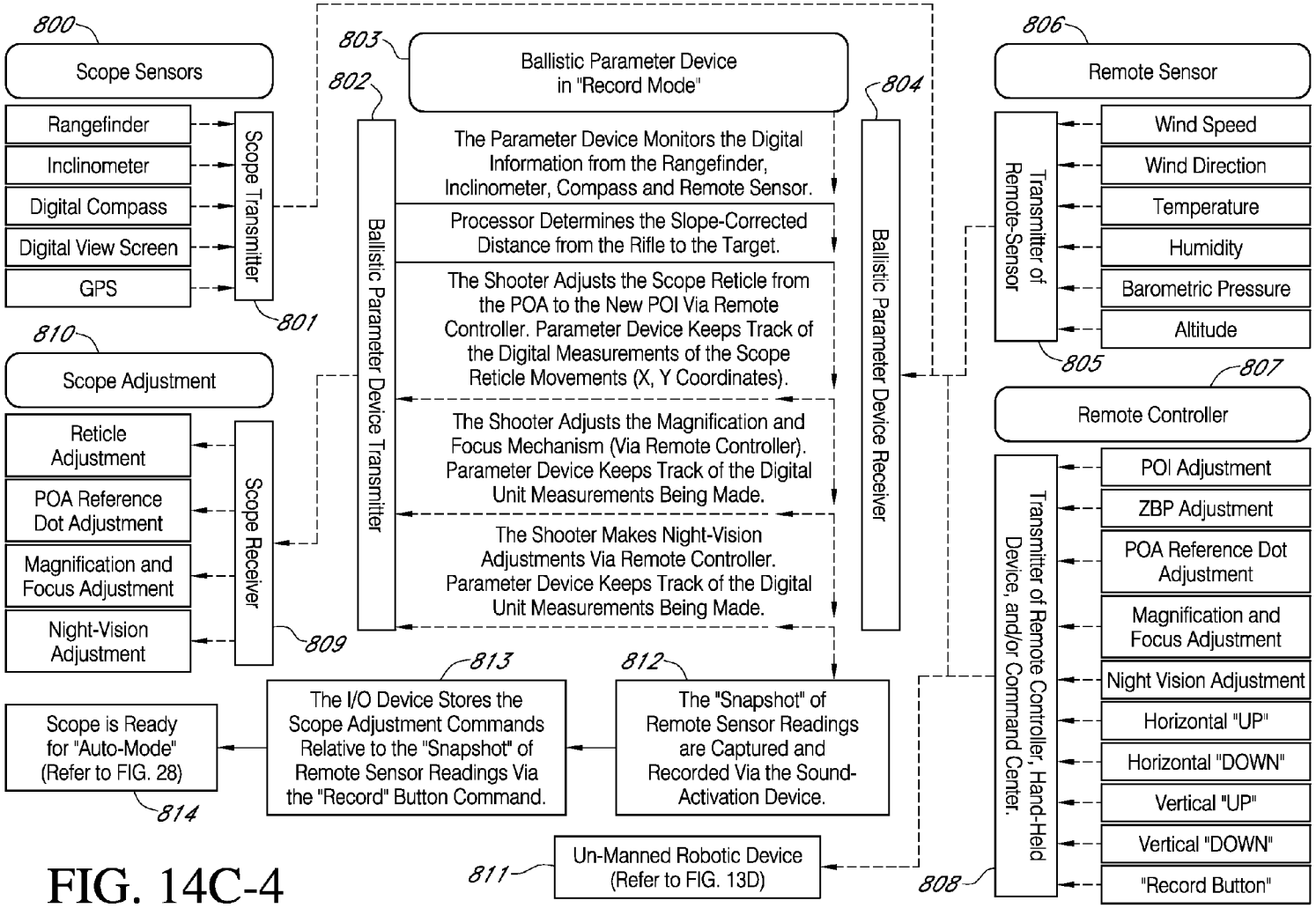
Figures 5, 14C:
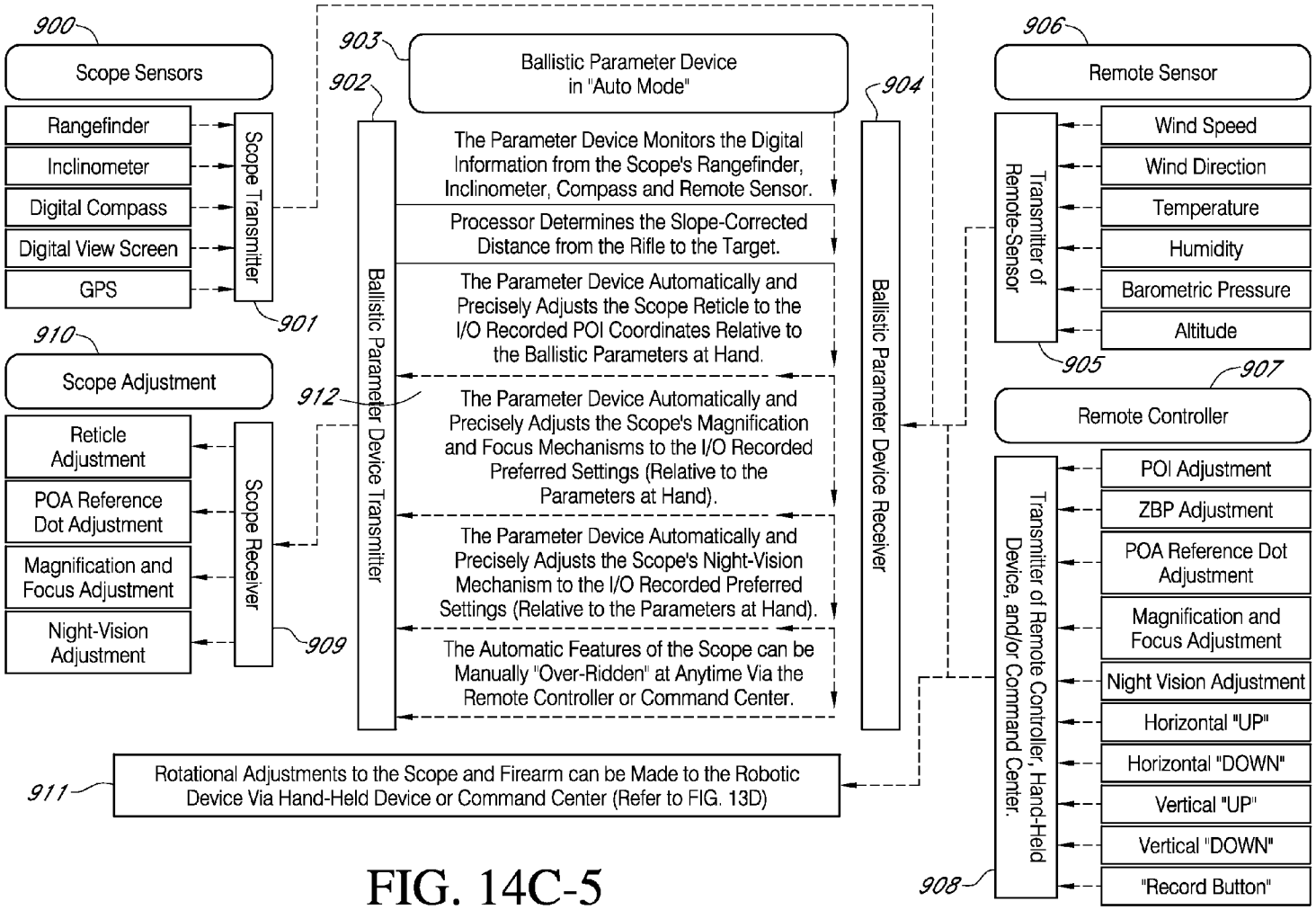

FIG. 14C-4 illustrates a block diagram that summarizes how the sighting system can operate in Record Mode as well as the method used to adjust, record, and save the sighting system's various settings relative to the sensed ballistic parameters at hand. While in Record Mode, the ballistic parameter device 803 monitors the digital ballistic parameter information (e.g., yardage, slope, wind etc.) that is being streamed (e.g., in real time) from the scope sensors 800 and the remote sensor 806. While this information is being streamed from the transmitter 801 of the scope sensor 800, and the transmitter 805 of the remote sensor 806; the receiver 804 of the ballistic parameter device 803 can receive this digital information and monitors it in real time.

During the time that the ballistic parameter device 803 is monitoring the ballistic parameter information from the scope sensor 800 and the remote sensor 805, the shooter can take aim (POA) at his intended target and then fire a shot. The sound of the shot being fired activates the stimulus-activation device (in this example a sound activation device 812) which in turn captures a snapshot of the digital ballistic parameter information that was being streamed from the sensors 900, 906 to the ballistic parameter device 903 at or near the moment the shot was fired. In other words, this captured snapshot of information becomes a recorded tabulation of the ballistic parameters that the projectile was subjected to at the moment it left the projectile launching device and traveled in route to the POA. Once the shot is made and the ballistic parameter information is captured 812, the shooter can then proceed to adjust the POAI from the POAC to the POIC. This is performed by first pressing either the ZBP button on the remote controller 807 (if it is the first POIC being recorded), or the POI button if it is a secondary POIC being recorded. In either situation, once the appropriate button is activated, the shooter then proceeds to make the POIC adjustment by keeping the point of aim reference dot (POAD) (FIGS. 23-A and 24A-24D) on the POAC while moving the POAI to the POIC.

The point of aim indicator (POAI) adjustment mechanism 810 can be adjusted by the remote controller 807 via the relayed signals sent from ballistic parameter device 803 to the POAI adjustment mechanism 810. The digital commands of the remote controller 807 are transmitted by its transmitter 808. The digital signal transmissions of the transmitter 808 can be first received by the receiver 804 of the ballistic parameter device 803. The ballistic parameter device 803 can automatically monitor and simultaneously relay these remote controller signals (adjustment commands), via its transmitter 802, to the sighting system's receiver 809 and adjustment mechanism 810. The scope adjustment mechanism 810 responds to these remote controller adjustment commands by moving the POAI adjustment mechanism 810 to the X and Y coordinates of the POIC as determined and adjusted by the shooter (via the remote controller 807).

Once the POIC adjustment is made, the shooter can then proceed to record the POIC adjustment, relative to the ballistic parameters of the POA, by pressing the Record button on the remote controller 807. Once the Record button is pressed, the horizontal and vertical movements of the POAI, relative to the original zero-baseline point of impact coordinate, can be recorded. The ballistic parameters that were captured at or near the moment of sound activation, can also be recorded when the Record button is pressed. In other words, once the Record button is pressed, the POIC and its corresponding tabulated set of parameters (SOP) can be recorded by the ballistic parameter device 803, each of which are stored on the I/O device 813 (for example, SD card).

In addition to the POAC to POIC adjustments, the shooter can also choose to make preferred visual adjustments to the sighting system's zoom-magnification (ZM), auto-focus (AF), night-vision (NV), infra-red (IR) and/or thermal-imaging (TI) settings. The digital adjustments of these visual settings can be activated by first pressing the appropriate button(s) of the remote controller 807. The digital commands made to these preferred visual settings, as performed by the shooter via the remote controller 807, can also be monitored by the ballistic parameter device 803 and then simultaneously transmitted 802 (relayed) to the receiver 809 of scope adjustment mechanism 810. Once the shooter makes the preferred visual adjustments to the scope, these preferred settings can also be recorded (relative to the POIC and tabulated set of ballistic parameters) when the Record button is pressed.

Once the POIC adjustment and preferred visual setting adjustments (relative to the tabulated set of ballistic parameters for the POIC) are recorded and stored on the I/O device 813, the shooter can then proceed to repeat this adjustment and recording method on as many additional POIC and preferred visual settings as he wishes (from any number of ballistic parameter combinations as he chooses). Once several of these variable POICs are recorded onto the I/O, the shooter can then proceed to operate the scope in Auto-Mode 814.

FIG. 14C-5 illustrates a block diagram that summarizes how the sighting system can operate in Auto-Mode as well as a method of how automatic adjustment(s) can be made relative to the ballistic parameters at hand. While in Auto-Mode, the ballistic parameter device 903 monitors the digital ballistic parameter information (e.g., yardage, slope, wind etc.) that is being streamed from the transmitter 901 of the scope sensor 900 and the transmitter 905 of the remote sensor 906. This tabulated set of digital information is streamed from these sensors 900, 906 (in real time) to the ballistic parameter device 903. This streamed information is received by the receiver 904 of the ballistic parameter device 903. The ballistic parameter device 903 can automatically correlate this sensed ballistic parameter information, with the ballistic parameter information that was previously recorded and stored onto the I/O device 912. Based upon the sensed ballistic parameter information received (relative to the pre-recorded ballistic parameter information stored on the I/O device), the ballistic parameter device 903 then automatically determines the proper POIC adjustment to be made to the scope adjustment mechanism 910. The proper POIC adjustment can then be transmitted 902 from the ballistic parameter device 903 to the receiver 909 of the scope adjustment mechanism 910. Based upon the digital POIC information transmitted 902 and received 909, the scope adjustment mechanism 910 automatically adjusts the point of aim indicator (POAI) (relative to the ballistic parameters at hand) to the proper ballistic parameter determined and transmitted POIC coordinate. The projectile launching device is now ready to shoot. The shooter simply places the POAI on the target and pulls or otherwise activates the trigger.

FIG. 14D illustrates one embodiment of a record 594A of a plurality of empirical data points 696A-D, including a position of a POAI and associated set of parameters (SOP) that may be stored in the storage 594. It will be appreciated that the record may store any number of data points, and the four data points 696A-D shown are presented for purposes of illustration rather than limitation. Though a table is shown in FIG. 14D, the empirical data points 696A-D may be stored in any format known in the art, including spreadsheet software and relational databases. The illustrated record illustrates the position of the POAI by an X offset 694A and a Y offset 694B, though other embodiments may indicate the position with other formats known in the art. The data points 696A-D also include one or more ballistic parameters associated with the position of the POAI, including, for example, range data 694C, wind data 694D, bullet data 694E, atmosphere data 694F, slope data 694G, and altitude data 694H. Wind data may indicate wind speed and direction along one or more axes relative to the projectile launching device, such as the x axis, y axis, and z axis. Projectile data may indicate the weight, size, frictional coefficient, powder load, and any other dimension or property of a projectile. Atmosphere data may indicate any information about the atmosphere, including humidity, temperature, and air pressure.

The processor 592 may access the stored empirical data points 696A-D in the record 594A to determine a POA adjustment for new sensed ballistic parameters received from one of more of ballistic parameter detectors 670A and 670B, rangefinder 610, wind velocity detector 612, and/or the inclinometer 614. The processor may first determine if the ballistic parameters corresponding to the stored data points 696A-D are substantially identical to the new sensed parameters. For example, if a new sensed parameter is a range of 250 meters, the processor may access the record 594A to determine if any data point 696A-D corresponds to a substantially identical range. The processor may then determine that data point 696D has a range that is substantially identical with the new sensed parameter, and may then use part or all of the corresponding POAC adjustment information to determine a POAI adjustment. For example, the processor may use the Y offset of −0.5 MOA as the POAC adjustment in response to receiving the new sensed parameter of the range of 250 meters.

The processor may also interpolate the POAC adjustment from the data points 696A-D. For example, if the processor receives new sensed parameters including a range of 296 meters and a 7 mph crosswind on the x-axis, the processor may determine that no data point 696A-D has ballistic parameters that are substantially identical to the new sensed parameters. The processor may then use some of all of the data points 696A-D to interpolate the POAC adjustment information for the new sensed parameters. The processor may interpolate the data by developing a ballistic equation for one or more of the ballistic parameters that models the effect of the one or more ballistic parameters on the trajectory of a projectile, for example a ballistic curve (described below). It will be appreciated that a greater number of empirical data points can increase the accuracy of the POAC adjustment, both by increasing the likelihood that new sensed parameters will be identical or close to stored parameters and by increasing the accuracy of the interpolation. The processor may use a combination of using adjustment information from data points that have parameters that are substantially identical to new sensed parameters and interpolation of other parameters. For example, the processor may determine a Y adjustment by determining a data point has a substantially identical range and then using the corresponding Y offset information and may determine an X adjustment by interpolating wind information from a plurality of data points.

Figure 15A:
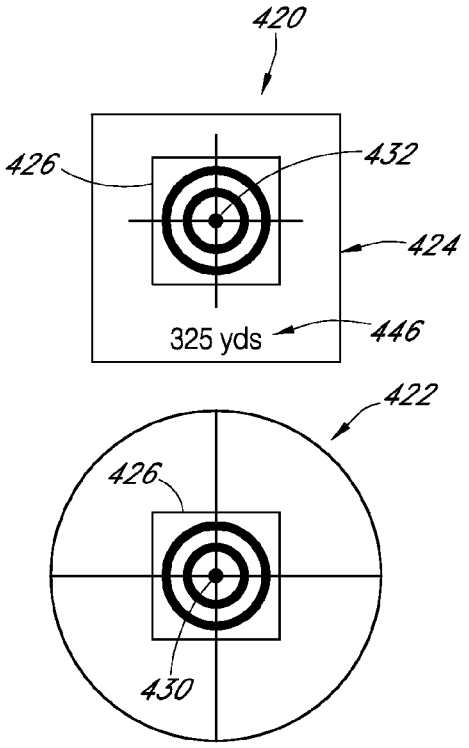
FIGS. 15A-C illustrate how various ballistic parameters such as target range 446, slope angle 451, wind velocity 447, wind direction 448, elevation 452, compass bearing 453 and other environmental factors (without departing from the present teachings) can be determined and digitally displayed in the sighting system's field-of-view and/or remote hand held device, and/or PC and/or command center.
Figure 15B:
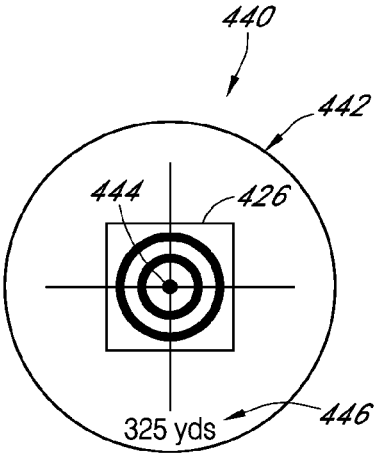
Figure 15C:
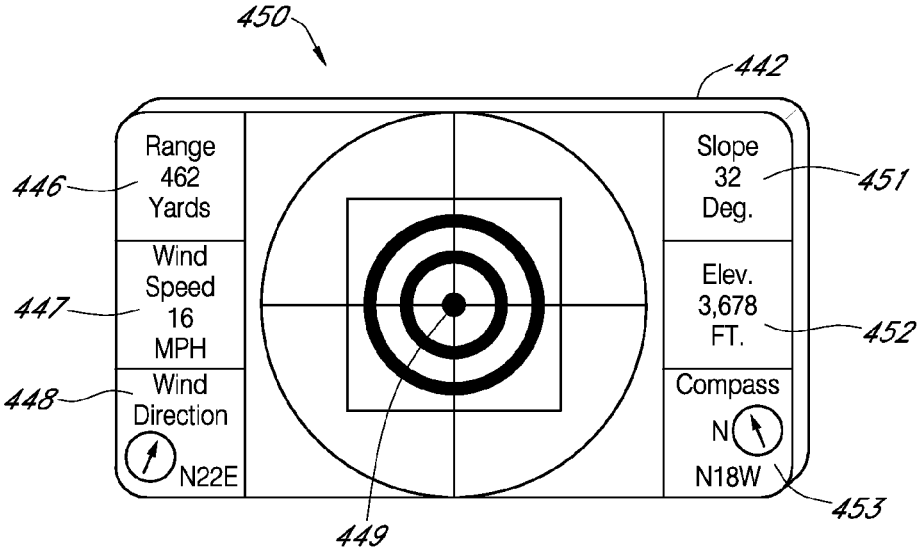

FIGS. 15A-C depict some possible configurations of the sighting system for integrating the ballistic parameter into the processor. FIG. 15A illustrates one embodiment 420 having a separate scope sight picture 422 and a rangefinder picture 424. Preferably, the sighting system's POAC 430 and the rangefinder's POA 432 generally point to a similar area on a target 426. The rangefinder determines a range 434, and provides the range information to the processor.

In another embodiment 440 shown in FIG. 15B, a rangefinder is integrated into a scope such that a POAC 444 of the sight picture 442 indicates the ranging point on a target 426. A range 446 thus obtained is provided to the processor.

In yet another embodiment 450 shown in FIG. 15C, range 446, wind velocity 447 and wind direction 448 information may be input into the processor as well as digitally displayed in the sighting system's field of view 442. The wind velocity 447 and wind direction data information 448 may be automatically transmitted to the processor from a built-in wind detector or via wireless link from a remote sensor (e.g., FIG. 25 set-up in a remote location FIG. 26). In both cases, the wind data can be transmitted to the processor so that the processor can then determine the amount of adjustment to be made to the horizontal (windage) mechanism such that the POAC will coincide with the calculated POIC, and a digital display of the wind information can be viewed through the field of view 442. The wind velocity and direction information may also be approximated by the shooter and entered into the processor. Such approximation may be facilitated by some form of a wind indicator such as a flag or an independent commercially available hand held device that determines wind velocity and direction which information can then be manually inputted into the processor. If such equipment is not available in the shooting environment, the shooter may rely on natural feature's (such as grass) response to the wind to approximate the wind velocity. Windage does not necessarily have to be determined at the target location. In many shooting situations, experienced shooters will try to gauge the wind velocity between the rifle and the target using means such as flags and/or natural features. However, by placing the remote sensor 1064 (FIG. 25) in a strategic location 1090 (FIG. 26), the remote sensor can capture the actual digital wind speed and direction from that strategic location and transmit 1092 (FIG. 26) the same to the sighting system's processor for determination of an accurate POIC adjustment.

It will be appreciated that any number of ballistic parameters may be passed onto the processor in any number of ways without departing from the spirit of the present teachings. For example, the load information about the ammunition may be entered into the processor by the shooter in any number of ways including digital downloads of pre-programmed ballistics tables and/or shareware enabled digital downloads from other marksmen via the internet etc. In addition, FIG. 15C also illustrates how other parameter information such as slope angle 451, altitude (elevation) 452, compass bearing relative to wind direction 453 and 448, humidity, and barometric pressure can also be captured, viewed and processed for proper POIC determination.

Figure 16:
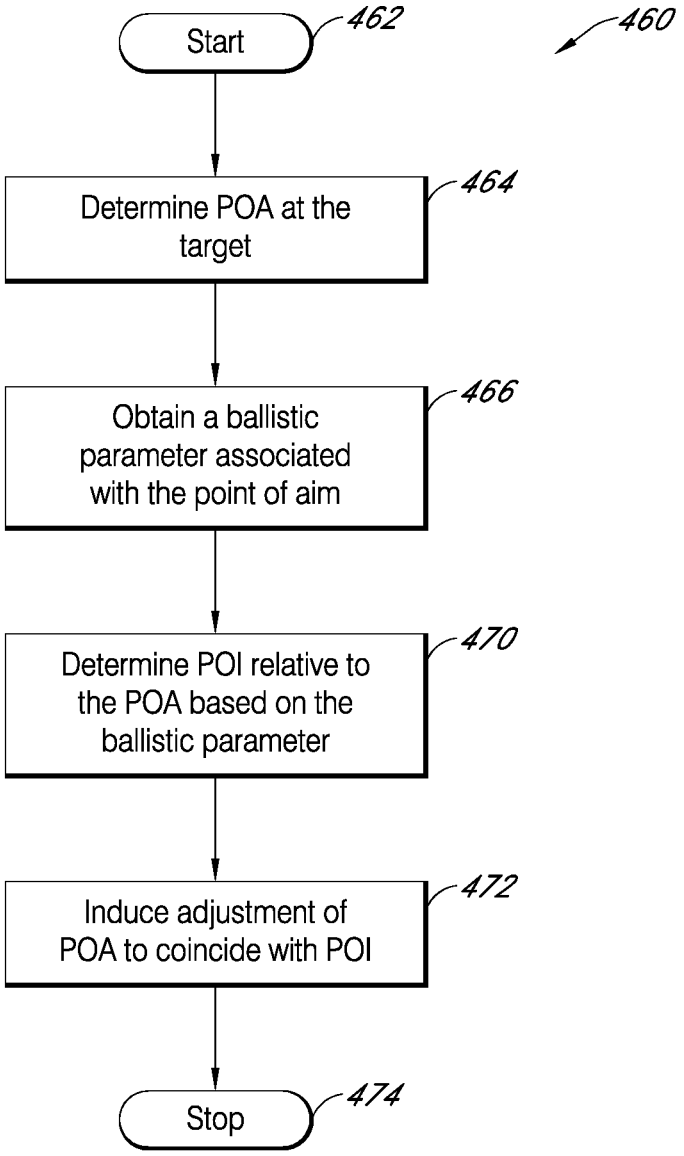
FIG. 16 illustrates an example process for automatically adjusting the point of aim relative to the point of impact, based on the input ballistic parameter.

FIG. 16 illustrates a process 460 for adjusting the point of aim indicator (POAI) from the point of aim coordinate (POAC) to the point of impact coordinate (POIC) based on a given set of parameters (SOP). The process 460 may be performed by the processor 402 in FIG. 14A. The process 460 begins at a start state 462, and in state 464 that follows, the process 460 determines the POAC at the target. In state 466 that follows, the process 460 obtains an SOP associated with the point of aim. Such parameter information may depend on the projectile's properties and/or the shooting environment (for example; distance to target, slope to target, wind velocity and direction, temperature, altitude, air pressure and humidity). In state 470 that follows, the process 460 determines the POIC relative to the POAC and the SOP at hand. In state 472, the process 460 induces adjustment of the POAI from the POAC to coincide with the POIC. The process 460 ends at a stop state 474.

To accurately perform process 460, the projectile launching device can be configured to be sufficiently stable, at least until the adjustment of the POAI from the POAC to the POIC is performed. Otherwise, a shifting point of aim reference dot (POARD) may not provide an accurate reference point for determining the quantifiable adjustment measurement of the POAI from the POAC to the POIC. In one embodiment, the processor may make the POIC determination and freeze the relative POAC, POARD, and POIC positions in the field of view via digital snapshot. Thus, fast processing of POAC to POIC determination may allow accurate POIC determination even with a physically unstable aiming platform. In such an embodiment, the subsequent instability of the projectile launching device during the POIC adjustment generally does not affect the accuracy of the POAC to POIC adjustment being made.

In another embodiment, the processor may continuously or periodically update the relative POAC-POIC positions and adjust the POAI accordingly. It will be appreciated that the various adjustment mechanisms described above, in conjunction with the POIC determination process, facilitate fast adjustment of the POAI so as to reduce the effects of the projectile launching device's instability. Such an embodiment of the sighting system can be particularly useful in situations where the projectile launching device is moving and/or the ballistic parameter is changing during acquisition of the target (for example, a moving target).

Figure 17A:
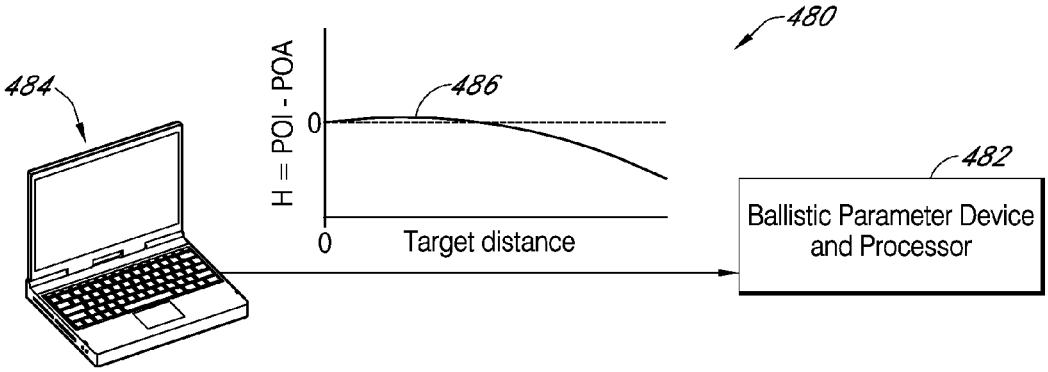
FIG. 17A illustrates an example of providing ballistic parameter information to the ballistic parameter device and processor to allow it to determine the point of impact relative to the point of aim for a given exemplary ballistic parameter, the target range, wherein the ballistic parameter information relative to the resulting POI's is transferred (e.g., downloaded) from an external source, in this example a computer, to the ballistic parameter device and processor.
Figure 17B:
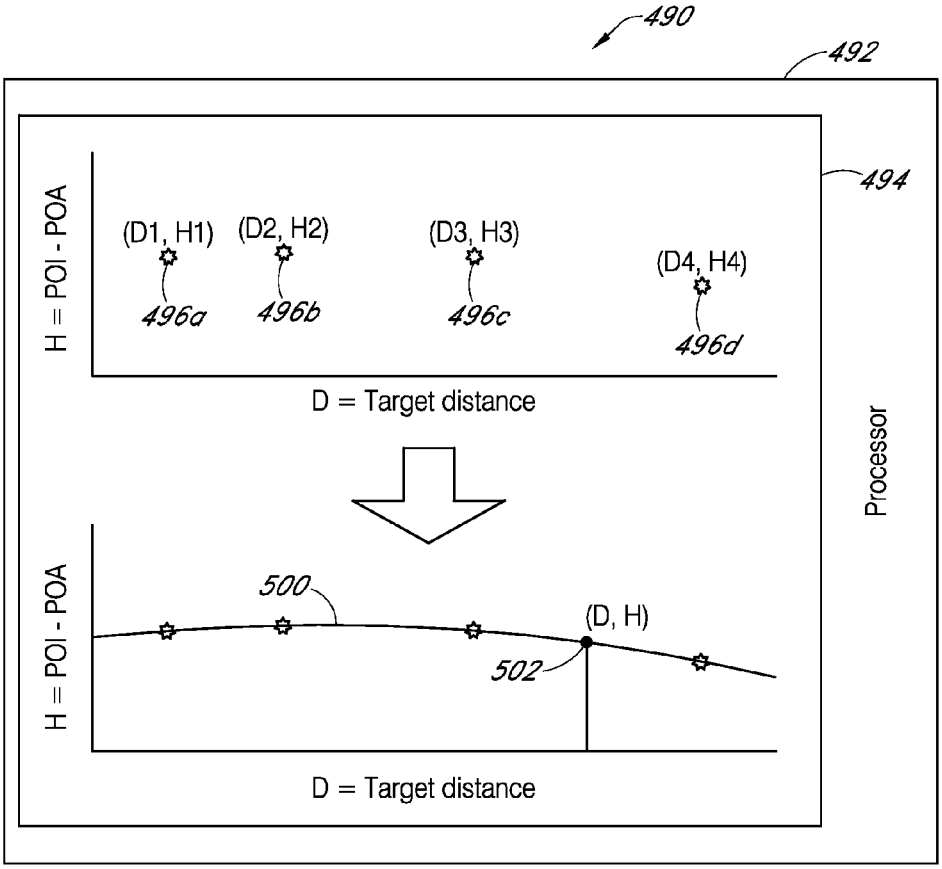
FIG. 17B illustrates an example of calibrating the processor to allow self-contained determination of the point of impact relative to the point of aim for a given exemplary ballistic parameter, the target range, wherein the calibration comprises making a plurality of shots at various target distances and measuring each points of impact with respect to some reference elevation, and wherein for subsequent shots at a given target distance, the corresponding elevation can be approximated based on the measured calibration shots.

FIGS. 17A-B now illustrates some possible exemplary methods of determining the POIC relative to the POAC based on the SOP (step 470 in process 460 of FIG. 16). Such methods may configure the processor prior to the adjustment process 460. The exemplary methods of FIGS. 17A-B are described in context of projectile's elevation trajectory. Thus, the target distance is the ballistic parameter for the purpose of the description. The target distance may be obtained from a rangefinder in a manner described above. It should be understood, however, that any other ballistic parameters (e.g., wind velocity, load type, etc.) may be treated in a similar manner without departing from the spirit of the present teachings.

FIG. 17A illustrates one exemplary method 480 where a bullet trajectory curve 486 is transferred from an external computer 484 to a processor 482 of the sighting system. The curve 486 may be in the form of a look-up table, or an algorithm that calculates the displacement H=POI−POA from the target distance using some known algorithm. Many commercially available software products can provide such functions (or something similar). A given curve may depend on the properties of the ammunition, such as, by way of example, bullet weight, projectile's ballistic coefficient, caliber, amount of propellant powder, and muzzle velocity. Once transferred onto the processor 482 and in step 470 of the process 460, the target range determined by the rangefinder and input to the process 460 (step 466) can be used to determine the corresponding value of H.

FIG. 17B illustrates another exemplary method 490 of determining the POI relative to the POA based on one or more ballistic parameters. Though target distance will be used as an example in the following description, the method applies to any other ballistic parameter as well. The processor obtains a plurality of data points representing target distances and their corresponding values of H=POI−POA. Each data point (i-th data point) can be obtained by making a shot, observing the difference in height between $POA_i$ and $POI_i$, moving the $POA_i$ to the $POI_i$ (by $H_i$), and having the processor record the value of H. When the $POA_i$ is set to the $POI_i$, the zero crossing point of a bullet fired from the projectile launching device is at distance $D_i$. The zero crossing point is the point at which the path of a projectile intersects the horizontal sighting plane of the optical assembly. For example, the data point associated with the range of D1 indicates the POA can be adjusted by H1 so that a projectile fired by the projectile launching device will cross the horizontal sighting plane when it is at distance equal to D1 from the projectile launching device. Other than the recording part, such a process is similar to the POA adjustment method described above in reference to FIGS. 12A-B. A method of storing data points will be described in further detail below.

In FIG. 17B, four such exemplary data points 496*a-d* are shown. The processor may interpolate the data to determine a POA adjustment H such that the POI at distance D coincides with the POA. In one embodiment, the interpolation comprises obtaining a curve 500 based on the data points 496*a-d*, wherein the curve 500 allows approximation of value of H given a target distance D (at an exemplary point 502). Such a curve can be obtained in any number of ways. For example, if the trajectory is relatively flat, or if the shooter obtains sufficient number of calibration data shot points, simple joining of the neighboring data points may provide sufficient accuracy in H for a given D.

Alternatively, a curve can be fit based on the data points. As is generally understood, the trajectory of a projectile under gravitational influence typically has a parabolic shape that can be characterized as $y=a+bx+cx^2$; where x and y respectively represent horizontal and vertical positions of the projectile, and a, b, and c are constants for a given load being calibrated and used. The constant "a" is usually taken to be approximately zero if the projectile launching device's barrel is considered to be at the reference zero elevation. Given the exemplary data points 496*a-d*, the processor may be configured to fit Equation (2) to obtain the values of the constants b and c. Such determined values of a, b, and c may be stored in a memory location on the processor or some other location accessible by the processor. Subsequent determination of y based on input values of x may be performed in any number of ways, including but not limited to, formation of lookup tables or an algorithm programmed into the processor.

Once such fit parameters of Equation (2) are obtained and stored, the shooter can acquire a target, from which a rangefinder determines the distance D. The processor may then automatically input the value of D as x in Equation (2), and determines (calculates) the corresponding value of y (H). The POA is then automatically adjusted based on the value of H in a manner similar to that described above. These automatic vertical and windage adjustments to the POA are performed in a manner wherein the shooter simply has to look through the scope at the target and place the POA on the target. The range finder automatically determines the distance to the target and then transmits such yardage data to the processor which in turn calculates the total amount of vertical and windage adjustments necessary to move thePOAT from the POAC to the anticipated POIC. These automatic adjustments can be made in response to and in combination with the other current environmental conditions. Such environmental conditions may include slope angle, wind velocity, wind speed, temperature etc. Thus, no matter what the distance or environmental condition the shooter is faced with in the field or at the range; the shooter only has to concentrate on holding the POA on the target and pulling the trigger. The adjustments made to the vertical and windage mechanisms via the internal controller can be automatically made via the data provided to the controller by the processor. The data information provided by the processor to the internal controller may be automatically and instantaneously retrieved from one or more of the data storage areas in response to the environmental conditions at hand. These pieces of previously recorded and stored data can then be processed in such a way as to accurately predict the exact or desired incremental adjustment necessary in moving the POA to the anticipated POI. It will be appreciated that the elevation/distance calibration method described above in reference to FIG. 17B does not require knowledge of the projectile's ballistic properties because the data points associated with the trajectory are determined empirically.

As previously described, the sighting system may be configured to integrate and utilize other (than elevation) ballistic parameters without departing from the spirit of the present teachings.

Figure 18:
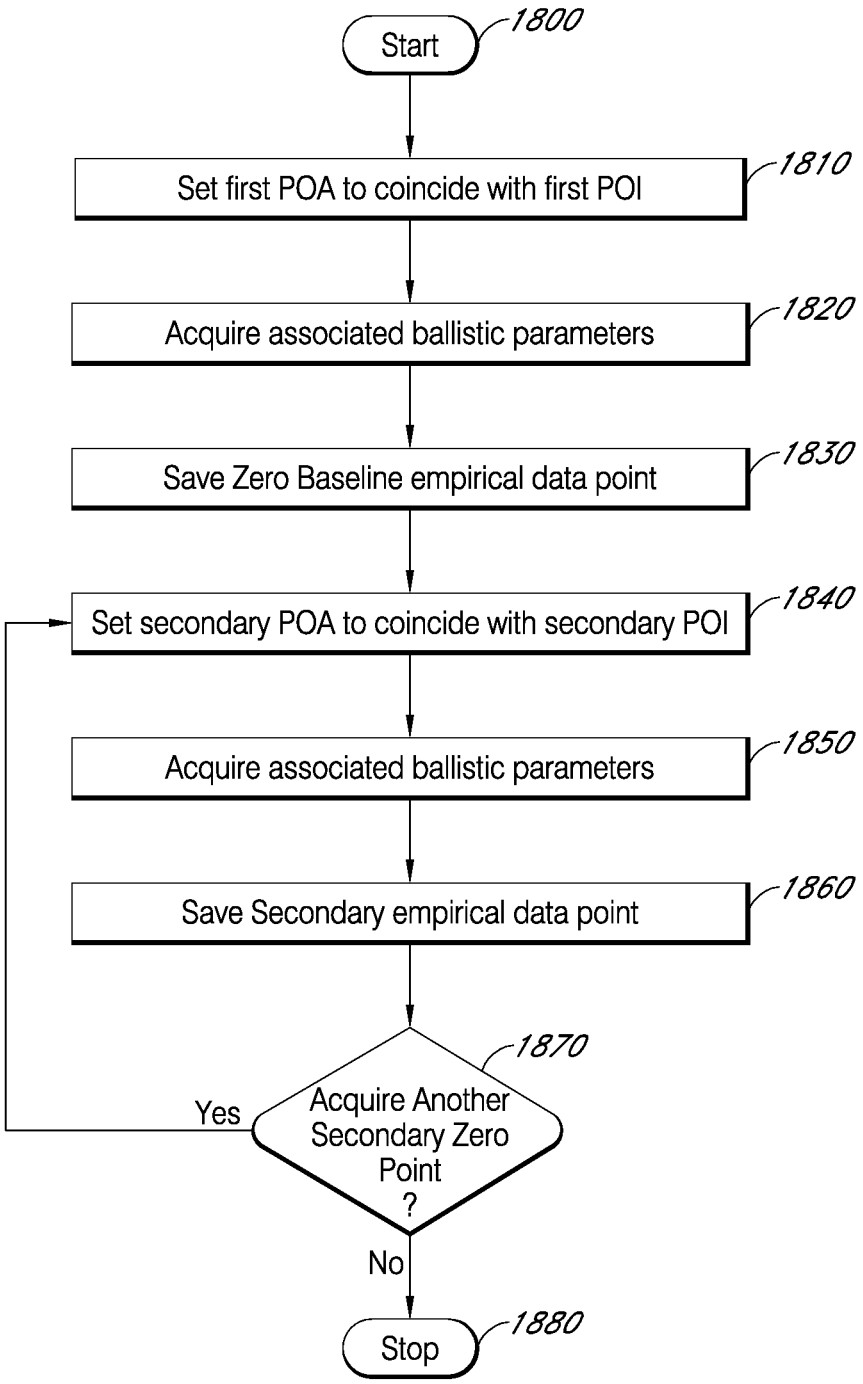
FIG. 18 illustrates one embodiment of a method of acquiring data points representative of a position of a POAI and one or more associated ballistic parameters.

FIG. 18 illustrates one embodiment of a method of acquiring data points representative of a position of a POAI and one or more associated ballistic parameters. The method begins in block 1800 and proceeds to block 1810, where after a shot is fired the POAI is set in a first position so that a first POA coincides with a first POI. Next, in block 1820, one or more associated ballistic parameters are acquired. Associated ballistic parameters can be ballistic parameters sensed substantially contemporaneously with the firing of a shot, such that the parameters indicate the parameters that the projectile was subject to during its flight. The ballistic parameters may be received from various devices that are configured to sense the ballistic parameters that are present at or near the moment the shot is fired. The ballistic parameter-sensing devices can wirelessly transmit (e.g., in real time) the digital parameter readings to the receiver 600, FIG. 14C-1 of the ballistic parameter device 580. The stimulus activation of a projectile being launched (example the sound-activated stimulus of a shot being fired) can engage the stimulus activation device 594-B to capture and store in memory the sensed ballistic parameters that were received at the moment that the projectile was launched. Other examples of external stimuli that the stimulus-activation device can be configured for include but are not limited to movement activation, trigger activation, and muzzle velocity activation. The stimulus created from the projectile being launched will engage the memory to capture the parameters that were transmitted from the parameter sensing devices to the ballistic parameter device at or near the moment that the projectile was launched and thus the moment that the projectile was in route to the target. This stimulus-activated snap-shot of recorded parameter information can be stored in memory 594 until the shooter decides to delete the ballistic information or transfer the ballistic information onto the ammunition-specific I/O device 596 (FIG. 14C-1). Transferring the information onto the I/O device can be performed when the shooter depresses the Record (R) button 582-F (FIG. 14C-3) of the remote controller (FIG. 14C-3). The method and step by step procedure of capturing and recording the ballistic parameters and initiating the automatic features of scope adjustment are described later.

In block 1830, the position of the POAI, which may be indicated by an absolute position (e.g., coordinates) or a relative position (e.g., an MOA adjustment from a reference point), and associated ballistic parameters can be saved to create a zero baseline data point. In one embodiment, the zero baseline data point can create a point of reference from which other POAI adjustments are founded upon.

Moving to block 1840, after a second shot is fired a secondary position of the POAI can be set so the POA coincides with the POI of the second shot. In block 1850 ballistic parameters associated with the second shot are acquired, and in block 1860, the secondary position of the POAI and the associated ballistic parameters can be saved. The secondary position of the POAI may be indicated as an adjustment relative to the position of the POAI associated with the zero baseline data point. For example, the secondary position of the POAI may indicate a number of MOA increments relative to the position of the POAI of the zero baseline data point. This may allow all the data points to be recalibrated by setting a new zero baseline data point. In block 1870, it is determined if another secondary data point is to be acquired. If not, the method proceeds to block 1880, where it stops. Otherwise, the method returns to block 1840 and another secondary data point can be acquired and saved. Any number of secondary data points may be acquired and saved. As more data points are saved, a massive record of data points may be created with the information from hundreds or thousands of shots. The data points may contain empirical data that indicates the POA position for many different ranges, wind velocities, atmospheric conditions, projectile dimensions, altitudes, slopes, etc. As the number of data points increases, the accuracy of POA adjustment can improve because it is more likely that there is a data point with ballistic parameters substantially identical or similar to currently sensed ballistic parameters, and because the greater number of data points may increase the accuracy of interpolation performed by the processor by providing the processor more detailed information about the effect of ballistic parameters on the trajectory of a projectile.

Various methods associated with the adjustments, recordings and storage of the zero baseline data point as well as the number of secondary point of impact coordinates that can be recorded and stored relative to the zero baseline data point can allow the shooter to record an indefinite number of Point-of-Impact Coordinates (POICs) from an indefinite number of distances and environmental combinations. The captured set of parameter information that was present at or near the moment the POIC was generated is often referred to as the captured Set of Parameters (SOP). Because the zero baseline and all subsequent secondary data points are coordinates associated with the POIC of the projectile, the zero baseline data point can be referred to as the Zero-Baseline Point of Impact Coordinate ($POIC_{ZB}$) and all subsequent secondary point of impact coordinate data points can be referred to as Secondary Point of Impact Coordinates ($POIC_{secondary}$).

In certain implementations, each POIC has both a vertical and a horizontal coordinate associated with its particular set of shooting parameters. Each Secondary Point of Impact Coordinates ($POIC_{secondary}$) can therefore be a functional measurement of "X" vertical data points and "Y" horizontal data points from the Zero-Baseline-POIC ($POIC_{ZB}$). The $POIC_{ZB}$ can be the first Point-of-Impact Coordinate stored onto, for example an SD card, and as such, the "X" and "Y" coordinates for the $POIC_{ZB}$ are "0, 0". All subsequent (secondary) $POIC_{secondary}$ can have an "X" and "Y" coordinate that are >, <, or =0.

The step-by-step method of adjusting and recording the POA to POI coordinates can be outlined as follows:

(1) Step 1: The shooter first installs the appropriate I/O device (example SD card) into the I/O port 596 (FIG. 14C-1) of the ballistic parameter device 580. It is noted that every caliber of rifle, brand of ammunition, or custom load of ammunition, can each have their own individually assigned SD card. Once the SD card is installed, the shooter can activate the ballistic parameter device and sighting system by pressing the power-on button 703 (FIG. 14C-2), followed by pressing the Record Mode button 705. Pressing the Record Mode button 705 activates the ballistic parameter device 701 to operate in a mode of operation that is specific to the monitoring and recording of manual adjustments being made by the shooter as well as the various ballistic parameters being sensed and automatically transmitted to the ballistic parameter device from the scope sensors and remote sensor. Activation of the Record Mode engages the ballistic parameter device 580 (FIG. 14C-1) to begin receiving and monitoring the digital information 404 (FIG. 14A) being transmitted from either the remote controller (FIG. 14C-3) or the various ballistic parameter detectors 610, 612, 613, 614, 598-A, 670A and 670B (FIG. 14C-1).

(2) Step 2: If the scope adjustment system includes the remote sensor feature 563A (FIG. 13C), the shooter will next want to activate the remote-sensing device 563A by pressing its power-on button 563-B. The remote-sensing device can then be strategically placed (FIG. 26) in a location that the shooter feels it will most conveniently and accurately sense and transmit 563-I the wind and atmospheric conditions that are representative of what the bullet will be subjected to during its flight in-route to the target from the projectile launching device 563-J to the target 563-M.

(3) Step 3: The shooter takes aim at his intended target (POA). Once the shooter aims at his intended target (POA), the following functions of the optical assembly and adjustment mechanisms can be performed automatically: The rangefinder, inclinometer, internal compass, and the remote sensor each stream their own independent digital shooting parameters to the sighting system's ballistic parameter device. The ballistic parameter device calculates a slope-corrected distance to the target based upon the distance and slope angle from the projectile launching device to the target. The ballistic parameter device senses and monitors a compass bearing, relative to wind bearing, based upon the digital information received from both the wind anemometer and vane 563-C and the bearing of the compass 563-J. The sighting system's ballistic parameter device and processor receives the digitally streamed wind and compass-bearing information, and tabulates (in real time) the exact correlation of yardage distance to cross-wind speed, and wind direction relative to the direction of the anticipated bullet flight.

(4) Step 4: The shooter fires a shot at his intended target (POA). The digitally monitored shooting parameters for wind speed and wind direction (relative to bullet direction) are automatically recorded, via stimulus-activation (in the example via sound-activation), at or near the moment that the shooter pulls the trigger. The stimulus-activation feature allows the ballistic parameter device to capture and record the wind and atmospheric conditions and compass bearing into its memory at or near the moment that the projectile was travelling in-route to the target. The stimulus-activated digital snap-shot of tabulated set of parameter (SOP) information associated with temperature 563-D, barometric pressure 563-E, humidity 563-F, and altitude 563-G can also be captured and transmitted from the remote sensing device 563-A to the sighting system's receiver and micro-processing system. The SOP captured can be recorded into memory, via the stimulus activation device (for example, when the shooter pulls the trigger). In this example, at or near the moment the shooter pulls the trigger, the stimulus-activation device captures and records a snap-shot of shooting parameters that the projectile was subjected to at or near the moment it was in route 563-L to the POIC. The snap-shot of shooting parameters captured at or near the moment the shot was made can include but is not limited to: Slope-corrected target distance; bullet bearing relative to windage bearing; wind speed; temperature; humidity; barometric pressure; and altitude (elevation).

(5) Step 5: After the shot is fired and the SOP is captured, the shooter finishes making his POAC-to-POIC adjustment to his scope (e.g., via the remote controller 570-A). If the POAC-to-POIC adjustment being recorded is the very first POIC coordinate to be recorded onto the SD card it is called the Zero-Baseline Point of Impact Coordinate ($POIC_{ZB}$). To record the $POIC_{ZB}$, the shooter presses the ZBP button on the remote control transmitter. However, to record each additional secondary POIC, the shooter presses the REC (record) button on the remote controlled transmitter. Pressing either the ZBP or REC button on the remote controller causes the ballistic parameter device to record the Point-of-Impact-Coordinate (POIC) and its captured SOP, relative to that particular POIC, onto the SD card. The POIC and its captured SOP will only be stored on the SD card when the shooter depresses the ZBP or REC on the remote controller. The shooter may choose to repeat the POAC-to-POIC procedure several times before finally recording his POIC. At the moment the record button is depressed, all elements associated with the POIC can be recorded and stored. All elements associated with the POIC can include: POAC-to-POIC adjustment long with the captured SOP which in this example include the slope-corrected target distance; bullet bearing relative to windage bearing; wind speed; temperature; humidity; barometric pressure; and altitude (elevation). The slope-corrected target distance can have an influence on the Vertical position of the POIC (from the $POIC_{ZB}$), whereas the bearing of the bullet relative to the windage bearing and velocity can have an influence on the Horizontal position of the POIC (from the $POIC_{ZB}$). Temperature, humidity, pressure and altitude can have variable effects on both Vertical and Horizontal coordinates (from the $POIC_{ZB}$).

(6) Step 6: Once the $POIC_{ZB}$ or secondary POIC is recorded and stored, the shooter can repeat steps 3-5 above with as many target distances and shooting parameters as desired.

The remote sensing device 563-A (FIG. 13C) automatically senses and transmits (e.g., in real time) the wind information via the wind sensor. The wind sensor can be configured such that its digital readings can be transmitted from the remote sensor 563-A to the ballistic parameter device 562-A. The remote sensor 563-A wirelessly transmits the sensed wind speed, and wind direction, as depicted by line 563-I, to the ballistic parameter device 562-A (e.g., in real time). Ballistic parameters associated with temperature, barometric pressure, humidity, altitude and ambient light conditions are sensed by the remote thermometer 563-D, barometer 563-E, Hygrometer 563-F, altimeter 563-G, and light meter 563-H of the remote sensing device. The digital readings sensed from each of these remote digital ballistic parameter instruments are also configured to be transmitted (e.g., in real time), as depicted by line 563-I, from the remote sensor 563-A to the ballistic parameter device 562A.

The digital information associated with the projectile flight's compass bearing 563-J is also transmitted (e.g., streamed) from the sighting system's internal compass to the ballistic parameter device 562-A, as depicted by line 563-K. Similar in function to the sighting system's embodied rangefinder and inclinometer, the sighting system's embodied digital compass is configured to transmit the digital bearing of the projectile launching device relative to the target (POA) to the ballistic parameter device 562A.

In FIG. 14C-1, it is illustrated that the information from the rangefinder 610 and inclinometer 614 are also configured to transmit their digital readings from the scope to the ballistic parameter device as depicted by line 632. Information from the rangefinder and inclinometer pertain to the relative distance and percent slope of the projectile launching device relative to the target. The digital compass generates digital information pertaining to the directional bearing of the rifle (also referred to as anticipated bearing of bullet) relative to the direction and speed of the wind.

The POA compass bearing of the scope 563-J (FIG. 13C) can be equal to the directional bearing of the anticipated bullet flight 563-L prior to the influences on the bullet subject to the sensed ballistic parameters of the remote sensor 563-A. Deviations of the bullet flight 563-L from the compass bearing 563-J can be subject to the type and degree of ballistic parameters sensed by the remote sensor 563-A at the time the bullet was in flight 563-L to the target 563-M. For example, the flight of the bullet relative to the compass bearing will deviate in direct proportion to the distance to the target and the wind speed and wind direction captured and recorded at or near the moment the bullet was in flight to the target.

In addition to adjusting and recording the POA to POI coordinates, the shooter may also choose to adjust and record his preferred magnification and focus settings. A method of adjusting and recording the magnification and focus settings can be performed concurrently with the method of adjusting and recording the POA to POI coordinates. Such a method of adjusting and recording the magnification and focus settings can be outlined as follows:

(1) Step 1: The shooter begins the recording method of the zoom-magnification and focus recordings by pressing the "Record-Mode" button 715 (FIG. 14C-2) on the sighting system's ballistic parameter device.

(2) Step 2: Once the Record Mode is activated, the shooter next presses the M/F (magnification/focus) button 582-H (FIG. 14C-3) on the finger-activated remote transmitter 582. Once the M/F button 582-H is pressed, the shooter can then zoom-in-and-out on his intended target by pressing the vertical arrow-keys 582-B, 582-C on the finger-controlled transmitter 582. In some embodiments, the auto-focus feature of the sight-system will attempt to provide the shooter with a crisply-focused image of the target relative to the magnification setting selected. If necessary, the shooter may choose to customize his particular focus setting by manually overriding the auto-focus feature. This can be performed by pressing the horizontal arrow-keys 582-D, 582-E on the finger-controlled transmitter. The horizontal arrow-keys provide the shooter with an improved method of focusing-in on his target so that the shooter will have a more clearly visible view of his intended target for his particular condition of ocular vision. If necessary or if preferred, this custom focus setting feature can also allow the shooter to operate his sighting system without the aid of prescription glasses or contact lenses.

(3) Step 3: Once the shooter performs the zoom-magnification and focus adjustments to his preferred visual settings, he can then record this preferred magnification/focus setting, for any or all POIC(s) he chooses, by pressing the Record button 582-F on the remote controller 582. The scopes internal rangefinder and inclinometer automatically determines the slope-corrected distance to the target. At the moment the shooter presses the Record button 582-F, the sighting system's ballistics parameter device 580 (FIG. 14C-1) automatically records the slope-corrected distance to the target as well as the preferred magnification/focus setting that was manually adjusted (customized) for that particular target distance and POIC parameter.

In addition to adjusting and recording the POA to POI coordinates and the preferred magnification and focus settings; the shooter may also choose to adjust and record his preferred settings for ambient light, and/or night-vision (NV) and/or infra-red (IR) and/or thermal imaging (TI). A method of adjusting and recording such preferred visual settings can be performed concurrently with the method of adjusting and recording the magnification, focus and POAC to POIC. Such a method of adjusting and recording such preferred visual settings can be outlined as follows:

(1) Step 1: The shooter begins the recording method of the preferred settings feature by pressing the "Record-Mode" button on the sighting system's ballistic parameter device.

(2) Step 2: For the purpose of description, one can limit the preferred-setting process to night-vision only, but keeping in mind that a similar method can be performed for the preferred-settings of IR, and TI as well. Thus in this example, the shootershooter presses the NV (night-vision) button 582-I, which can be located on the remote controller 582. Once the night-vision record mode feature is activated, the shooter can then proceed to open and close the sighting system's night-vision aperture-opening mechanism by pressing the vertical arrow-keys 582-B, 582-C on the remote controller 582. If necessary, with the night-vision feature activated, the shooter may choose to augment the natural ambient light with varying levels of artificial light. This can be performed by adjusting the intensity 598-E (FIG. 14C-1) of the sighting system's artificial light adjustment mechanism 598-B. Adjusting the intensity 598-E of the sighting system's artificial light adjustment mechanism 598-B is performed by pressing the horizontal arrow-keys on the finger-controlled transmitter. While looking through the sighting system's field-of-view, the shooter can adjust the aperture-opening until the preferred amount of ambient-light illuminates the field-of-view of the target well enough to accurately see the intended target and to make an accurate shot. While looking through the sighting system's field-of-view, if the amount of ambient light is insufficient to see the intended target, the shooter may choose to augment the ambient allowed to enter the aperture-opening with artificial light until a preferred level of total light illuminates the target well enough to make a positive ID and take an accurate shot.

(3) Step 3: Once the shooter adjusts the aperture-opening (and if necessary augments the same with artificial light) to his preferred setting, he can now record this preferred setting by pressing the record button 582-F on the remote control transmitter 582. The aperture opening is an empirical adjustment mechanism that controls the amount of ambient and/or artificial light that is allowed to enter into the scopes optical viewing assembly. The aperture adjustment is made relative to the ambient-light conditions (or lack thereof) as they exist in the field at or near the moment the aperture adjustment is made. The ambient-light conditions are measured via an ambient-light sensing device 563-H (FIG. 13C) located within the remote sensing device 563-A. The remote sensing device can be strategically placed in a location that is accurately representative of the ambient light conditions in the field or in close proximity to the likely target location. The digital measurement of the ambient-light conditions present, at or near the time that the aperture adjustment is made; is transmitted from the remote sensor to the ballistic parameter device. In addition to the ambient-light measurement; the sight-system's internal rangefinder and inclinometer automatically determines the slope-corrected distance to the target when the scope is aimed at the target. When the shooter presses the record button, the sighting system's ballistic parameter device automatically records both the slope-corrected distance to the target as well as the ambient-light readings and aperture-setting (and intensity of artificial light if applicable) for this particular ambient light/magnification/target distance combination. Once the preferred night vision setting adjustment is made and the record button 582-F (FIG. 14C-2) is pressed; the aperture-setting for this particular target distance and magnification setting is now recorded relative to the ambient-light conditions in the field and augmented, if necessary, with a quantifiable intensity of additional artificial light; the levels of which are also recorded as a component of the preferred night-vision setting.

(4) Step 4: The shooter can repeat this night vision setting and recording procedure on as many target distances, magnification and ambient-light combinations as he chooses. It is noted that similar adjustments and preferred-settings for the Infra-red (IR) and Thermal imaging (TI) components can also be made in similar manners as the night vision, and then recorded for future automatic retrieval and adjustment.

The methods of recording the POAC-to-POIC, magnification, focus, NV, IR and TI settings may be augmented with and/or replaced with downloadable digital ballistics POIC software. The downloadable ballistics POIC software and/or APP do not require a significant investment of time in the field capturing and recording numerous POICs. The downloadable ballistics software information allows the shooter to operate his sighting-system in Auto-Mode without first having to obtain numerous POICs in the field. The ballistics software may not be as accurate as the field-recorded data, but can be superior in accuracy when compared to various conventional ballistic tables, singular zero-point settings, extrapolation, and hold-over procedures of marksmanship. The ballistics software can be further calibrated in the field by calibrating the same against its field-verified Zero-Baseline Point of Impact Coordinate or $POIC_{ZB}$ (refer to the Record Mode methods and procedures of $POIC_{ZB}$ previously presented). The ballistics software can be obtained via the manufacturer or shared via marksmen the world-over. The sharing of these ballistics data information may be shared via shareware downloads from the internet or swapping and downloading of SD cards.

Once the shooter is finished adjusting and recording his POAC to POIC and preferred visual settings, and/or obtaining the same via software or shareware downloads, he may then chose to operate his sight-system in Auto-Mode. Once the shooter is finished recording and/or downloading his various custom POIC and preferred visual settings, the sighting system is then ready to be operated automatically. To engage the sighting system's automatic feature, the shooter presses the ballistic parameter device's Auto-Mode button 704 (FIG. 14C-2). Once in Auto-Mode, the shooter simply aims at whatever target he wants, regardless of the distance and shooting parameters associated with the target selected. Once in Auto-Mode, the sighting system's embodied rangefinder, inclinometer, auto-zoom-focus, and night vision feature of the scope can now automatically determine the slope-corrected distance to the target and then automatically zoom-in, focus and adjust the light aperture of the scope to the desired view-setting that was previously recorded for that particular distance and shooting-parameter combination. While in Auto-Mode, these prerecorded magnification/focus/aperture settings can be automatically retrieved and adjusted in conjunction with and simultaneous to the corresponding POIC settings. Once the shooter aims his sight-system at his intended target, the sight-system can automatically retrieve these prerecorded settings (relative to the shooting parameters at hand) and then automatically adjust the sighting system to the preferred view-settings (e.g., magnification, focus, night-vision etc.) as well as Point-of-Impact-Coordinate (POIC) simultaneously. Once the sight-system is engaged in Auto-Mode, the shooter simply aims at whatever target distance he intends to shoot and pulls the trigger. The automatic feature of the sight-system can automatically adjust the sight-system to perform the actions described in 0145-A through 0145-D above.

Figure 19:
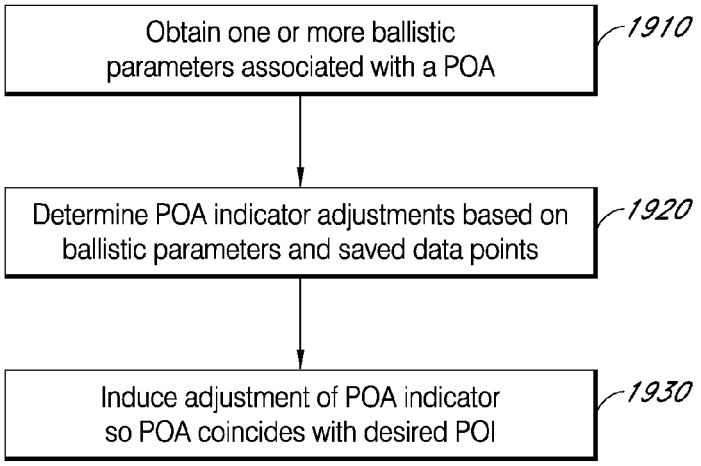
FIG. 19 illustrates one embodiment of a method of adjusting the position of a POAI of an optical assembly.
Figure 19A:
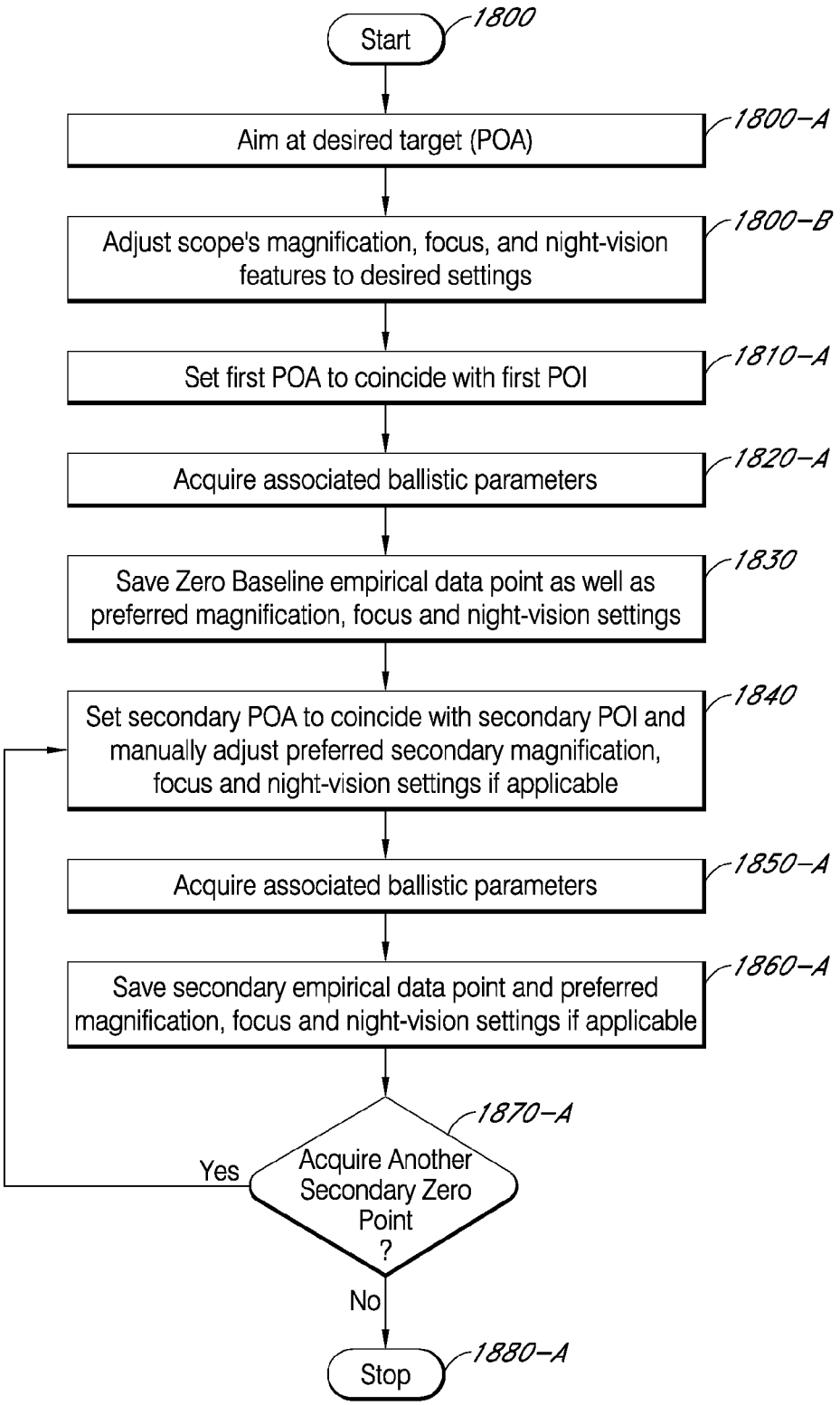
Figure 19B:
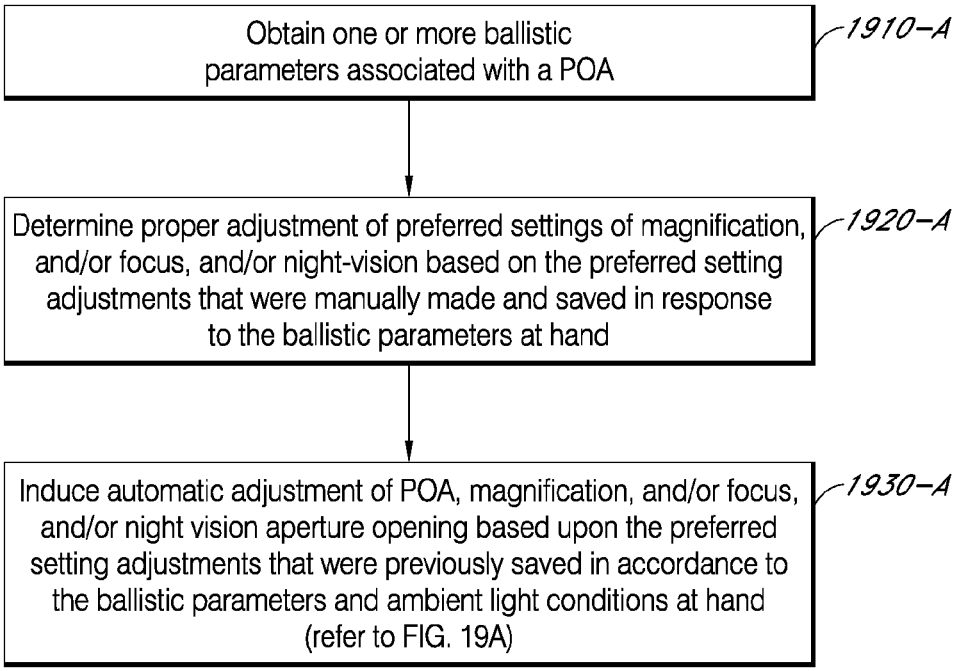

FIG. 19 illustrates one embodiment of a method of automatically adjusting the position of a POAI of an optical assembly. In block 1910, one or more parameters associated with a POAC are obtained. Moving to block 1920, a processor determines one or more POAI adjustments based on the target ballistic parameters and the data points. In one embodiment, the processor determines that a data point saved in memory has ballistic parameters that are substantially identical to the target ballistic parameters. The processor may then adjust the position of the POAI to the position of the POAI associated with the data point. For example, if the target ballistic parameter is a range of 100 yards and a previously recorded data coordinate is retrieved that is also associated with a range of 100 yards, the processor may then adjust the POAI to the position of the POAI associated with the retrieved coordinate.

In other embodiments, the processor may determine a POAI adjustment by interpolating data from a subset of the data points or all of the data points. In block 1930, the processor induces the adjustment of the POAI so that the when the POA is indicated by the POAI the POAI substantially corresponds with the POIC. The inducement may be performed by sending a signal to an actuator mechanism that is coupled to the optical assembly.

FIG. 19-A illustrates one embodiment of a method of adjusting the preferred magnification, focus and night-vision settings of an optical assembly. In block 1910-A, one or more ballistic parameters and/or ambient-light readings associated with the preferred settings are obtained. Moving to block 1920-A, a processor determines one or more preferred setting adjustments based on the obtained target ballistic parameters ambient-light readings and data points. In one embodiment, the processor determines that the digital settings saved in memory have ballistic parameters that are substantially identical to the target ballistic parameters obtained. In block 1930-A the processor may then induce the magnification, focus and/or night-vision adjustment mechanisms to make the proper adjustments. For example, if the target ballistic parameter is a range of 400 yards and one or more preferred magnification, focus and/or night-vision settings are associated with a range of 450 yards, the processor may then adjust the optical assembly to the preferred position of magnification, focus and/or night-vision associated with the saved digital information associated with 450 yards. The inducement may be performed by sending a signal to an actuator mechanism that is coupled to the optical assembly.

The use of empirical data points advantageously allows for custom data points to be acquired for a projectile launching device that indicate the actual performance of the projectile launching device, and reduces or eliminates reliance on a generic ballistic table that only includes general information. The custom data points may account for parameters unique to each projectile launching device, such as the distance between the scope and the firing plane and variations in the barrel, performance differences of the projectile launching device in different conditions, wear of the projectile launching device, and performances differences when using different ammunition. Also, increasing the number of data points may increase the accuracy of the interpolation of a POAI adjustment by providing the processor more data to use when calculating the POAI adjustment for a given set of ballistic parameters.

Figure 20A:
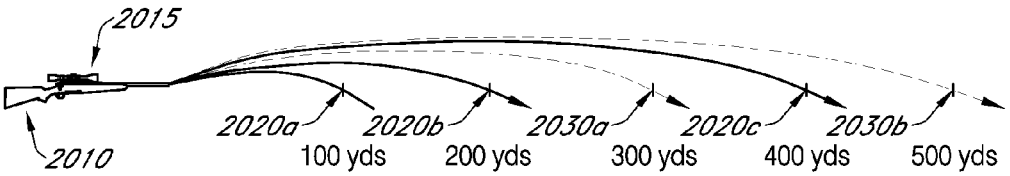
FIGS. 20A and 20B illustrate embodiments of a method of determining a POAC adjustment.
Figure 20B:
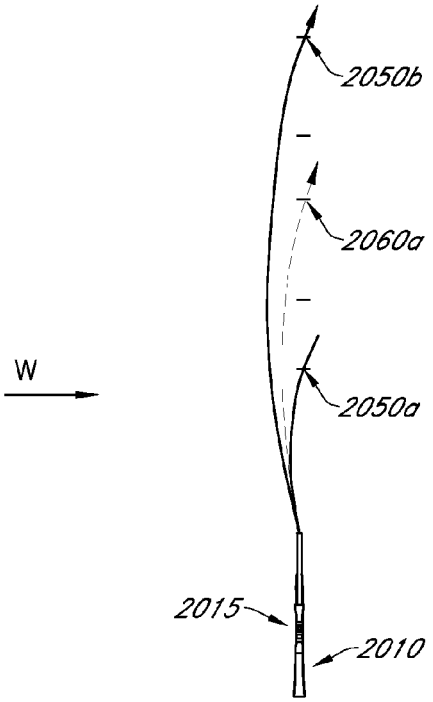

FIGS. 20A and 20B illustrate embodiments of a method of determining a POAI adjustment. In FIG. 20A, a sighting system 2015 of a projectile launching device 2010 has saved data points 2020*a*, 2020*b*, and 2020*c*. Each data point indicates the range and a POAI position of the sighting system 2015. For example a POAI may be a reticle, such as cross hairs, a dot, and/or a circle. When the POAI of the sighting system 2015 is in the position indicated by a data point, the zero crossing of the horizontal plane of the POAI of a bullet fired from the projectile launching device 2010 can coincide with the associated range indicated by the data point. When a new range is received for a target, a new range referring to at a range that does not correspond to a range associated with a saved data point (for example, range 2030*a* or 2030*b*), the sighting system 2015 can interpolate a position of the POAI from the saved data points 2020*a-c*. When the POAI is in the interpolated position (for example, the position interpolated for range 2030*a*), a bullet fired from the projectile launching device 2010 can cross the horizontal plane of the POAI at a range that substantially coincides with the new range 2030*a*.

FIG. 20B illustrates how the sighting system may compensate for windage. In FIG. 20B, a sighting system 2015 has saved data points 2050*a* and 2050*b* that indicate a respective range, wind velocity $W_{saved}$, POAI position. When the POAI of the sighting sighting system 2015 is in the position indicated by a data point, the zero crossing of the vertical plane (and in some embodiments the horizontal plane as well) of a bullet fired from the projectile launching device 2010 that is subject to the associated $W_{saved}$ saved can coincide with the associated range indicated by the data point. When a new range 2060*a* and a new wind velocity $W_{new}$ are received for a target, a position of the POAI may be interpolated such that the zero crossing of the vertical plane of the POAI (or both planes of the POAI, also referred to as the line of sight of the POAI) of a fired bullet can coincide with the new range. Any number of parameters associated with a target may be accounted for in the POAI adjustment and in the interpolation, such that a fired bullet can cross the line of sight of the scope at the position of the target.

Figure 21A:
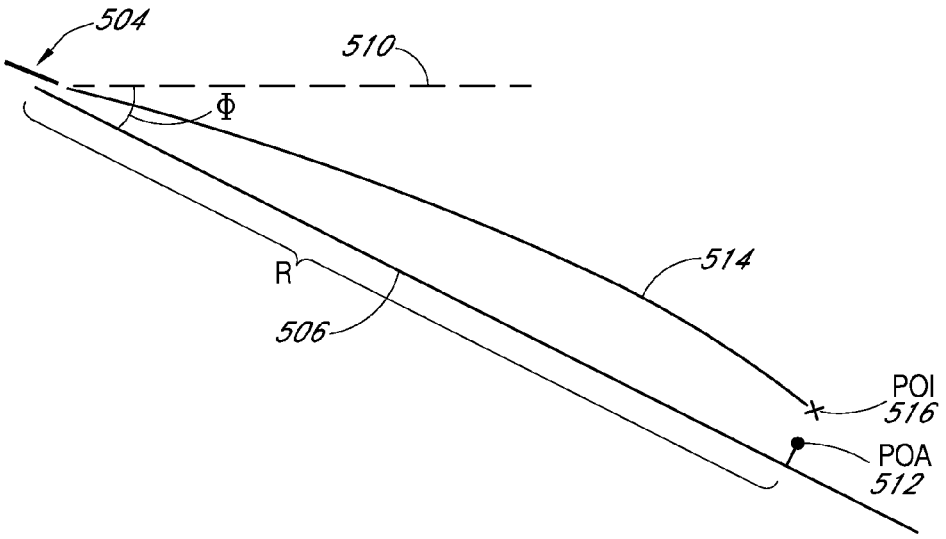
FIGS. 21A-B illustrate the projectile's trajectory in downhill and uphill shooting situations, showing how the point of impact is high if the point of aim is determined based on the target range alone.
Figure 21B:
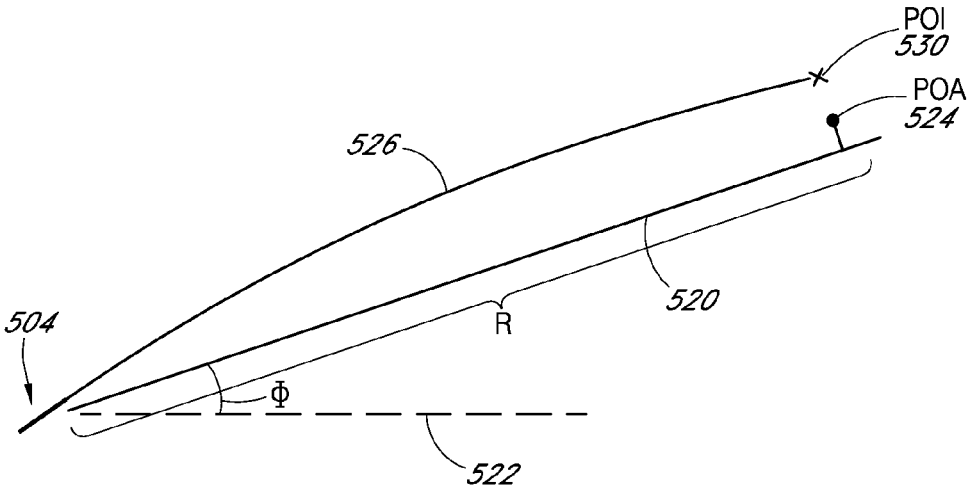

One aspect of the present teachings relates to integrating and utilizing a terrain-related ballistic parameter to adjust for the effect of shooting a rifle either downhill or uphill. FIGS. 21A and 21B illustrate exemplary downhill and uphill shooting situations. In FIG. 21A, a rifle 504 is aimed at a POA 512 of a target located at a range R along a downhill slope 506. The slope 506 forms an angle $\phi$ with respect to a horizon 510. As is understood in the art, when the rifle 504 is shot at the POA 512 (adjusted for range R, either in one of the methods described above, or otherwise), the bullet impacts at a POI 516 that is higher than the POA 512 with respect to the downhill slope 506 at the target.

Similarly in FIG. 21B, the rifle 504 is aimed at a POA 524 of a target located at a range R along an uphill slope 520. The slope 520 forms an angle $\phi$ with respect to a horizon 522. As is also understood in the art, when the rifle 504 is shot at the POA 524 (adjusted for range R, either in one of the methods described above, or otherwise), the bullet impacts at a POI 530 that is higher than the POA 524 with respect to the downhill slope 520 at the target.

Both of the shooting high effects illustrated in FIGS. 21A and 21B are due to the rifle-to-target line deviating from the horizon (by approximately $\phi$) that is generally perpendicular to the gravitational field. As is understood in the art, one common method of accounting for the angle $\phi$ to the target, thereby reducing the high POI, is to treat the range to target not as R, but as approximately R cos $\phi$. The angle $\phi$ may be obtained in any number of ways, including but not limited to, some form of an inclinometer whose output is integrated into the sighting system, an independent device whose reading is obtained by the shooter, or simply a shooter's visual approximation. The angle determined in the foregoing manner may be used by the sighting system to adjust the POA.

Figure 22:
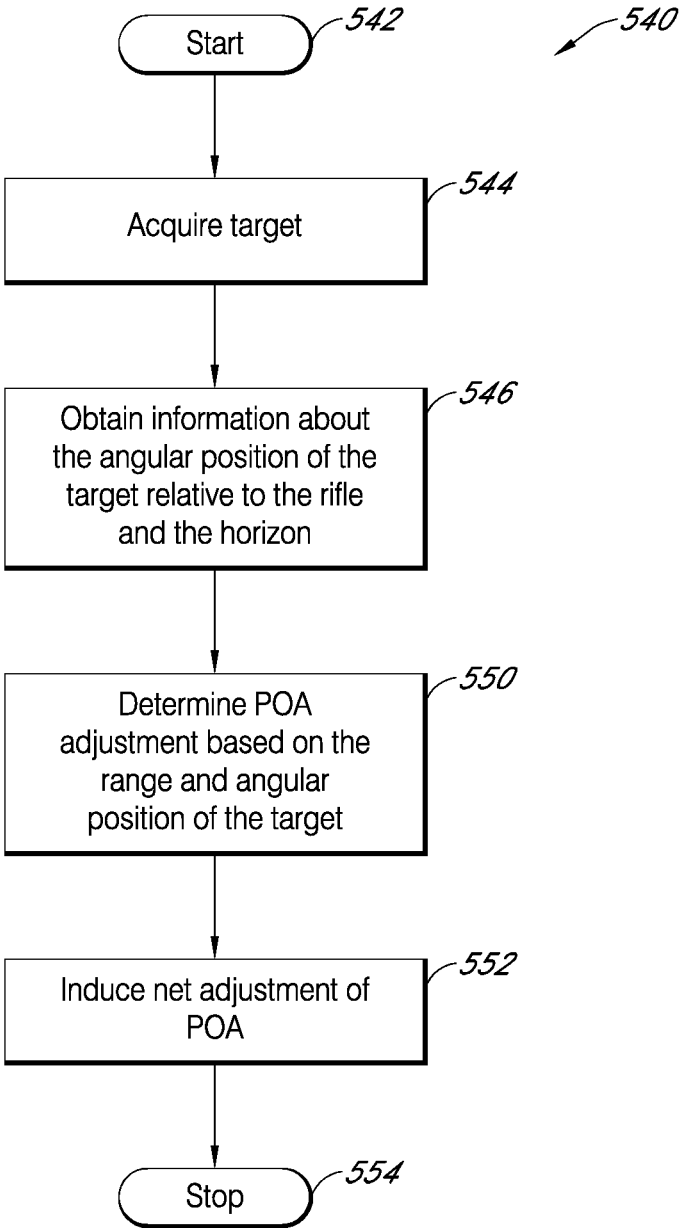
FIG. 22 illustrates an example process for determining the point of aim adjustment based on the angle of the rifle with respect to the horizon.

FIG. 22 illustrates one such possible process 540 for adjusting the POA based on the angular position of the target with respect to the horizon and the rifle. The process 540 begins at a start state 542, and in state 544 that follows, the process 540 acquires the target in a manner similar to that described above. In state 546 that follows, the process 540 obtains information about the angular position of the target with respect to the horizon and the rifle. In state 550 that follows, the process 540 determines a POA adjustment based on the range and the angular position of the target. In state 552 that follows, the process 540 induces the POA adjustment. The process 540 ends in a stop state 556.

One example shooting situation and resulting POA adjustments are as follows: If a hill is at an angle of 20 degrees with respect to the horizon, and the target is 300 yards away from the shooter, $\phi$=20 degrees and R=300 yards. To determine the POA adjustment, a range of R cos $\phi$=300 cos(20)=300×0.94=282 yards would be used instead of 300 yards.

Based on the foregoing description of the various embodiments of the scope adjustment system, it should be apparent that similar systems and methods can be adapted to be used in any optical sighting devices attached any projectile launching devices. The optical sight does not necessarily have to magnify the image of the target. As an example, some optical sights simply project an illuminated dot as a POA, and the shooter simply places the POA at the target. Such non-magnified or low-power magnified devices are sometimes used, for example, in handguns and bows where the POA adjustment principles generally remain valid.

In one embodiment, various embodiments of the remote controller and the corresponding adjustment mechanism described herein can be integrated, configured, or manufactured to allow remote or automatic adjustment of magnification and optical focus of the scope as well as variable settings for night vision. Some scopes have variable magnification and/or night vision settings that can be adjusted by, for example, turning the eyepiece end of the scope and/or light emitting and receiving mechanisms of the sighting system's night vision feature. A movement mechanism can be configured to couple to such adjustment mechanisms, or internally integrated into the sighting system's design, so that the remote controller can induce the movement that changes the magnification and night vision settings of the scope. FIG. 13A shows one embodiment of a scope that includes auto-zoom, auto-focus, and auto-night vision features within the scope that are based upon the same principle of adjustment methods and mechanisms of the previously described scope adjustment mechanisms. As previously described, the use of empirical data points advantageously allows for custom data points to be acquired for a projectile launching device. In this example, such data points can also be integrated into the sighting system's adjustment mechanism in such a way as to not only make accurate adjustments to the vertical and windage adjustment mechanisms, but they can also be used to make adjustments to the sighting system's magnification, optical focus and night-vision features as well.

For example, a target located only 100 yards away may require the scope to have a different magnification, focus and/or night-vision settings than a target located at say 400 yards. In one embodiment, the shooter can first adjust his optical zoom, focus and night-vision (if applicable) parameters to the 100 yard target and then record and store these settings in his adjustment system 384. The shooter can then proceed to repeat the same adjustment and storage procedures for a target located at 400 yards. Once these new optical parameters are stored for the 400 yard setting, the adjustment system 384 may then be able to automatically make the optical adjustments to the field of view 388 so that the field of view is more easily decipherable. Such adjustments may be automatically performed in the field or at the range whenever the shooter were to aim at a target located at a distance of similar yardage parameters. These optical adjustment procedures can be programmed and controlled to adjust in-synch with the sighting system's stored ballistic parameters so that the vertical, windage, magnification, focus and night-vision adjustments can all be made automatically and in combination with each other.

FIG. 22-A illustrates one embodiment of a method of acquiring a preferred magnification, focus, and night-vision setting (if applicable) as well as the previously described data points representative of a position of a POAI and one or more associated ballistic parameters presented in FIG. 18. The method begins in block 1800 and proceeds to block 1800-A where a target is acquired, and then to block 1800-B where the shooter adjusts the scope to his preferred magnification, focus and night-vision settings by following the adjustment methods described earlier. After a shot is fired, the method proceeds to block 1810-A where the POAI is set in a first position so that a first POA coincides with a first POI. Next, in block 1820-A, one or more associated ballistic parameters are acquired. Associated ballistic parameters can be ballistic parameters sensed substantially contemporaneously with the firing of a shot, such that the parameters indicate the parameters that the projectile was subject to during its flight. The ballistic parameters may be received from various devices that are configured to sense ballistic parameters. In block 1830-A, the position of the POAI, which may be indicated by an absolute position (e.g., coordinates) or a relative position (e.g., an MOA adjustment from a reference point), preferred magnification, focus, night-vision and associated ballistic parameters are saved to create a zero baseline data point. In one embodiment, the zero baseline data point creates a point of reference from which other POAI adjustments are determined.

Moving to block 1840-A, after a second target is acquired and the preferred magnification, focus, and night-vision settings are performed, a second shot is then fired, and a secondary position of the POAI is set so the POA coincides with the POI of the second shot. In block 1850-A ballistic parameters associated with the second shot are acquired, and in block 1860-A, the secondary preferred magnification, focus, and night-vision settings as well as the position of the POAI and the associated ballistic parameters are saved. The secondary position of the POAI may be indicated as an adjustment relative to the position of the POAI associated with the zero baseline data point. For example, the secondary position of the POAI may indicate a number of MOA increments relative to the position of the POAI of the zero baseline data point. This may allow some or all the data points to be recalibrated by setting a new zero baseline data point. In block 1870-A, it is determined if another secondary data point is to be acquired. If not, the method proceeds to block 1880-A, where it stops. Otherwise, the method returns to block 1840-A and another secondary data point and associated magnification, focus and night-vision settings are acquired and saved. Any number of data points and their respective magnification, focus and night-vision settings may be acquired and saved.

FIG. 19-B illustrates one embodiment of a method of automatically adjusting the scope to the desired POA and magnification, focus, and night-vision settings of an optical assembly after such settings are saved. In block 1910-A, one or more ballistic parameters associated with a POA are obtained.

Moving to block 1920-A, a processor determines one or more preferred setting adjustments based on the yardage and ballistic parameters at hand. The processor determines the magnification, focus, and night-vision adjustments to be automatically performed based on the preferred settings that were manually adjusted, captured and recorded by the shooter in response to the actual distance to the target as well as the ambient light conditions that the target was subjected to at or near the time the settings were recorded. In one embodiment, the processor determines that a saved data point (FIG. 18) and its corresponding saved preferred visual settings (FIG. 19-A) have ballistic parameters that are substantially identical to the target ballistic parameters at hand. The processor may then automatically adjust the scope to the POA's corresponding preferred magnification, focus and night-vision settings. For example, if the target ballistic parameter is a range of 100 yards and a POA data point is associated with a range of 100 yards, the processor may then adjust the POAI to the position of the POAI associated with the data point (refer to FIG. 19) while at the same time making the appropriate adjustments to the scope magnification, focus and night-vision. In other embodiments, the processor may determine a POAI adjustment by interpolating data from a subset of the data points or all of the data points.

Moving to block 1930-A, the processor induces the adjustment of the magnification, focus, night-vision to their respective preferred saved settings. In addition, the processor induces the adjustment of the POAI so that the when the POA is indicated by the POAI the POA substantially corresponds with the POI (refer to FIG. 19). The inducement may be performed by sending a signal to an actuator mechanism that is coupled to the optical assembly.

Figure 23:
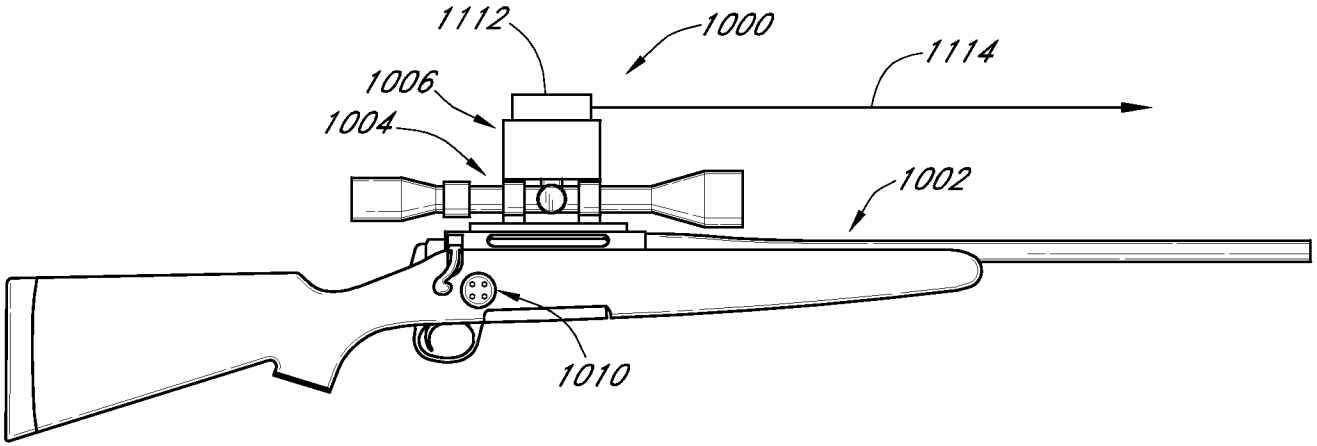
FIG. 23 illustrates an example where a scope adjustment system can be mounted to an example projectile launching device such as a rifle, where the scope adjustment system includes an adjustable light projection device such as a laser that can project a beam to a remotely located target
Figure 23A:
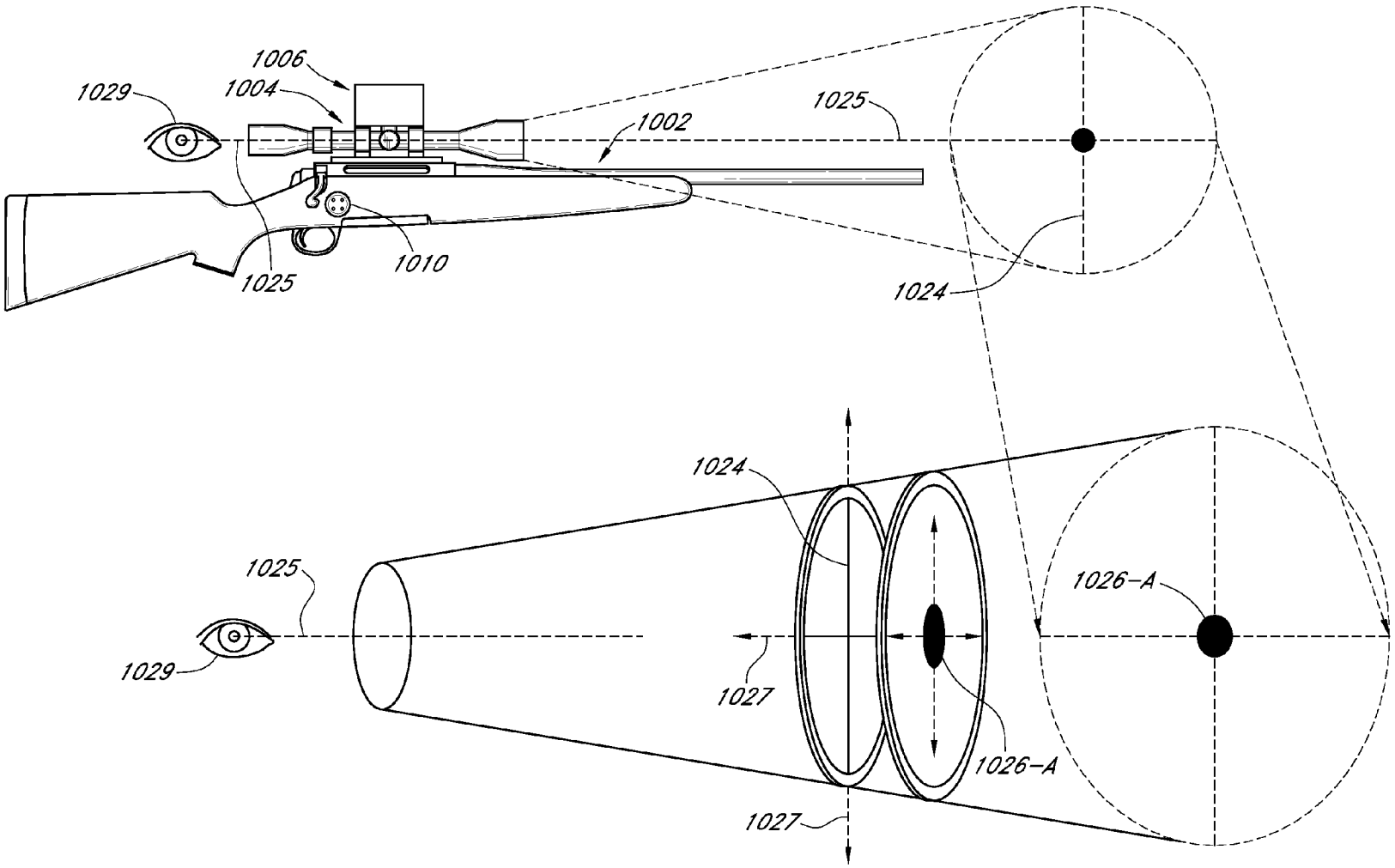
FIG. 23A illustrates one embodiment of a scope adjustment system mounted to an example projectile launching device such as a rifle, wherein the sighting system includes an adjustable Point of Aim Reference Dot (POARD) that is internally confined to the field of view (FOV) of the sighting system as opposed to being projected onto the target itself. The POARD provides a visual reference indicator in the field of view relative to the point of aim indicator, the point of aim coordinate, and the point of impact coordinate of the projectile.

FIG. 23 now shows one embodiment of a scope adjustment system 1000 that includes an adjustable light projection device 1112 that can project a beam 1114 to a target that is located remotely. In one embodiment, the light projection device 1112 is a laser, such that the beam 1114 is a laser beam. The laser can be a visible type (for example, HeNe laser), or other types such as an infrared laser (for which appropriate optical elements can be included so as to make the beam spot visible to the shooter).

In one embodiment as shown in FIG. 23, the light projection device 1112 is depicted as being mounted to an example adjustment mechanism 1006 which is in turn coupled to an example scope 1004. The scope 1004 is shown to be mounted to an example projectile launching device such as a rifle 1002. In other embodiments, the light projection device 1112 can be mounted at other locations, such as but not limited to, the scope 1004 or the rifle 1002.

In one embodiment, the adjustment mechanism 1006 can be any of the various embodiments described above, or any other devices that provide similar functionalities. For example, as shown in FIG. 23, the adjustment mechanism 1006 can be controlled by a remote controller 1110 in a manner similar to that described above (for example, the remote controller 110 and the adjustment mechanism 106 of FIG. 1).

In one embodiment, the light projection device 1112 is adjustable so that the direction of the beam 1114 can be adjusted with respect to an optical axis of the scope 1004. Such adjustment can be achieved in a number of known ways, either manually or via some powered component(s). In one embodiment, the adjustment can be made so that the beam 1114 can move along directions having two orthogonal transverse components. In one embodiment, such adjustment of the beam 1114 can be achieved by a remote controller similar to the controller 1110. In one embodiment, the controller can be configured to toggle between adjustments of the scope 1004 and the light projection device 1112.

FIG. 23-A now shows one embodiment of a scope adjustment system that includes a Point of Aim Reference Dot (POARD) 1026-A that can be adjusted using the remote controller 1010. The POARD can be used in conjunction with but independent of the sighting system's POAI 1024. The POAI can also be adjusted using the same remote controller 1010, but independent of the POARD 1026-A.

In one embodiment as shown in FIG. 23-A, the internal adjustable POARD 1026-A is depicted as being integrated into the internal optical assembly of the scope 1004, which can be viewed by the shooter 1029 when looking through the sighting system's field of view and optical axis 1025.

In one embodiment, the POARD 1026-A is adjustable so that the position of the POARD can be adjusted with respect to the optical axis of the sighting system's field of view 1025. Such adjustment can be achieved in a number of known ways, either manually or via some powered component(s). The powered components can be turned-on (refer to 582-G, FIG. 14-2), when the POARD 1026-A is needed for making the reticle adjustments from the POAC to the POIC and then turned-off when the POARD 1026-A is no longer needed for making such POA reference point adjustments. In one embodiment, the vertical and/or horizontal adjustments can be made so that the POARD 1026-A can move along directions having two orthogonal transverse components 1027. In one embodiment, such adjustment of the reference dot 1026-A can be achieved by a remote controller 1010. In one embodiment, the remote controller 1010 can be configured to toggle between adjustments of the POAI 1024 and the Point of Aim Reference Dot (POARD) 1026-A.

Figure 24A:
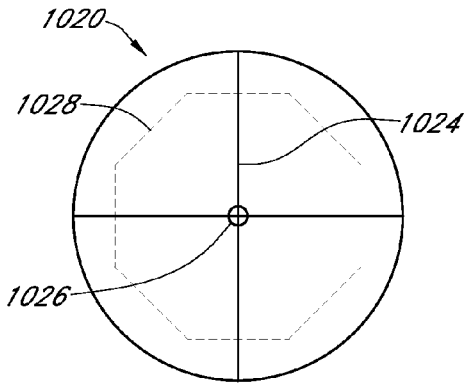
FIGS. 24A-D illustrate by example how a laser beam and/or the internally confined POARD can provide a visual reference indicator in the field of view of the target to facilitate the adjustment of the point of aim.

FIGS. 24A-24D now show an example sequence of how the Point of Aim Reference Dot (POARD) and the adjust mechanism 1006 (FIG. 23) can be used in conjunction with the scope 1004 (FIGS. 23 and 23-A). The source of the visible POARD can be, for example, a light projection device 1112 (FIG. 23) or an internally integrated reference dot (that is independent of the reticle) 1026-A (FIG. 23-A). FIG. 24A shows one embodiment of a first example field of view 1020 through an example scope, where an example reticle 1024 (for example, a cross-hair) that defines a point-of-aim (POA) that is placed on a selected location on a target 1028. A beam spot 1026, projected from the light projection device 1112, is depicted as being positioned (by adjusting the light projection device 1112) so as to be at or near the POA. In this example sequence, a shot is made while the POA is positioned at the selected location on the target 1028. In other embodiments, the beam spot might not actually be projected onto a target but instead may be an internal reference dot similar to 1026-A (FIG. 23-A) that is visible only when looking 1029 through the scope 1004 field of view 1025.

Figure 24B:
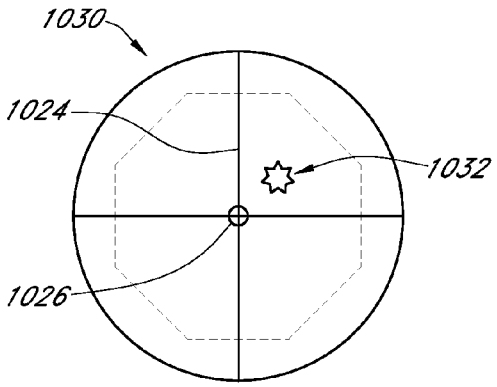

FIG. 24B shows a second example field of view 1030 depicting a point-of-impact (POIC) 1032 of the projectile is different than the POAC (POAI 1024). At this stage, the beam spot 1026 substantially coincides with the POA 1024 because the beam spot 1026 has not been adjusted from the first example field of view 1020. Based on the difference in the POAC 1024 and the POIC 1032, the POAI 1024 can be moved towards the POIC 1032 in a manner described above. In one embodiment, the POAI 1024 can be moved substantially independently from the beam spot 1026, so that the beam spot 1026 remains at the pre-adjustment position of the FIGS. 24A and 24B while the POAI 1024 is moved towards the POI 1032. One can see that the beam spot 1026 can function as a reference marker at the target 1028 that indicates where the last POA had been as the POAI 1024 is moved. In other embodiments, the beam spot might not actually be projected onto a target but instead may be a reference point or dot such as 1026-A (FIG. 23-A) which is visible only when looking 1025 through the scope 1004 field of view 1025.

The foregoing feature—where the beam spot 1026 provides a visual reference with respect to the POAI—can aid a shooter to re-establish a desired field of view after the first shot. For example, suppose that the shooter's attention is interrupted while the POAI 1024 is in the process of being moved. The shooter can re-establish the original field of view by positioning the beam spot 1026 at or near the original POA on the target 1028. Such positioning of the beam spot 1026 on the target can be facilitated by, for example, identifiable features on or about the target 1028 that the shooter can recall. A desired angular orientation of the field of view with respect to the target 1028 can be facilitated by the POAI 1024. Once the beam spot 1026 is positioned at or near the original POA, the POAI 1024 should be at or near the position (between the original POA and the POI 1032) before the shooter was interrupted. The shooter can then resume the movement of the POAI 1024 to the POI 1032 made by the first shot. In other embodiments, the beam spot might not actually be projected onto a target but instead may be a reference point 1026A that is visible only when looking through the scope.

Figure 24C:
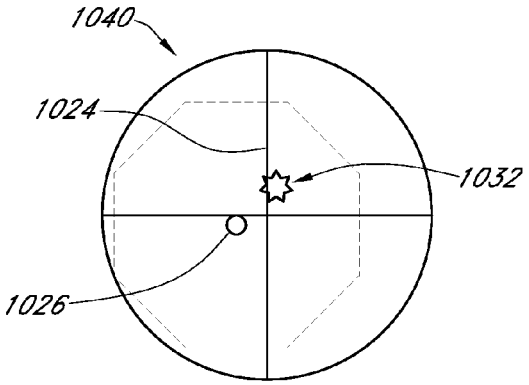
Figure 24D:
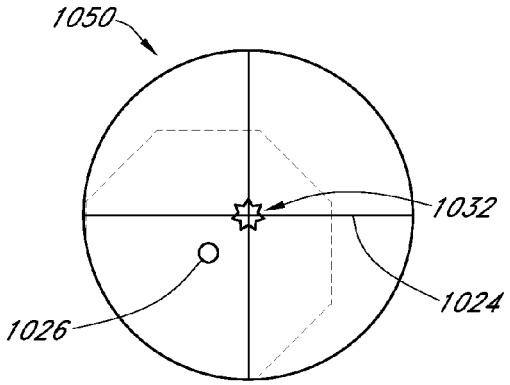

FIG. 24C shows a third example field of view 1040, where the POAI 1024 is being moved from the original POA (referenced by the beam spot 1026) to the POI 1032. FIG. 24D shows a fourth example field of view 1050, where the POAI 1024 has been moved to the POI 1032, thereby establishing a new POA. The beam spot 1026 is shown to indicate the previous POA in the field of view 1050. If the shooter desires, the beam spot 1026 can be moved to the new POA, so as to provide a reference marker for the next adjustment (if necessary). In other embodiments, the beam spot might not actually be projected onto a target but instead may be a spot (reference point) 1026-A that is visible only when looking through the scope.

Some scope devices have a secondary visual indicator (such as a second reticle) in the scope itself. Use of such an indicator as a reference point on the target can depend on the shooter's viewing eye with respect to the scope. Use of a projected beam, however, provides a reference indicator at the target itself, and the reference beam spot at the target does not depend on the shooter's viewing angle. However, the use of a secondary visual indicator located within the scope itself 1026-A can be used in place of or in conjunction with a projected beam of light without departing from the spirit of the present teachings. Such internal secondary visual indicators can be an illuminated dot, a secondary traditional cross-hair or any other POAI design. Furthermore, the use of a light projection on a target may be illegal in some government territories when used in conjunction with hunting. In this situation, the option to use an internal secondary visual indicator would be preferable over a projected beam of light. Furthermore, a projected beam of light on a target may be hard to decipher when the target is in direct sunlight. In such cases, the use of a projected beam of light may be limited in distance during daylight hours. In this example, the use of an internal secondary indicator may be preferable to a projected beam of light.

Figure 25:
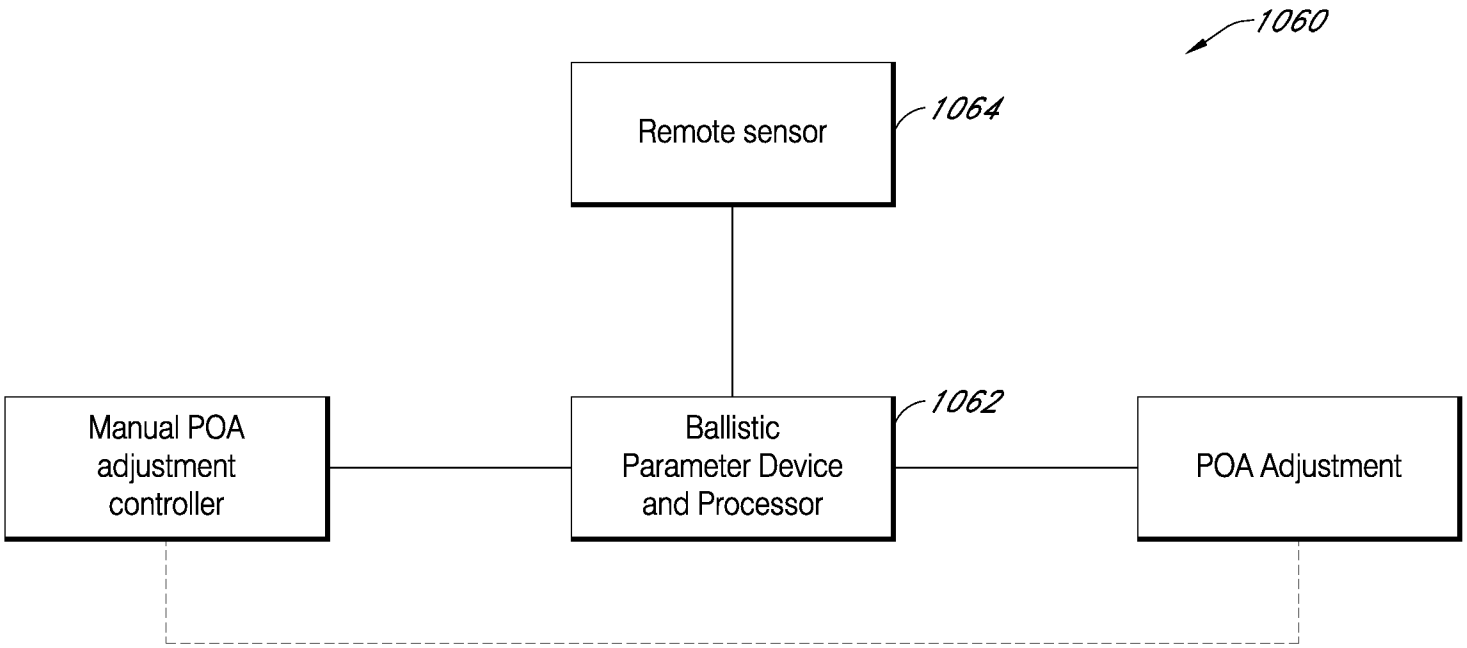
FIG. 25 now shows one embodiment of a scope adjustment system that is configured to be able to capture, and record the one or more ballistic parameters from a remote sensor. Together, the parameters captured from the one or more remote sensors as well as the parameters captured by the one or more embodied sensors (e.g., FIG. 14A) make up a set of parameters (SOP) that affect the flight of the projectile. The SOP obtained in such a manner are then stored in memory, along with its relative point of impact coordinate and its point of aim indicator adjustment command, and then later automatically retrieved by the processor so as to automatically adjust the point of aim indicator to the point of impact coordinate.

In one embodiment as shown in FIG. 25, the scope adjustment system 1060 includes a processor 1062 that is configured to receive information from a remote sensor 1064. Such information can facilitate determination of one or more ballistic parameters at or near the location of the remote sensor 1064. Ballistic parameters can include, by way of examples, wind speed and direction, and the air properties such as relative humidity, barometric pressure, and temperature. Once such ballistic parameters are determined by the processor 1062, adjustment of the scope can be achieved in a manner similar to that described above in reference to FIG. 14A.

In one embodiment, the remote sensor 1064 transmits the ballistic information to the scope assembly in a wireless manner. In another embodiment, such transmission is achieved in a wire-based manner.

As one can appreciate, having one or more of the foregoing remote sensors 1064 positioned generally along the projectile's intended trajectory can provide accurate and relevant ballistic information. Usefulness of such information from the field can be appreciated in an example situation where the environmental condition about the shooter is significantly different than that along the substantial portion of the trajectory.

Figure 26:
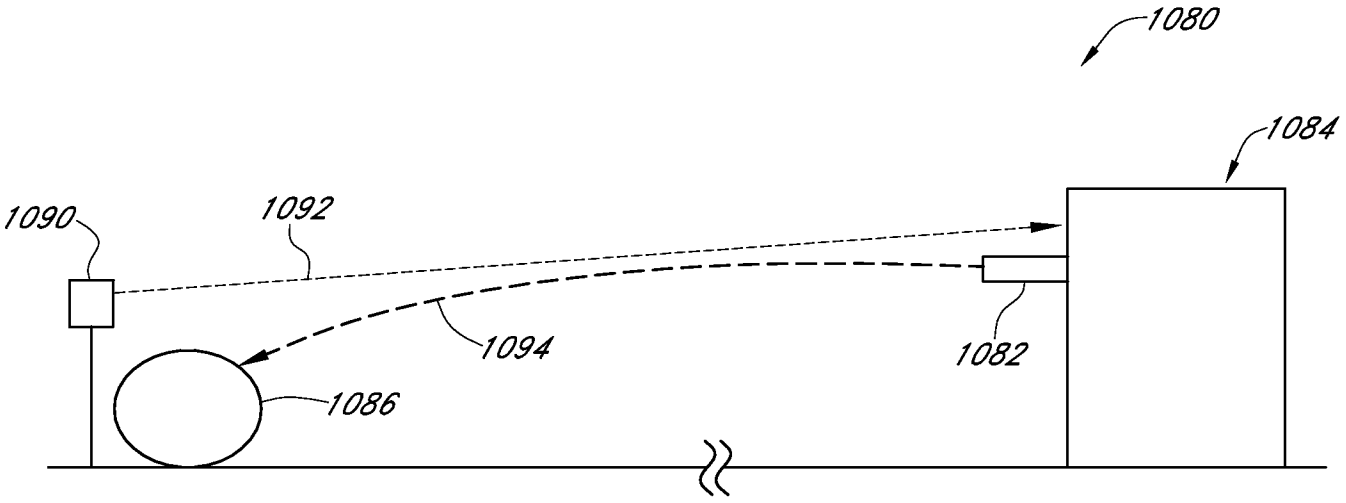
FIG. 26 illustrates one embodiment of a scope adjustment system that is configured to be able to obtain one or more ballistic parameters from a remote sensor that is strategically placed in a remote location, the remote location of which is accurately representative of the parameters that the projectile is subjected to while in flight to the target. Strategic placement of remote sensors in the field allow the shooter and the sighting system to accurately capture the actual parameters that the projectile is affected by which in turn allows the processor (e.g., FIG. 25) to accurately predict where the point of impact coordinate (POIC) of the projectile will occur, and then automatically adjust the point of aim indicator to the POIC (e.g., FIGS. 14C-4 and 14C-5).

FIG. 26 shows one such example situation 1080 where one or more remote sensors 1090 can provide accurate field condition information for the purpose of trajectory estimation. A shooter (not shown) is depicted as being positioned in a partially enclosed structure 1084. Such structure can block the wind and also provide a warmer condition than that of outside. The shooter is depicted as shooting a rifle 1082 having scope adjustment system 1060 (FIG. 25) at a target 1086. If the shooter provides one or more ballistic parameters to the scope adjustment system 1060 based on the condition inside the enclosed structure 1084, the resulting trajectory estimate may be significantly different than what would result if the outside condition is used.

In one embodiment shown in FIG. 26, the scope adjustment system 1060 of FIG. 25 can include a remote sensor 1090 that is positioned at or near the target 1086. If the target 1086 is substantially stationary (such as in a target shooting situation), then such positioning of the remote sensor 1090 can be relatively easy, since the shooting direction and range are generally predetermined. If the target 1086 moves (such as in a hunting situation), one or more remote sensors 1090 can be placed along a likely direction and range of shooting.

As further shown in FIG. 26, the remote sensor 1090 is depicted as transmitting (line 1092) a signal to the scope adjustment configured rifle 1082. The signal 1092 can be processed in a manner described herein so as to make adjustments that yield a trajectory 1094 to the target 1086.

The present disclosure describes various features, no single one of which is solely responsible for the benefits described herein. It will be understood that various features described herein may be combined, modified, or omitted, as would be apparent to one of ordinary skill. Other combinations and sub-combinations than those specifically described herein will be apparent to one of ordinary skill, and are intended to form a part of this disclosure. Various methods are described herein in connection with various flowchart steps and/or phases. It will be understood that in many cases, certain steps and/or phases may be combined together such that multiple steps and/or phases shown in the flowcharts can be performed as a single step and/or phase. Also, certain steps and/or phases can be broken into additional sub-components to be performed separately. In some instances, the order of the steps and/or phases can be rearranged and certain steps and/or phases may be omitted entirely. Also, the methods described herein are to be understood to be open-ended, such that additional steps and/or phases to those shown and described herein can also be performed.

Some aspects of the systems and methods described herein can advantageously be implemented using, for example, computer software, hardware, firmware, or any combination of computer software, hardware, and firmware. Computer software can comprise computer executable code stored in a computer readable medium (e.g., non-transitory computer readable medium) that, when executed, performs the functions described herein. In some embodiments, computer-executable code is executed by one or more general purpose computer processors. A skilled artisan will appreciate, in light of this disclosure, that any feature or function that can be implemented using software to be executed on a general purpose computer can also be implemented using a different combination of hardware, software, or firmware. For example, such a module can be implemented completely in hardware using a combination of integrated circuits. Alternatively or additionally, such a feature or function can be implemented completely or partially using specialized computers designed to perform the particular functions described herein rather than by general purpose computers.

Multiple distributed computing devices can be substituted for any one computing device described herein. In such distributed embodiments, the functions of the one computing device are distributed (e.g., over a network) such that some functions are performed on each of the distributed computing devices.

Some embodiments may be described with reference to equations, algorithms, and/or flowchart illustrations. These methods may be implemented using computer program instructions executable on one or more computers. These methods may also be implemented as computer program products either separately, or as a component of an apparatus or system. In this regard, each equation, algorithm, block, or step of a flowchart, and combinations thereof, may be implemented by hardware, firmware, and/or software including one or more computer program instructions embodied in computer-readable program code logic. As will be appreciated, any such computer program instructions may be loaded onto one or more computers, including without limitation a general purpose computer or special purpose computer, or other programmable processing apparatus to produce a machine, such that the computer program instructions which execute on the computer(s) or other programmable processing device(s) implement the functions specified in the equations, algorithms, and/or flowcharts. It will also be understood that each equation, algorithm, and/or block in flowchart illustrations, and combinations thereof, may be implemented by special purpose hardware-based computer systems which perform the specified functions or steps, or combinations of special purpose hardware and computer-readable program code logic means.

Furthermore, computer program instructions, such as embodied in computer-readable program code logic, may also be stored in a computer readable memory (e.g., a non-transitory computer readable medium) that can direct one or more computers or other programmable processing devices to function in a particular manner, such that the instructions stored in the computer-readable memory implement the function(s) specified in the block(s) of the flowchart(s). The computer program instructions may also be loaded onto one or more computers or other programmable computing devices to cause a series of operational steps to be performed on the one or more computers or other programmable computing devices to produce a computer-implemented process such that the instructions which execute on the computer or other programmable processing apparatus provide steps for implementing the functions specified in the equation(s), algorithm(s), and/or block(s) of the flowchart(s).

Some or all of the methods and tasks described herein may be performed and fully automated by a computer system. The computer system may, in some cases, include multiple distinct computers or computing devices (e.g., physical servers, workstations, storage arrays, etc.) that communicate and interoperate over a network to perform the described functions. Each such computing device typically includes a processor (or multiple processors) that executes program instructions or modules stored in a memory or other non-transitory computer-readable storage medium or device. The various functions disclosed herein may be embodied in such program instructions, although some or all of the disclosed functions may alternatively be implemented in application-specific circuitry (e.g., ASICs or FPGAs) of the computer system. Where the computer system includes multiple computing devices, these devices may, but need not, be co-located. The results of the disclosed methods and tasks may be persistently stored by transforming physical storage devices, such as solid state memory chips and/or magnetic disks, into a different state.

Unless the context clearly requires otherwise, throughout the description and the claims, the words "comprise," "comprising," and the like are to be construed in an inclusive sense, as opposed to an exclusive or exhaustive sense; that is to say, in the sense of "including, but not limited to." The word "coupled", as generally used herein, refers to two or more elements that may be either directly connected, or connected by way of one or more intermediate elements. Additionally, the words "herein," "above," "below," and words of similar import, when used in this application, shall refer to this application as a whole and not to any particular portions of this application. Where the context permits, words in the above Detailed Description using the singular or plural number may also include the plural or singular number respectively. The word "or" in reference to a list of two or more items, that word covers all of the following interpretations of the word: any of the items in the list, all of the items in the list, and any combination of the items in the list. The word "exemplary" is used exclusively herein to mean "serving as an example, instance, or illustration." Any implementation described herein as "exemplary" is not necessarily to be construed as preferred or advantageous over other implementations.

The disclosure is not intended to be limited to the implementations shown herein. Various modifications to the implementations described in this disclosure may be readily apparent to those skilled in the art, and the generic principles defined herein may be applied to other implementations without departing from the spirit or scope of this disclosure. The teachings of the invention provided herein can be applied to other methods and systems, and are not limited to the methods and systems described above, and elements and acts of the various embodiments described above can be combined to provide further embodiments. Accordingly, the novel methods and systems described herein may be embodied in a variety of other forms; furthermore, various omissions, substitutions and changes in the form of the methods and systems described herein may be made without departing from the spirit of the disclosure. The accompanying claims and their equivalents are intended to cover such forms or modifications as would fall within the scope and spirit of the disclosure.

What is claimed is:

1. A system for sighting of a projectile-launching device, the system comprising:

an aiming system coupled to the projectile-launching device, the aiming system including a display that shows a field of view, a point of aim indicator and an adjustment mechanism configured to change point-of-aim indicator of the projectile-launching device visible to a user and indicative of the aim point of the aiming system in the field of view based on an input signal;

a gimbaled robotic apparatus configured to receive and provide movable support for the projectile-launching device, the gimbaled robotic apparatus further configured to point the projectile-launching device to a desired direction;

a trigger activation device configured to allow launching of a projectile from the projectile-launching device; and a control system in communication with the aiming system, the gimbaled robotic apparatus, and the trigger activation device, the control system configured to receive information from the aiming system representative of a current point of aim setting, the control system further configured to generate and send the input signal for the aiming system to effectuate the change in point of aim, the control system further configured to generate and send a launch signal to the trigger activation device to launch the projectile from a remote location when the change in point of aim is effectuated by the aiming system wherein the aiming system is further configured to move the gimbaled robotic apparatus and projective launching device in-synch with the point of aim indicator so as to automatically adjust a point of aim of the projectile launching device to a point of impact coordinate that corresponds to the point of aim indicator.

2. The system of claim 1, wherein the aiming system includes a field of view (FOV) that can be electronically transmitted and viewed from the remote location.

3. The system of claim 2, wherein the control system is further configured to generate the signal based on an operator viewing the field of view at the remote location and entering a command into the control system.

4. The system of claim 1, wherein the field of view of the aiming system includes a friend-or-foe identifier configured to identify a target as a friend or a foe by visually communicating with the shooter as to whether or not a target is friendly; and an over-ride feature that prevents the shooter from engaging the trigger activation device in the event the target is determined to be friendly.

5. The system of claim 1, wherein the point of impact coordinate is for a static or moving target.

6. The system of claim 1, wherein the gimbaled robotic apparatus is mounted on a static platform or a moving platform.

7. The system of claim 1, further comprising a user interface in communication with the control system, the user interface configured to allow operation of the projectile-launching device by an operator with disability or limited physical capability.

8. The system of claim 1, wherein the aiming system and the control system are configured to automatically capture, record, and save a set of parameters having information about a point-of-aim-coordinate (POAC) of the point of aim indicator and the point of impact coordinate when the projectile is launched.

9. The system of claim 8, wherein the control system is further configured to calculate a new point of aim indicator based on the point of impact coordinate of the projectile.

10. The system of claim 1, further comprising one or more remote sensors located away from the projectile-launching device and in communication with the control system, the one or more remote sensors configured to sense and provide one or more conditions experienced by the projectile during its flight.

11. The system of claim 10, wherein the one or more remote sensors are configured to provide information about at least one of wind speed, wind direction, temperature, humidity, and pressure.

12. The system of claim 1, wherein the aiming system includes at least one of a variable-magnification optical component, an auto-focus component, a night-vision sensor, an infra-red (IR) sensor, and a thermal imaging sensor.

13. The system of claim 1, wherein the aiming system includes a motion sensing device.

14. The system of claim 13, wherein the motion sensing device includes a radar device.

15. The system of claim 1, wherein the projectile-launching device includes a rifle.

* * * * *